US008203507B2

(12) United States Patent
Itakura et al.

(10) Patent No.: US 8,203,507 B2
(45) Date of Patent: Jun. 19, 2012

(54) DRIVE METHOD OF PLASMA DISPLAY PANEL

(75) Inventors: Shunsuke Itakura, Chuo (JP); Mitsuhiro Ishizuka, Chuo (JP); Kazuo Yahagi, Chuo (JP); Tetsuya Shigeta, Chuo (JP); Hirofumi Honda, Chuo (JP)

(73) Assignee: Panasonic Corporation, Osaka (JP)

( * ) Notice: Subject to any disclaimer, the term of this patent is extended or adjusted under 35 U.S.C. 154(b) by 1147 days.

(21) Appl. No.: 12/039,968

(22) Filed: Feb. 29, 2008

(65) Prior Publication Data

US 2008/0211741 A1 Sep. 4, 2008

(30) Foreign Application Priority Data

Mar. 2, 2007 (JP) ..... 2007-052773

(51) Int. Cl.
*G09G 3/28* (2006.01)

(52) U.S. Cl. ..... 345/63; 345/37; 345/41; 345/60

(58) Field of Classification Search ..... 345/63, 345/37, 41, 60
See application file for complete search history.

(56) References Cited

U.S. PATENT DOCUMENTS 3,827,025 A * 7/1974 Mauch et al. ..... 382/201
6,417,824 B1 * 7/2002 Tokunaga et al. ..... 345/60
6,465,970 B2 * 10/2002 Nagakubo et al. ..... 315/169.4
6,479,943 B2 * 11/2002 Shigeta et al. ..... 315/169.4
6,614,413 B2 * 9/2003 Tokunaga et al. ..... 345/63
6,630,796 B2 * 10/2003 Tokunaga et al. ..... 315/169.4
6,642,911 B2 * 11/2003 Shigeta et al. ..... 345/60
7,053,872 B2 * 5/2006 Iwami ..... 345/60
7,626,336 B2 * 12/2009 Hai et al. ..... 313/587
7,667,670 B2 * 2/2010 Kitagawa et al. ..... 345/60
7,701,415 B2 * 4/2010 Gotoda et al. ..... 345/63
2002/0012075 A1 * 1/2002 Nagakubo et al. ..... 348/797
2002/0014847 A1 * 2/2002 Nagakubo et al. ..... 315/169.1
2002/0054000 A1 * 5/2002 Tokunaga et al. ..... 345/60

(Continued)

FOREIGN PATENT DOCUMENTS

EP 1 575 020 A2 3/2005
EP 1 591 988 A2 4/2005

(Continued)

OTHER PUBLICATIONS

European Search Report dated Jul. 7, 2009.

*Primary Examiner* — Bipin Shalwala
*Assistant Examiner* — Afroza Chowdhury
(74) *Attorney, Agent, or Firm* — Sughrue Mion, PLLC

(57) ABSTRACT

A drive method of a plasma display panel that can increase the dark contrast, without causing a discharge failure. When a discharge cell that assumes a black display state in a first field from among first and a second fields that are adjacent in time and switches to a display state representing a brightness other than black in the second field is detected as a lighting transition cell, at least one drive of the below-described first and second forced lighting drives is executed. In the first forced lighting drive, the lighting transition cell is forcibly set into the lighting mode only in the address process of a predetermined subfield within the field in the first field. In the second forced lighting drive, an adjacent discharge cell that is adjacent to the lighting transition cell is forcibly set into the lighting mode only in the address process of the predetermined subfield in the second field.

29 Claims, 26 Drawing Sheets

U.S. PATENT DOCUMENTS

| | | | | |
|---|---|---|---|---|
| 2002/0180665 | A1* | 12/2002 | Awamoto et al. | 345/60 |
| 2004/0233129 | A1* | 11/2004 | Iwami | 345/60 |
| 2008/0024477 | A1* | 1/2008 | Sasaki et al. | 345/208 |
| 2008/0084407 | A1* | 4/2008 | Hashikawa | 345/205 |
| 2008/0284686 | A1* | 11/2008 | Mashita et al. | 345/63 |
| 2009/0002276 | A1* | 1/2009 | Tanaka | 345/60 |
| 2009/0021503 | A1* | 1/2009 | Tanaka | 345/205 |

FOREIGN PATENT DOCUMENTS

| | | | |
|---|---|---|---|
| EP | 1968035 | * | 10/2008 |
| JP | 2000-200064 | A | 7/2000 |
| JP | 2000-356971 | A | 12/2000 |
| JP | 2001312244 | A | 11/2001 |
| JP | 200654160 | A | 2/2006 |

* cited by examiner

III – III SECTION

IV – IV SECTION

FIG. 7

GRADATION DRIVE

DISPLAY BRIGHTNESS

| | DATA CONVERSION TABLE | | | | | | | | | | | | | | | LIGHT EMISSION PATTERN | | | | | | | | | | | | | | |
|---|---|---|---|---|---|---|---|---|---|---|---|---|---|---|---|---|---|---|---|---|---|---|---|---|---|---|---|---|---|---|
| | PDs | GD, GGD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1st | 0000 | 0 | 0 | 0 | 0 | 0 | 0 | 0 | 0 | 0 | 0 | 0 | 0 | 0 | 0 | | | | | | | | | | | | | | | 0 |
| 2nd | 0001 | 1 | 1 | 0 | 0 | 0 | 0 | 0 | 0 | 0 | 0 | 0 | 0 | 0 | 0 | ◎ | ● | | | | | | | | | | | | | 1 |
| 3rd | 0010 | 1 | 0 | 1 | 0 | 0 | 0 | 0 | 0 | 0 | 0 | 0 | 0 | 0 | 0 | ◎ | ○ | ● | | | | | | | | | | | | 3 |
| 4th | 0011 | 1 | 0 | 0 | 1 | 0 | 0 | 0 | 0 | 0 | 0 | 0 | 0 | 0 | 0 | ◎ | ○ | ○ | ● | | | | | | | | | | | 9 |
| 5th | 0100 | 1 | 0 | 0 | 0 | 1 | 0 | 0 | 0 | 0 | 0 | 0 | 0 | 0 | 0 | ◎ | ○ | ○ | ○ | ● | | | | | | | | | | 17 |
| 6th | 0101 | 1 | 0 | 0 | 0 | 0 | 1 | 0 | 0 | 0 | 0 | 0 | 0 | 0 | 0 | ◎ | ○ | ○ | ○ | ○ | ● | | | | | | | | | 27 |
| 7th | 0110 | 1 | 0 | 0 | 0 | 0 | 0 | 1 | 0 | 0 | 0 | 0 | 0 | 0 | 0 | ◎ | ○ | ○ | ○ | ○ | ○ | ● | | | | | | | | 39 |
| 8th | 0111 | 1 | 0 | 0 | 0 | 0 | 0 | 0 | 1 | 0 | 0 | 0 | 0 | 0 | 0 | ◎ | ○ | ○ | ○ | ○ | ○ | ○ | ● | | | | | | | 55 |
| 9th | 1000 | 1 | 0 | 0 | 0 | 0 | 0 | 0 | 0 | 1 | 0 | 0 | 0 | 0 | 0 | ◎ | ○ | ○ | ○ | ○ | ○ | ○ | ○ | ● | | | | | | 73 |
| 10th | 1001 | 1 | 0 | 0 | 0 | 0 | 0 | 0 | 0 | 0 | 1 | 0 | 0 | 0 | 0 | ◎ | ○ | ○ | ○ | ○ | ○ | ○ | ○ | ○ | ● | | | | | 95 |
| 11th | 1010 | 1 | 0 | 0 | 0 | 0 | 0 | 0 | 0 | 0 | 0 | 1 | 0 | 0 | 0 | ◎ | ○ | ○ | ○ | ○ | ○ | ○ | ○ | ○ | ○ | ● | | | | 119 |
| 12th | 1011 | 1 | 0 | 0 | 0 | 0 | 0 | 0 | 0 | 0 | 0 | 0 | 1 | 0 | 0 | ◎ | ○ | ○ | ○ | ○ | ○ | ○ | ○ | ○ | ○ | ○ | ● | | | 147 |
| 13th | 1100 | 1 | 0 | 0 | 0 | 0 | 0 | 0 | 0 | 0 | 0 | 0 | 0 | 1 | 0 | ◎ | ○ | ○ | ○ | ○ | ○ | ○ | ○ | ○ | ○ | ○ | ○ | ● | | 179 |
| 14th | 1101 | 1 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 215 |
| 15th | 1110 | 1 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : SELECTIVE WRITE ADDRESS DISCHARGE + SUSTAIN DISCHARGE EMISSION

○ : SUSTAIN DISCHARGE EMISSION

● : SELECTIVE ERASE ADDRESS DISCHARGE

FIG. 22

GRADATION DRIVE

DISPLAY BRIGHTNESS

| | DATA CONVERSION TABLE | | | | | | | | | | | | | | | LIGHT EMISSION PATTERN | | | | | | | | | | | | | | |
|---|---|---|---|---|---|---|---|---|---|---|---|---|---|---|---|---|---|---|---|---|---|---|---|---|---|---|---|---|---|---|
| | PDs | GD, GGD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1st | 0000 | 0 | 0 | 0 | 0 | 0 | 0 | 0 | 0 | 0 | 0 | 0 | 0 | 0 | 0 | | | | | | | | | | | | | | | 0 |
| 2nd | 0001 | 1 | 0 | 0 | 0 | 0 | 0 | 0 | 0 | 0 | 0 | 0 | 0 | 0 | 0 | □ | | | | | | | | | | | | | | $\alpha$ |
| 3rd | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4th | 0011 | 1 | 1 | 1 | 0 | 0 | 0 | 0 | 0 | 0 | 0 | 0 | 0 | 0 | 0 | □ | ◎ | ● | | | | | | | | | | | | $1+\alpha$ |
| 5th | 0100 | 1 | 1 | 0 | 1 | 0 | 0 | 0 | 0 | 0 | 0 | 0 | 0 | 0 | 0 | □ | ◎ | ○ | ● | | | | | | | | | | | $3+\alpha$ |
| 6th | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | $9+\alpha$ |
| 7th | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | $17+\alpha$ |
| 8th | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | $27+\alpha$ |
| 9th | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | $39+\alpha$ |
| 10th | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | $55+\alpha$ |
| 11th | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | $77+\alpha$ |
| 12th | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | $103+\alpha$ |
| 13th | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | $133+\alpha$ |
| 14th | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | $169+\alpha$ |
| 15th | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | $209+\alpha$ |
| 16th | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | $255+\alpha$ |

□ : WRITE ADDRESS DISCHARGE + VERY SMALL LIGHT EMISSION DISCHARGE

◎ : WRITE ADDRESS DISCHARGE + SUSTAIN DISCHARGE EMISSION

○ : SUSTAIN DISCHARGE EMISSION

● : ERASE ADDRESS DISCHARGE $\alpha < 1$

FIG. 26

| GRADATION DRIVE | DATA CONVERSION TABLE | | | | | | | | | | | | | | | LIGHT EMISSION PATTERN | | | | | | | | | | | | | | DISPLAY BRIGHTNESS |
|---|---|---|---|---|---|---|---|---|---|---|---|---|---|---|---|---|---|---|---|---|---|---|---|---|---|---|---|---|---|---|
| | PDs | GD, GGD | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1st | 0000 | 0 | 0 | 0 | 0 | 0 | 0 | 0 | 0 | 0 | 0 | 0 | 0 | 0 | 0 | | | | | | | | | | | | | | | 0 |
| 2nd | 0001 | 1 | 0 | 0 | 0 | 0 | 0 | 0 | 0 | 0 | 0 | 0 | 0 | 0 | 0 | □ | | | | | | | | | | | | | | α |
| 3rd | 0010 | 0 | 1 | 0 | 0 | 0 | 0 | 0 | 0 | 0 | 0 | 0 | 0 | 0 | 0 | | ◎ | | | | | | | | | | | | | 1 |
| 4th | 0011 | 0 | 1 | 1 | 1 | 0 | 0 | 0 | 0 | 0 | 0 | 0 | 0 | 0 | 0 | | ◎ | ◎ | ● | | | | | | | | | | | 2 |
| 5th | 0100 | 0 | 1 | 1 | 0 | 1 | 0 | 0 | 0 | 0 | 0 | 0 | 0 | 0 | 0 | | ◎ | ◎ | ○ | ● | | | | | | | | | | 4 |
| 6th | 0101 | 0 | 1 | 1 | 0 | 0 | 1 | 0 | 0 | 0 | 0 | 0 | 0 | 0 | 0 | | ◎ | ◎ | ○ | ○ | ● | | | | | | | | | 12 |
| 7th | 0110 | 0 | 1 | 1 | 0 | 0 | 0 | 1 | 0 | 0 | 0 | 0 | 0 | 0 | 0 | | ◎ | ◎ | ○ | ○ | ○ | ● | | | | | | | | 24 |
| 8th | 0111 | 0 | 1 | 1 | 0 | 0 | 0 | 0 | 1 | 0 | 0 | 0 | 0 | 0 | 0 | | ◎ | ◎ | ○ | ○ | ○ | ○ | ● | | | | | | | 38 |
| 9th | 1000 | 0 | 1 | 1 | 0 | 0 | 0 | 0 | 0 | 1 | 0 | 0 | 0 | 0 | 0 | | ◎ | ◎ | ○ | ○ | ○ | ○ | ○ | ● | | | | | | 56 |
| 10th | 1001 | 0 | 1 | 1 | 0 | 0 | 0 | 0 | 0 | 0 | 1 | 0 | 0 | 0 | 0 | | ◎ | ◎ | ○ | ○ | ○ | ○ | ○ | ○ | ● | | | | | 78 |
| 11th | 1010 | 0 | 1 | 1 | 0 | 0 | 0 | 0 | 0 | 0 | 0 | 1 | 0 | 0 | 0 | | ◎ | ◎ | ○ | ○ | ○ | ○ | ○ | ○ | ○ | ● | | | | 104 |
| 12th | 1011 | 0 | 1 | 1 | 0 | 0 | 0 | 0 | 0 | 0 | 0 | 0 | 1 | 0 | 0 | | ◎ | ◎ | ○ | ○ | ○ | ○ | ○ | ○ | ○ | ○ | ● | | | 134 |
| 13th | 1100 | 0 | 1 | 1 | 0 | 0 | 0 | 0 | 0 | 0 | 0 | 0 | 0 | 1 | 0 | | ◎ | ◎ | ○ | ○ | ○ | ○ | ○ | ○ | ○ | ○ | ○ | ● | | 170 |
| 14th | 1101 | 0 | 1 | 1 | 0 | 0 | 0 | 0 | 0 | 0 | 0 | 0 | 0 | 0 | 1 | | ◎ | ◎ | ○ | ○ | ○ | ○ | ○ | ○ | ○ | ○ | ○ | ○ | ● | 210 |
| 15th | 1110 | 0 | 1 | 1 | 0 | 0 | 0 | 0 | 0 | 0 | 0 | 0 | 0 | 0 | 0 | | ◎ | ◎ | ○ | ○ | ○ | ○ | ○ | ○ | ○ | ○ | ○ | ○ | ○ | 256 |

□ : WRITE ADDRESS DISCHARGE + VERY SMALL LIGHT EMISSION DISCHARGE $\alpha < 1$

◎ : WRITE ADDRESS DISCHARGE + SUSTAIN DISCHARGE EMISSION

○ : SUSTAIN DISCHARGE EMISSION

● : ERASE ADDRESS DISCHARGE

DRIVE METHOD OF PLASMA DISPLAY PANEL

BACKGROUND OF THE INVENTION

1. Field of the Invention

The present invention relates to a drive method by which a plasma display panel is driven according to an input video signal.

2. Description of the Related Art

Plasma display devices in which a plasma display panel (referred to hereinbelow as PDP) has a matrix-like arrangement of discharge cells corresponding to pixels are presently manufactured as thin, large-screen display devices.

A PDP has been suggested, (for example, see Japanese Patent Kokai No. 2006-54160) in which the discharge efficiency is increased by introducing a vapor-phase deposited magnesium oxide single crystal performing CL emission having a peak at 200 to 300 nm under electron beam irradiation within a magnesium oxide layer provided so as to cover electrodes in each discharge cell. With such PDP the discharge delay is significantly shortened. Therefore, a very weak discharge can be initiated within a short time with good stability. As a result, the discharge-induced light emission that makes no contribution to the displayed image can be inhibited, and contrast during the display of dark images, that is, the so-called dark contrast can be increased.

However, because the reset discharge that is initiated in all the discharge cells to initialize the discharge cell state is present as the discharge that makes no contribution to the displayed image, the dark contrast is impossible to increase significantly.

Accordingly, a drive method by which a PDP is driven without initiating a reset discharge has been suggested (for example, see Japanese Patent Kokai No. 2001-312244).

However, the problem arising when the reset discharge is not initiated is that subsequent discharges are not initiated with good stability and the possibility of discharge failure increases.

SUMMARY OF THE INVENTION

The present invention has been made to resolve the above-described problem, and it is an object thereof to provide a drive method of a plasma display panel that can increase the dark contrast, without causing a discharge failure.

According to a first aspect of the present invention, the drive method of a plasma display panel is a drive method by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to a brightness weight of the subfield; a discharge cell that assumes a black display state in a first field from among the first field and a second field that are adjacent in time and switches to a display state representing a brightness other than black in the second field is detected as a lighting transition cell based on the input video signal; and when the lighting transition cell is detected, at least one drive is executed from among a first forced lighting drive in which the lighting transition cell is forcibly set into the lighting mode only in the address process of a predetermined subfield from among the subfields, regardless of the brightness level indicated by the input video signal, in the first field, and a second forced lighting drive in which an adjacent discharge cell that is adjacent to the lighting transition cell is forcibly set into the lighting mode only in the address process of the predetermined subfield, regardless of the brightness level indicated by the input video signal, in the second field.

According to another aspect of the present invention, the drive method of a plasma display panel is a drive method by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to weighting of the subfield; and a forced lighting drive for forcibly setting into the lighting mode is executed only in the address process of a predetermined subfield from among the subfields, regardless of the brightness level indicated by the input video signal, with respect to a predetermined discharge cell from among the discharge cells.

According to yet another aspect of the present invention, the drive method of a plasma display panel is a drive method by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to a brightness weight of the subfield; the address process of at least two subfields from among the subfields is a selective write address process by which the discharge cell is set into the lighting mode by initiating a write address discharge with respect to the discharge cell; a discharge cell that assumes a black display state in a first field from among the first field and a second field that are adjacent in time and switches to a display state representing a brightness other than black in the second field is detected as a lighting transition cell based on the input video signal; and when the lighting transition cell is detected, a forced lighting drive is executed by which the lighting transition cell is forcibly set into the lighting mode in the selective write address process of a predetermined subfield from among the subfields, regardless of the brightness level indicated by the input video signal, in the second field.

When a discharge cell that assumes a black display state in a first field from among the first field and a second field that are adjacent in time and switches to a display state representing a brightness other than black in the second field is detected as a lighting transition cell, at least one drive from among the below-described first and second forced lighting drives is executed. In the first forced lighting drive, the lighting transition cell is forcibly set into the lighting mode only in the address process of a predetermined subfield within the field in the first field. On the other hand, in the second forced lighting drive, an adjacent discharge cell that is adjacent to the lighting transition cell is forcibly set into the lighting mode only in the address process of the predetermined subfield in the second field.

With the first or second forced lighting drive, charged particles are formed following a sustain discharge initiated forcibly by this forced lighting drive in a discharge cell in which the deficit of charge particles can be predicted, that is, within a discharge cell that is switched from the black display state to a display state representing a brightness other than black within the consecutive two fields. In other words, even when a transition has occurred of a display form, such that the deficit of charged particles occurs in each discharge cell, the charged particles can be formed without relying upon a reset discharge. As a result, the discharge cells can be driven without causing a discharge failure, regardless of the display form, even when the reset discharge is weakened with the object of the increasing the dark contrast.

BRIEF DESCRIPTION OF THE DRAWINGS

FIG. 7 shows an example of an emission pattern for each gradation in the plasma display device shown in FIG. 1;

FIG. 22 shows another example of emission patterns for each gradation in the plasma display device shown in FIG. 1;

FIG. 26 shows an example of emission patterns for each gradation in the plasma display device shown in FIG. 25;

DETAILED DESCRIPTION OF THE INVENTION

The embodiments of the present invention will be described below in greater detail with reference to the appended drawings.

Embodiment 1

Figure 1:
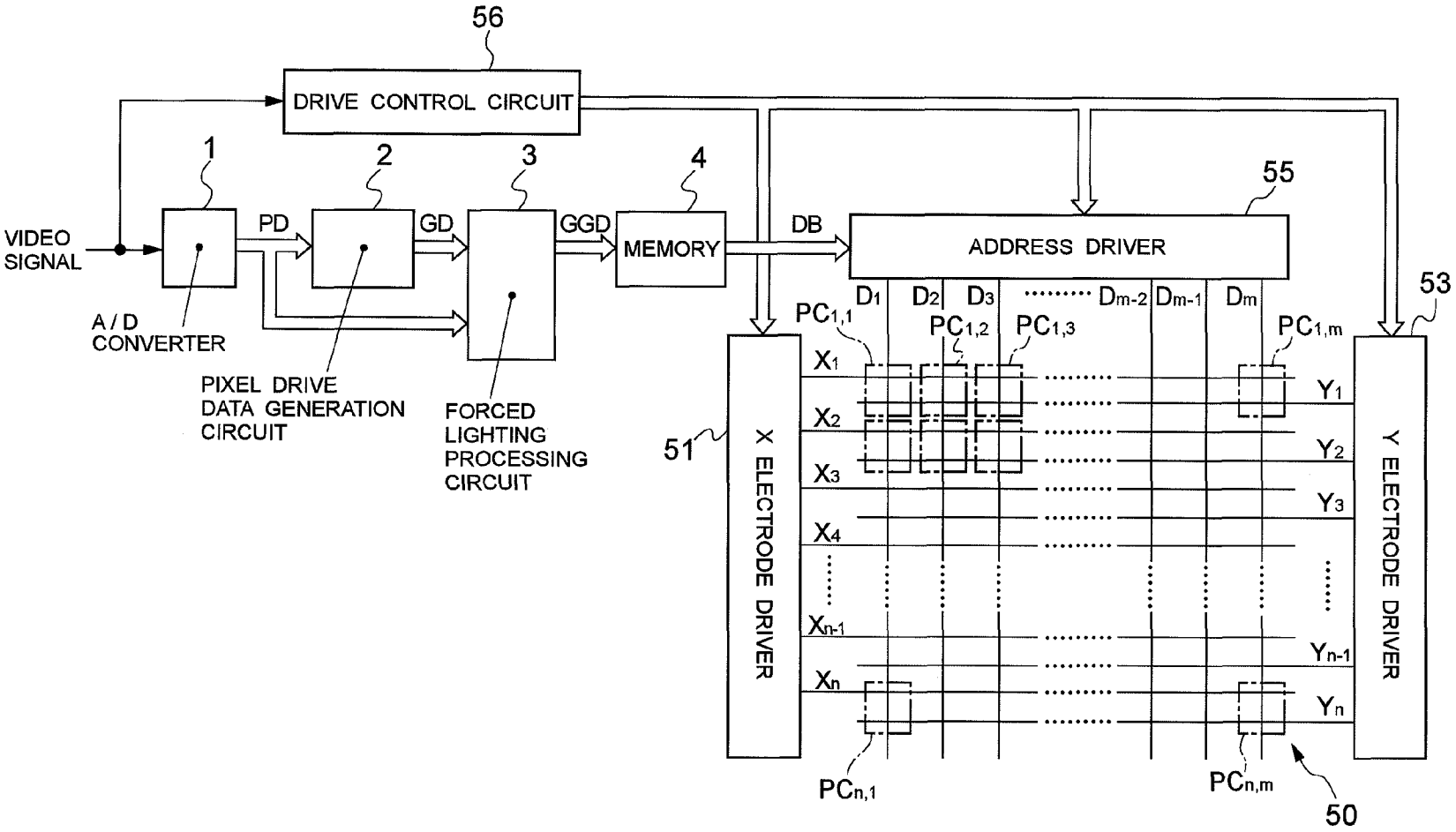
FIG. 1 illustrates a general configuration of a plasma display device in which a plasma display panel is driven according to the drive method in accordance with the present invention.

FIG. 1 shows a schematic configuration of the plasma display device in accordance with the present invention.

As shown in FIG. 1, the plasma display device is composed of an A/D converter 1, a pixel drive data generation circuit 2, a forced lighting processing circuit 3, a memory 4, a PDP 50, an X electrode driver 51, an Y electrode driver 53, an address driver 55, and a drive control circuit 56.

The A/D converter 1 samples the input video signal, converts it into, for example, 8-bit pixel data PD corresponding to each pixel, and supplies the data to the pixel drive data generation circuit 2 and forced lighting processing circuit 3.

The pixel drive data generation circuit 2, first, performs a multigradation processing including an error diffusion processing and a dither processing with respect to each pixel data PD of each pixel. For example, in the error diffusion processing, the pixel drive data generation circuit 2 takes higher-level 6-bit portion of pixel data as display data and the remaining lower-level 2-bit portion as failure data, adds weights to the failure data in the pixel data corresponding to each peripheral pixel, and reflects the results obtained in the display data, thereby producing 6-bit pixel data subjected to the error diffusion processing. With such error diffusion processing, the brightness of the lower-level 2-bit portion in the primary pixel is pseudo represented by the peripheral pixels, thereby enabling the brightness gradation representation with 6-bit display data (less than 8-bit display data) that is equivalent to that obtained with the 8-bit pixel data. Then, the pixel drive data generation circuit 2 performs the dither processing with respect to the 6-bit pixel data that have been obtained by the error diffusion processing. In the dither processing, a plurality of mutually adjacent pixels are taken as one pixel unit, dither coefficients composed of mutually different coefficient values are allocated to the pixel data subjected to the error diffusion processing that correspond to each pixel in the one pixel unit, and the data are added up, thereby producing dither added pixel data. With such addition of dither coefficients, the brightness that is equivalent to 8 bit can be represented with higher-level 4 bits of the dither added pixel data in the case where the aforementioned pixel unit is employed. Accordingly, the pixel drive data generation circuit 2 converts the upper-level 4-bit portion of the dither added pixel data into 4-bit multigradation pixel data PDs representing the total brightness level in 15 gradations (first to fifteenth gradations), as shown in FIG. 7. Then, the pixel drive data generation circuit 2 converts the multigradation pixel data PDs into 14-bit pixel drive data GD according to the data conversion table such as shown in FIG. 7, and supplies these data to the forced lighting processing circuit 3. The logical level of each bit of the pixel drive data GD indicates whether an address discharge (described hereinbelow) is generated in a subfield corresponding to a bit row thereof. For example, where the logical level is 1, the address discharge is generated, but when the logical level is 0, the address discharge is not generated in the subfield corresponding to the bit row thereof.

The forced lighting processing circuit 3 performs the forced lighting processing (described hereinbelow) with respect to each pixel drive data GD of each pixel and supplies the obtained pixel drive data GGD to the memory 4. The pixel drive data GGD also have a data pattern (14 bit) identical to the data pattern for each gradation based on the 14-bit pixel drive data GD, as shown in FIG. 7.

The memory 4 sequentially writes the pixel drive data GGD. Here, the memory 4 performs the below-described read operation upon completion of writing the (n×m) pixel drive data $GGD_{(1,1)}$ to $GGD_{(n,m)}$ corresponding to each pixel of one screen, that is, the first row by the first column to the n-th row by the m-th column.

First, the memory 4 takes the first bit of each pixel drive data $GGD_{(1,1)}$ to $GGD_{(n,m)}$ as pixel drive data bits $DB_{(1,1)}$ to $RDB_{(n,m)}$, reads them for each single display line in the below-described subfield SF1, and supplies them to the address driver 55. Then, the memory 4, takes the second bit of each pixel drive data $GGD_{(1,1)}$ to $GGD_{(n,m)}$ as the pixel drive data bit $DB_{(1,1)}$ to $DB_{(n,m)}$, reads them for each single display line in the below-described subfield SF2, and supplies them to the address driver 55. Then, the memory 4 reads the bits of each pixel drive data $GGD_{(1,1)}$ to $GGD_{(n,m)}$ separately by rows of the same bits and supplies each of them as pixel drive data bits $DB_{(1,1)}$ to $DB_{(n,m)}$ to the address driver 55 in the subfield corresponding to the bit row.

A PDP 50, which is a plasma display panel, has formed therein the column electrodes $D_1$ to $D_m$ that are arranged in a row and extend in the longitudinal direction (vertical direction) of a two-dimensional display screen and row electrodes $X_1$ to $X_n$ and row electrodes $Y_1$ to $Y_n$ that are arranged in rows and extend in the lateral direction (horizontal direction). In this case, row electrode pairs ($Y_1$, $X_1$), ($Y_2$, $X_2$), ($Y_3$, $X_3$), . . . , ($Y_n$, $X_n$) in which pairs are formed by mutually adjacent electrodes serve as the first display line to n-th display line in the PDP 50. Discharge cells (display cells) PC serving as pixels are formed in the intersections (regions surrounded by dash-dot lines in FIG. 1) of the display lines and column electrodes $D_1$ to $D_m$. Thus, in the PDP 50, the discharge cells $PC_{1,1}$ to $PC_{1,m}$ that belong to the first display line, the discharge cells $PC_{2,1}$ to $PC_{2,m}$ that belong to the second display line, . . . the discharge cells $PC_{n,1}$ to $PC_{n,m}$ that belong to the n-th display line are arranged as a matrix. In this case, from among the discharge cells $PC_{(1,1)}$ to $PC_{(n,m)}$, the discharge cells that belong to the (3t−2)-th column (t: integer of 1 to m/3), that is, the discharge cells PC that belong to the first column, fourth column, seventh column, . . . (m−2)-th column correspond to red pixels. Further, the discharge cells that belong to the (3t−1)-th column (t: integer of 1 to m/3), that is, the discharge cells PC that belong to the second column, fifth column, eighth column, . . . (m−1)-th column correspond to green pixels. The discharge cells that belong to the (3t)-th column (t: integer of 1−m/3), that is, the discharge cells PC that belong to the third column, sixth column, ninth column, . . . m-th column correspond to blue pixels.

Figure 2:
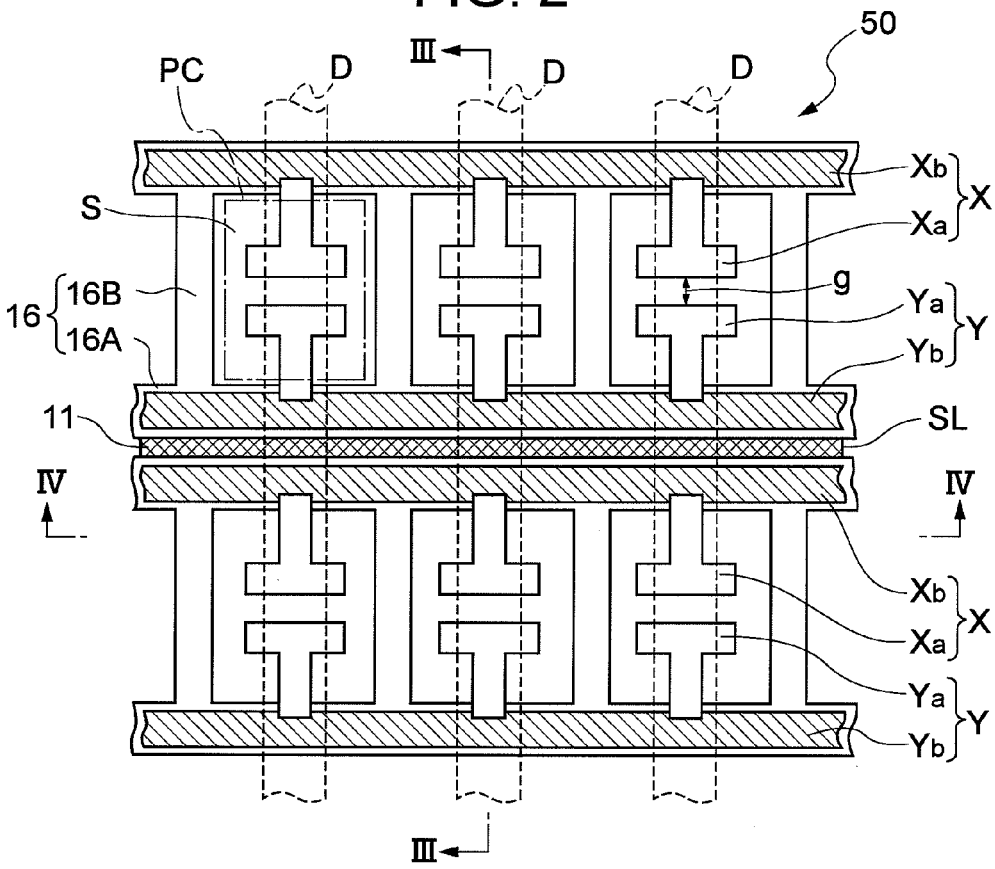
FIG. 2 is a front view illustrating schematically the internal structure of a PDP 50 that is viewed from the display surface side.
Figure 3:
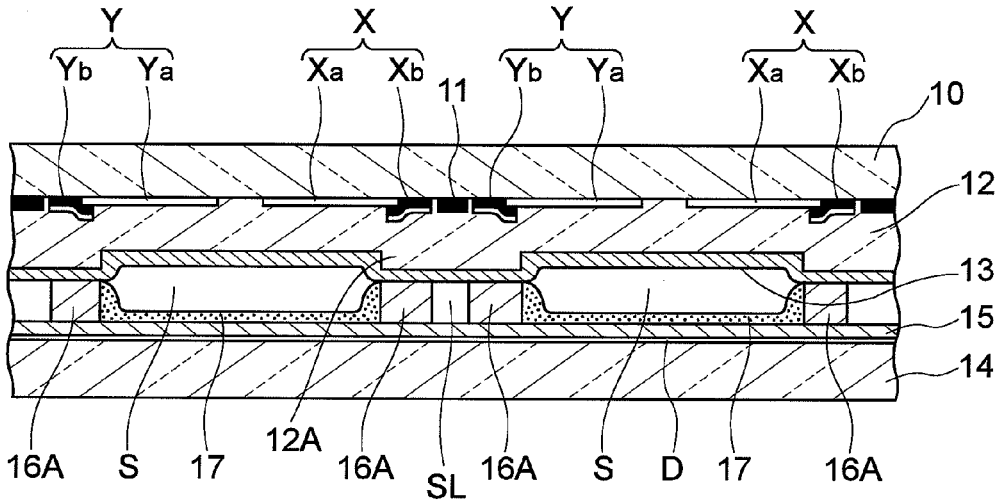
FIG. 3 shows a cross section along the V-V line shown in FIG. 2.
Figure 4:
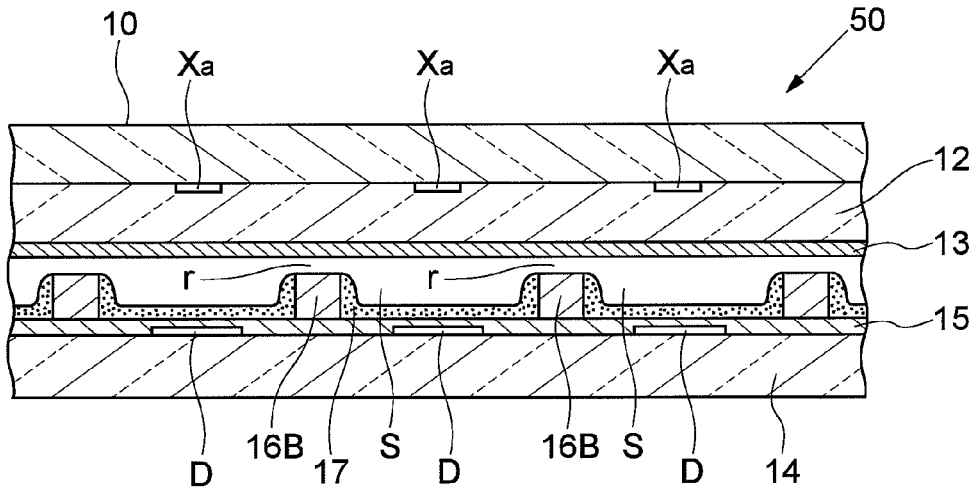
FIG. 4 shows a cross section along the W-W line shown in FIG. 2.

FIG. 2 is a front view showing schematically the inner structure of the PDP 50, as viewed from the display surface side. In FIG. 2, the intersection portions of the three adjacent column electrodes D and two adjacent display lines are shown by hatching. FIG. 3 is a cross-sectional view of the PDP 50 along the V-V line in FIG. 2. FIG. 4 is a cross-sectional view of the PDP 50 along the W-W line in FIG. 2.

As shown in FIG. 2, each row electrode X is composed of a bus electrode Xb that extends in the horizontal direction of the two-dimensional display screen and a T-shaped transparent electrode Xa provided in a position corresponding to the discharge cell PC on the bus electrode Xb so as to be in contact therewith. Each row electrode Y is composed of a bus electrode Yb that extends in the horizontal direction of the two-dimensional display screen and a T-shaped transparent electrode Ya provided in a position corresponding to the discharge cell PC on the bus electrode Yb so as to be in contact therewith. The transparent electrodes Xa and Ya are composed of a transparent electrically conductive film such as ITO, and the bus electrodes Xb and Yb are composed, for example, of a metal film. The row electrode X composed of the transparent electrode Xa and bus electrode Xb and the row electrode Y composed of the transparent electrode Ya and bus electrode Yb are, as shown in FIG. 3, formed on the rear surface side of a front transparent substrate 10 having the front side thereof as a display surface of the PDP 50. In this case, the transparent electrodes Xa and Ya in each row electrode pair (X, Y) extend on the side of row electrodes that mutually form a pair, and the top sides thereof that are wide portions are disposed opposite each other via a display gap g1 of a predetermined width. On the rear surface side of the front transparent substrate 10, a black or dark-colored light absorbing layer (light shielding layer) 11 that extends in the horizontal direction of the two-dimensional display screen is formed between the row electrode pair (X, Y) and the row electrode pair (X, Y) adjacent to this row electrode pair. Furthermore, on the rear surface side of the front transparent substrate 10, a dielectric layer 12 is formed so as to cover the row electrode pairs (X, Y). On the rear surface side of this dielectric layer 12 (surface opposite the surface that is in contact with the row electrode pairs), a raised dielectric layer 12A is formed in a portion corresponding to the light absorbing layer 11 and the region having formed therein the bus electrodes Xb and Yb adjacent to the light absorbing layer 11, as shown in FIG. 3.

A magnesium oxide layer 13 is formed on the surface of the dielectric layer 12 and raised dielectric layer 12A.

The magnesium oxide layer 13 contains a magnesium oxide crystal (referred to hereinbelow as CL emitting MgO crystal) serving as a secondary electron-emitting material that emits CL (cathode luminescence) having a peak within a wavelength range of 200 to 300 nm, more particularly 230 to 250 nm when excited by electron beam irradiation. The CL emitting MgO crystal is obtained by vapor-phase oxidation of magnesium vapor generated by heating magnesium and has, for example, a multipole crystal structure in which cubic crystal bodies are mated with each other, or a cubic single crystal structure. The average particle size of the CL emitting MgO crystal is equal to or more than 2000 Å (measured by a BET method). When a magnesium oxide single crystal obtained by a vapor phase method with a large particle size such that the average particle size is equal to or more than 2000 Å is to be obtained, a high heating temperature is required to generate the magnesium vapor. For this reason, the length of flame produced by the reaction of magnesium and oxygen increases and the difference in temperature between the flame and the environment becomes large. As a result, the larger is the particle size of the magnesium oxide single crystal obtained by the vapor phase method, the more bodies are formed that have an energy level corresponding to the peak wavelength (for example, close to 235 nm, within a range of 230 to 250 nm) of the above-described CL emission. Further, by contrast with the product obtained by the typical vapor-phase oxidation method, the magnesium oxide single crystal obtained by the vapor phase method, in which the amount of magnesium generated per unit time is increased, the reaction region of magnesium and oxygen is enlarged, and the reaction proceeds with a larger amount of oxygen, has an energy level corresponding to the peak wavelength of the above-described CL emission.

Because such CL emitting MgO crystal has an energy level corresponding to 235 nm, the electrons are trapped over a long period (several milliseconds), and by causing the emission of these electrons by the application of an electric field during selective emission, the initial electrons necessary for the discharge are rapidly acquired. Therefore, where such CL emitting MgO crystal bodies are contained in the magnesium oxide layer 13 such as shown in FIG. 3, the amount of electrons that is necessary and sufficient for generating the discharge are constantly present in the discharge space S, and the probability of discharge in the discharge space S is greatly increased.

Figure 6:
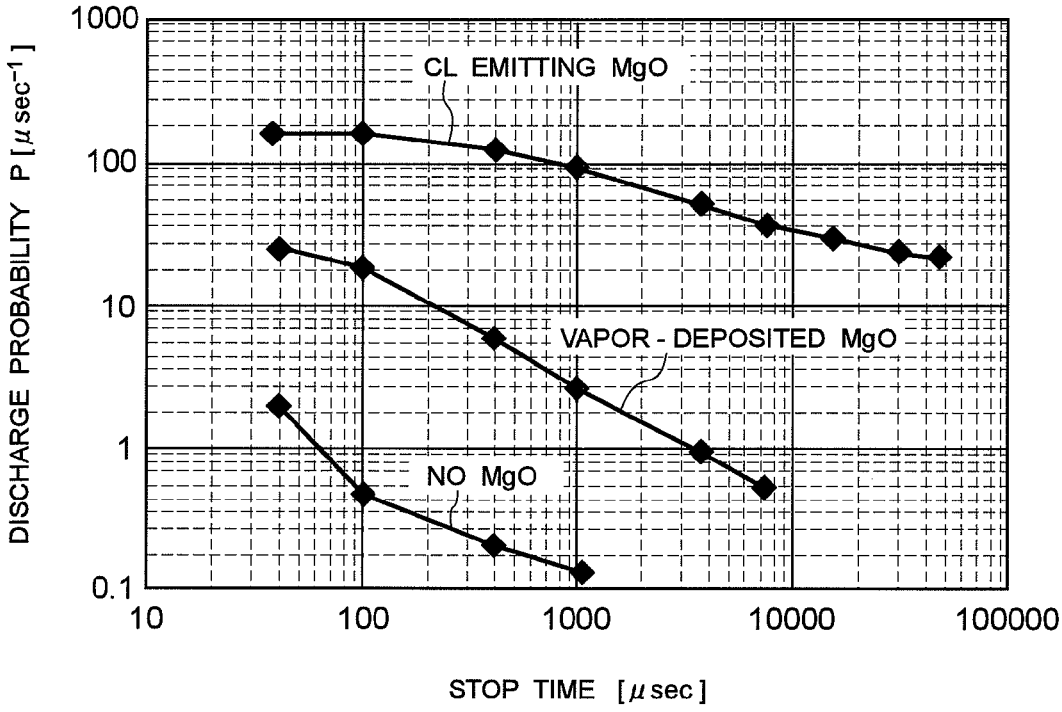
FIG. 6 shows a transition of an optimum peak potential of the reset pulse, scan pulse, and sustain pulse corresponding to the accumulation usage time of the PDP 50.

FIG. 6 shows the probabilities relating to the case in which no magnesium oxide layer is provided in a discharge cell PC, the case in which a magnesium oxide layer is formed by the conventional deposition method, and the case in which a magnesium oxide layer containing CL emitting MgO crystal bodies is provided.

In FIG. 6, the discharge stop time, that is, the time interval from the generation of a discharge to the generation of the next discharge, is plotted against the abscissa. As shown in FIG. 6, where the magnesium oxide layer 13 containing the CL emitting MgO crystal bodies is provided inside the discharge cell PC, the probability of discharge increases over that in the case where the magnesium oxide layer is formed by the conventional deposition method. At this time, by using the CL emitting MgO crystal bodies with a high intensity of CL emission under electron beam irradiation, in particular the intensity of CL emission having a peak at 235 nm, it is possible to reduce the delay of discharge generated in the discharge space S.

The magnesium oxide layer 13 is formed by causing the adhesion of such CL emitting MgO crystal bodies to the surface of the dielectric layer 12 by a spray method, an electrostatic coating method, and the like. Further, the magnesium oxide layer 13 may be also formed by vapor depositing or sputtering a thin-film magnesium oxide layer on the surface of the dielectric layer 12 and then causing the adhesion of the CL emitting MgO crystal to the thin-film magnesium oxide layer.

On the rear substrate 14 that is disposed parallel to the front transparent substrate 10, column electrodes are formed to extend in the direction perpendicular to the row electrode pairs (X, Y) in positions opposite the transparent electrodes Xa and Ya in the row electrode pairs (X, Y). Further, a white column electrode protective layer 15 that covers the column electrodes D is formed on the rear substrate 14. Partitions 16 are formed on the column electrode protective layer 15. The partition 16 is formed to have a ladder-like shape by a transverse wall 16A extending in the transverse direction of the two-dimensional display screen in positions corresponding to the bus electrodes Xb and Yb of each column electrode pair (C, Y) and a longitudinal wall 16B extending in the longitudinal direction of the two-dimensional display screen in an intermediate position between the adjacent column electrodes D. Furthermore, the ladder-shaped partition 16 such as shown in FIG. 2 is formed for each display line of the PDP 50. A gap SL such as shown in FIG. 2 is present between the adjacent partitions 16. The ladder-like partitions 16 partition the discharge cells PC containing the respective discharge space S and transparent electrodes Xa and Ya. A discharge gas containing xenon is sealed in the discharge space S. A fluorescent layer 17 is formed on the side surface of the transverse partitions 16A in each discharge cell PC, side wall of the longitudinal wall 16B, and surface of the column electrode protective layer 15 so as to cover completely these surfaces. The fluorescent layer 17 is actually composed of fluorescent materials of three kinds: a fluorescent material that emits red light, a fluorescent material that emits green light, and a fluorescent material that emits blue light. In other words, a fluorescent layer 17 that emits red light is formed inside the discharge cell PC corresponding to a red pixel, a fluorescent layer 17 that emits green light is formed inside the discharge cell PC corresponding to a green pixel, and a fluorescent layer 17 that emits blue light is formed inside the discharge cell PC corresponding to a blue pixel.

Figure 5:
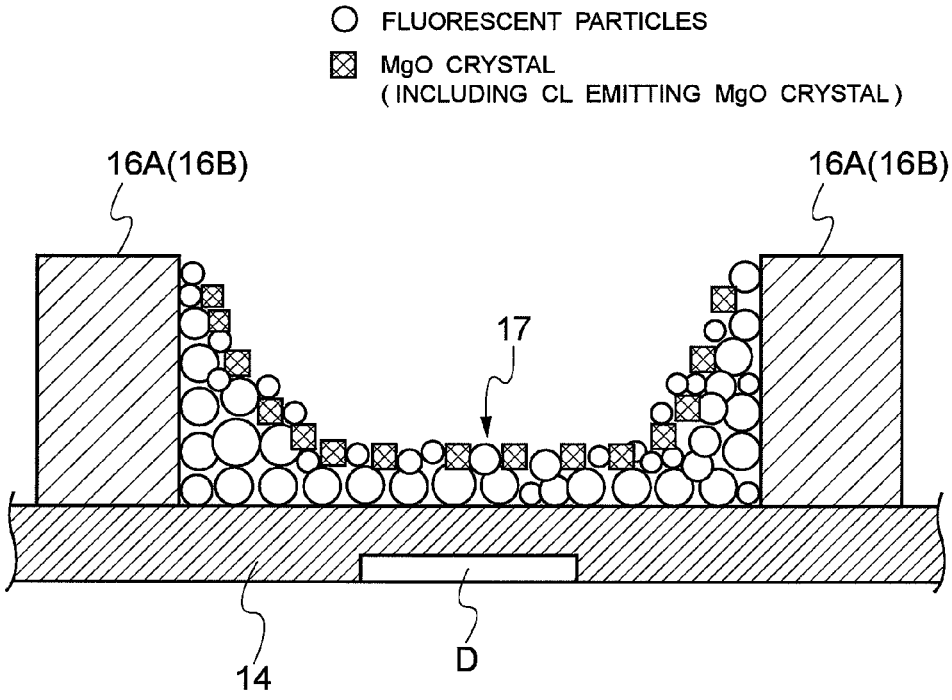
FIG. 5 shows schematically a MgO crystal contained in the fluorescent layer 17.

Inside the fluorescent layers 17, MgO crystal bodies are contained as a secondary electron emitting material, for example, in the form such as shown in FIG. 5. The MgO crystal bodies are exposed from the fluorescent layer 17 so as to be in contact with the discharge gas on the surface covering the discharge space S on the surface of the fluorescent layer 17, that is, on the surface that is in contact with the discharge space S. In this case, the above-described CL emitting MgO crystal bodies are contained in a plurality of MgO crystal bodies contained in the fluorescent layer 17. Thus, inside each discharge cell PC, the CL emitting MgO crystal bodies are contained in both the magnesium oxide layer 13 formed on the front transparent substrate 10 and the fluorescent layer 17 formed on the side of the rear substrate 14. With such a configuration, a large number of CL emitting MgO crystal bodies can be contained inside each discharge cell PC. Therefore, the probability of discharge is further increased and the discharge delay can be reduced. In addition, as described hereinabove, by forming the MgO crystal bodies so that they are in contact with the discharge gas on the surfaces of the magnesium oxide layer 13 and the fluorescent layer 17, it is possible to emit charged particles inside the discharge space S with good efficiency. As a result, the probability of discharge can be further increased and the discharge delay is further reduced.

The zones between the gaps SL and discharge spaces of the discharge cells PC are mutually closed by abutting the magnesium oxide layer 13 against the transverse wall 16A as shown in FIG. 3. Further, because the magnesium oxide layer 13 does not come into contact with the longitudinal wall 16B, as shown in FIG. 4, a gap r is present therebetween. Thus, the discharge spaces S of the discharge cells PC that are adjacent in the transverse direction of the two-dimensional display screen communicate with each other via the gaps r.

The X electrode driver 51 generates a reset pulse and a sustain pulse (described hereinbelow) in response to each control signal supplied from the drive control circuit 56 and applies the generated pulses to the row electrodes X of the PDP 50.

The Y electrode driver 53 generates a reset pulse, a scan pulse, and a sustain pulse (described hereinbelow) in response to each control signal supplied from the drive control circuit 56 and applies the generated pulses to the row electrodes $Y_1$ to $Y_n$ of the PDP 50.

In response to various control signals supplied from the drive control circuit 56, the address driver 55 generates pixel data pulses having a peak potential corresponding to the pixel drive data bit DB that is read from the memory 4 and applies these pulses to the column electrodes $D_1$ to $D_m$ of the PDP 50.

Figure 8:
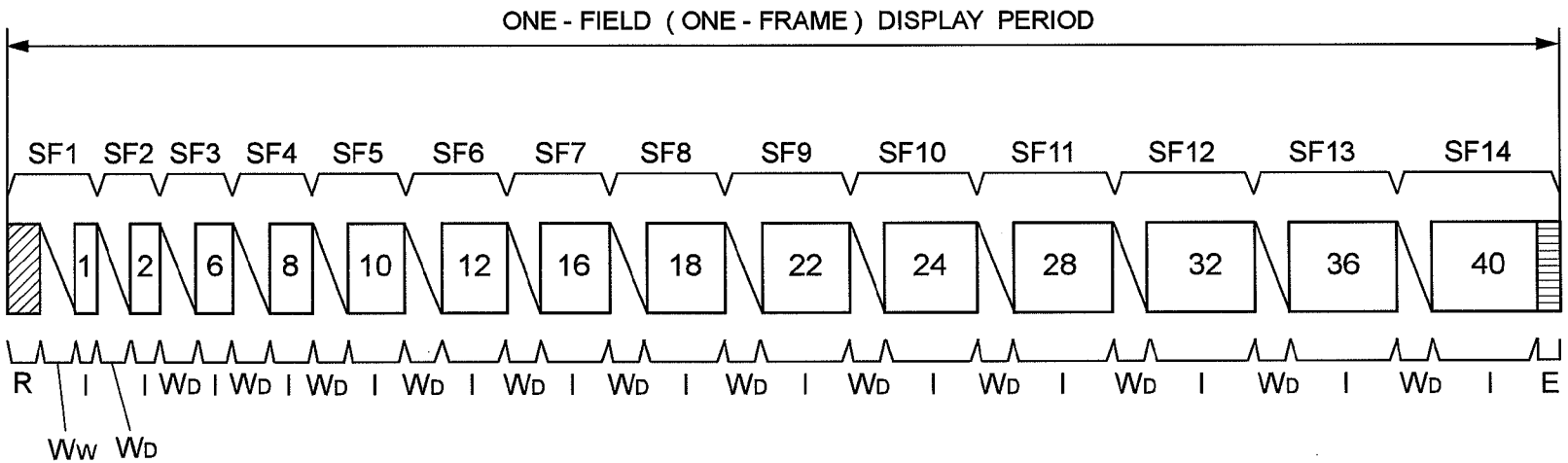
FIG. 8 shows an example of an emission drive sequence employed in the plasma display device shown in FIG. 1.

The drive control circuit 56 supplies the control signals that have to drive the PDP 50 having the above-described structure according to the light emission drive sequence employing a subfield method (subframe method), such as shown in FIG. 8, to the X electrode driver 51, Y electrode driver 53, and address driver 55 serving as panel drivers.

Thus, in the leading subfield SF1, such as shown in FIG. 8, the drive control circuit 56 supplies to the panel drivers the control signals that have to realize sequentially the driving according to the reset process R, selective write address process $W_W$, and sustain process I. Further, in the subfields SF2 to SF14, the control signals that have to realize sequentially the driving according to the selective erase address process $W_D$ and sustain process I are supplied to the panel drivers. After the sustain process I has been realized in the very last subfield SF14 within the one-field display period, the drive control circuit 56 supplies the control signals that have to realize sequentially the driving according to the erase process E to the panel drivers.

Figure 9:
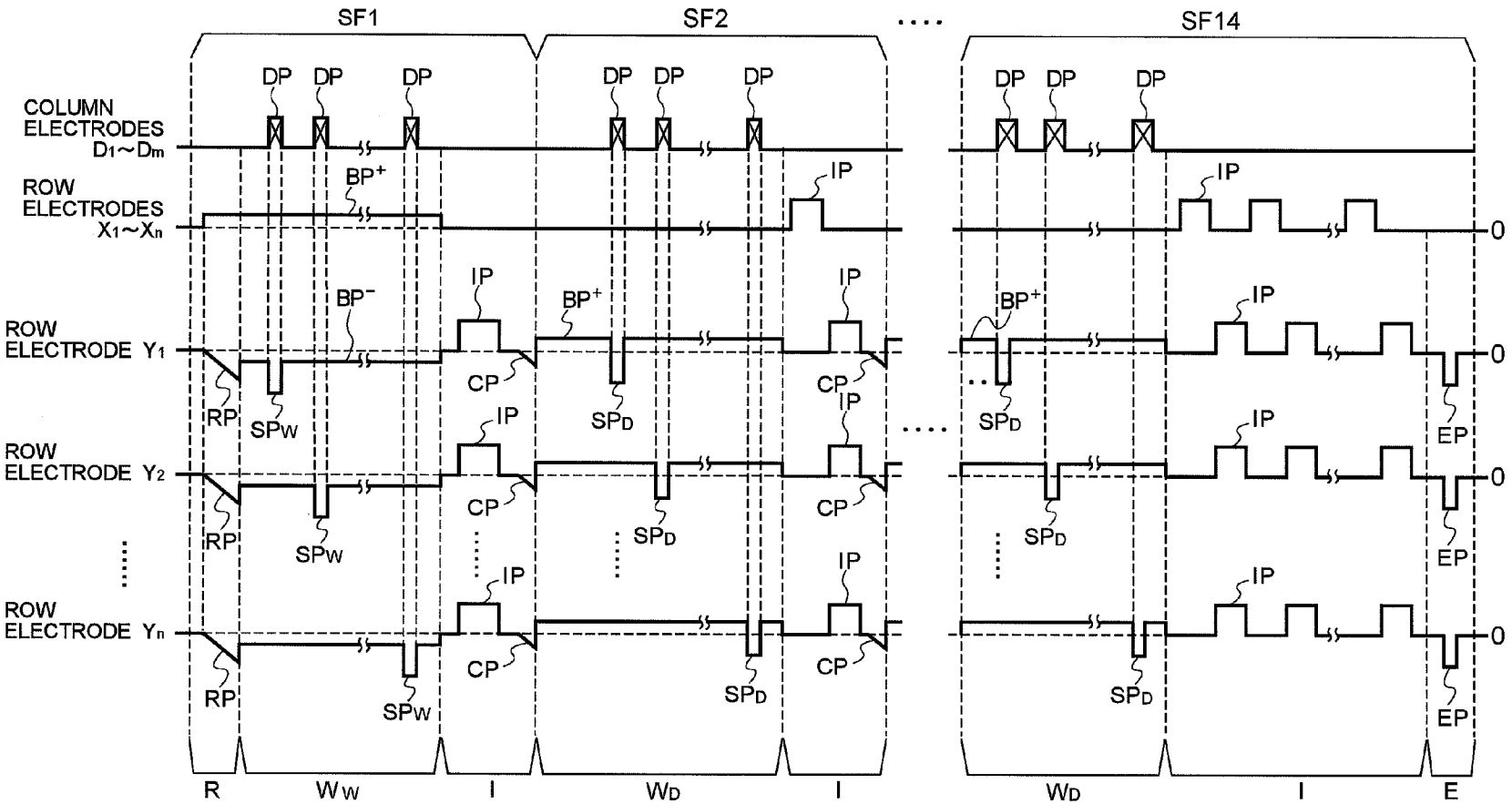
FIG. 9 shows drive pulses applied to the PDP 50 according to the emission drive sequence shown in FIG. 8.

The panel drivers, that is, the X electrode driver 51, Y electrode driver 53, and address driver 55 supply the drive pulses to the column electrodes D and row electrodes X and Y of the PDP 50 at the timing shown in FIG. 9 in response to the control signals that are supplied from the drive control circuit 56.

In FIG. 9, only the operation of the leading subfield SF1, the subfield SF2 that is next thereto, and the very last subfield SF14, from among the subfields SF1 to SF14 shown in FIG. 8, is shown in respective frames.

First, in the reset process R of the subfield SF1, the Y electrode driver 53 generates a reset pulse RP in which the electric potential decreases gradually with the passage of time, as shown in FIG. 9, and which has a pulse waveform reaching the peak potential of negative polarity and applies this reset pulse to all the row electrodes $Y_1$ to $Y_n$. Further, in the reset process R, the X electrode driver 51 applies a base pulse $BP^+$ having a predetermined base potential of positive polarity to all the row electrodes $X_1$ to $X_n$ over the period in which the reset pulse RP is applied. In this case, reset discharges are initiated between the row electrodes X and Y within all the discharge cells PC in response to the application of these reset pulse RP of negative polarity and base pulse $BP^+$ of positive polarity. The negative peak potential in the reset pulse RP is set to a potential that is higher than the peak potential of the write scanning pulse $SP_W$ of negative polarity that is described hereinbelow, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the selective write address process $W_W$ becomes unstable. Further, the pulse voltage of the reset pulse RP is set lower than the pulse voltage of the sustain pulse IP. The voltage applied between the row electrodes X and Y within each discharge cell by the reset pulse RP and base pulse $BP^+$ is lower than the voltage applied between the row electrodes X and Y by the application of the below-described sustain pulse IP. Therefore, the reset discharge initiated in response to the application of the reset pulse RP and base pulse $BP^+$ is weaker than the sustain discharge initiated by the application of the sustain pulse IP.

The wall charge formed in the vicinity of each row electrode X and Y within each discharge cell PC by the very weak reset discharge initiated in this reset process R is erased and all the discharge cells PC are initialized in a quenching mode. Further, a very weak discharge is also initiated between the row electrodes Y and column electrodes D within all the discharge cells PC in response to the application of this reset pulse RP. Accordingly, part of the wall charge of positive polarity that has been formed in the vicinity of column electrodes D is erased by this discharge and the wall charge is adjusted to a value capable of initiating the selective write address discharge correctly in the below-described selective write address process $W_W$.

Further, in the selective write address process $W_W$ of the subfield SF1, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 9, to the row electrodes $Y_1$ to $Y_n$ at the same time. In this selective write address process $W_W$, the X electrode driver 51 continues the application of the base pulse $BP^+$ that has been applied to the row electrodes $X_1$ to $X_n$ in the reset period R to the row electrodes $X_1$ to $X_n$. Electric potentials of the base pulse $BP^-$ and base pulse $BP^+$ are set such that the voltage between the row electrodes X and Y in the non-application period of the write scanning pulse $SP_W$ is lower than the discharge start voltage of the discharge cell PC.

Further, in the selective write address process $W_W$, the address driver 55, first, generates the pixel data pulse $D_P$ corresponding to the logical level of the pixel drive data bit DB corresponding to the subfield SF1. For example, when a pixel drive data bit with a logical level 1 that has to set the discharge cell PC to a lighting mode is supplied, the address driver 55 generates a pixel data pulse DP having a peak potential of positive polarity. On the other hand, with respect to a pixel drive data bit with a logical level 0 that has to set the discharge cell PC to a quenching mode, the address driver generates a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrode D and row electrode Y within the discharge cell PC having applied thereto a pixel data pulse DP having a peak potential of positive polarity that has to set the discharge cell to a lighting mode, simultaneously with the write scanning pulse $SP_W$. Furthermore, immediately after such selective write address discharge, a very weak discharge is also initiated between the row electrodes X and Y within the discharge cell PC. In other words, after the write scanning pulse $SP_W$ has been applied, a voltage corresponding to the base pulse $BP^-$ and base pulse $BP^+$ is applied between the row electrodes X and Y, but because this voltage is set to a level lower than the discharge start voltage of each discharge cell PC, a discharge is not initiated within the discharge cell PC by the application of this voltage alone. However, where the selective write address discharge is initiated, a discharge is initiated between the row electrodes X and Y by the application of voltage based on the base pulse $BP^-$ and base pulse $BP^+$ and induced by the selective write address discharge. This discharge and also the selective write address discharge set the discharge cell PC into a lighting mode, that is, a state in which a wall charge of positive polarity is formed in the vicinity of the row electrode Y, a wall charge of negative polarity is formed in the vicinity of row electrode X, and a wall charge of negative polarity is formed in the vicinity of the column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse $SP_W$, and therefore no discharge is generated between the row electrodes X and Y. Thus, in the discharge cell PC, the immediately preceding state, that is, a state of quenching mode initialized in the reset process R, is maintained.

Further, in the sustain process I of the subfield SF1, the Y electrode driver 53 generates, pulse by pulse, the sustain pulses IP having a peak potential of positive polarity and applies these pulses simultaneously to the row electrodes $Y_1$ to $Y_n$. During this time, the X electrode driver 51 sets the row electrode $X_1$ to $X_n$ to a state with the ground potential (0 V), and the address driver 55 sets the column electrodes $D_1$ to $D_m$ to the ground potential (0 V). In response to the application of this sustain pulse IP, a sustain discharge is initiated between the row electrodes X and Y within the discharge cell PC that has been set, as described hereinabove, into a lighting mode. The light emitted from the fluorescent layer 17 following this sustain discharge is irradiated to the outside via the front transparent substrate 10, whereby one display emission corresponding to the brightness weight of the subfield SF1 is performed. Further, in response to the application of this sustain pulse IP, a discharge is also initiated between the row electrode Y and column electrode D within the discharge cell PC that has been set into a lighting mode. By this discharge and also the above-described sustain discharge, a wall charge of negative polarity is formed in the vicinity of the row electrode Y within the discharge cell PC, and a wall charge of positive polarity is formed in the vicinity of row electrode X and column electrode D. Further, after the sustain pulse IP has been applied, the Y electrode driver 53 applies to the row electrodes $Y_1$ to $Y_n$ a wall charge adjustment pulse CP that has a peak potential of negative polarity with a gradual transition of electric potential at a front edge with the passage of time, as shown in FIG. 9. In response to the application of this wall charge adjustment pulse CP, a very weak erase discharge is initiated in the discharge cell PC when the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next selective erase address process $W_D$.

Further, in the selective erase address process $W_0$ of subfields SF2 to SF14, the Y electrode driver 53 successively and alternatively applies the erase scanning pulse $SP_D$ having a peak potential of negative polarity, such as shown in FIG. 9, to the row electrodes $Y_1$ to $Y_n$, while applying the base pulse $BP^+$ having a predetermined base potential of positive polarity to each row electrode $Y_1$ to $Y_n$. Further, the peak potential of the base pulse $BP^+$ is set such that can prevent an erroneous discharge between the row electrodes X and Y within the execution period of this selective erase address process $W_0$. Further, within the execution period of this selective erase address process $W_0$, the X electrode driver 51 sets the row electrodes $X_1$ to $X_n$ to a ground potential (0 V). Further, in the selective erase address process $W_D$, the address driver 55, first, converts the pixel drive data bit corresponding to the subfield SF to the pixel data pulse DP having a pulse voltage corresponding to the logical level thereof. For example, when a pixel drive data bit with a logical level 1 that has to cause a transition of the discharge cell PC from the lighting mode into the quenching mode is applied, the address driver 55 converts this bit into a pixel data pulse DP having a peak potential of positive polarity. On the other hand, when a pixel drive data bit with a logical level 0 that has to maintain the present state of the discharge cell PC is applied, the address driver converts this bit into a pixel data pulse DP of a low voltage (0 V). Further, the address driver 55 applies the pixel data pulse DP, by one display line (m lines), to the column electrodes $D_1$ to $D_m$ synchronously with the application timing of the erase scanning pulse $SP_D$. In this case, a selective erase address discharge is initiated between the column electrode D and row electrode Y within the discharge cell PC having applied thereto a high-voltage pixel data pulse DP having a peak potential of positive polarity, simultaneously with the erase scanning pulse $SP_D$. By such selective erase address discharge, the discharge cell PC is set to a state in which a wall charge of positive polarity is formed in the vicinity of each of row electrodes Y and X and a wall charge of negative polarity is formed in the vicinity of column electrode D, that is, to a quenching mode. On the other hand, the above-described selective erase address discharge is not initiated between the column electrode D and row electrode Y within the discharge cell PC having applied thereto a pixel data pulse DP of a low voltage (0 V), simultaneously with the erase scanning pulse $SP_D$. Therefore, in the discharge cell PC, the immediately preceding state (lighting mode, quenching mode), is maintained.

Further, in the sustain process I of each subfield SF2 to SF14, the X electrode driver 51 and Y electrode driver 53 apply the sustain pulse IP having a peak potential of positive polarity to the row electrodes $X_1$ to $X_n$ and $Y_1$ to $Y_n$ alternately for the row electrodes X and Y and repeatedly, the number of application cycles (even number) corresponding to the brightness weight of the subfield, as shown in FIG. 9. Each time the sustain pulse IP is applied, a sustain discharge is initiated between the row electrodes X and Y within the discharge cell PC that has been set into a lighting mode. The light emitted from the fluorescent layer 17 following this sustain discharge is irradiated to the outside via the front transparent substrate 10, whereby the display emission is performed, the number of cycles thereof corresponding to the brightness weight of the subfield SF. In this case, a wall charge of negative polarity is formed in the vicinity of the row electrode Y and a wall charge of positive polarity is formed in the vicinity of row electrode X and column electrode D within the discharge cell PC in which the sustain discharge has been initiated in response to the sustain pulse IP that is applied at the very end in the sustain process I of each subfield SF2 to SF14. Further, after this final sustain pulse IP has been applied, the Y electrode driver 53 applies to the row electrodes $Y_1$ to $Y_n$ a wall charge adjustment pulse CP that has a peak potential of negative polarity with a gradual transition of electric potential at a front edge with the passage of time, as shown in FIG. 9. In response to the application of this wall charge adjustment pulse CP, a very weak erase discharge is initiated in the discharge cell PC in which the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next selective erase address process $W_D$.

Further, at the end of the final subfield SF14, the Y electrode driver 53 applies the erase pulse EP having a peak potential of negative polarity to all the row electrodes $Y_1$ to $Y_n$. In response to the application of the erase pulse EP, an erase discharge is initiated only in the discharge PC that is in the lighting mode state. Under the effect of this erase discharge, the discharge cell PC that is in the lighting mode state makes a transition to the quenching mode state.

The above-described drive is executed based on the 15 pixel drive data GGD, such as shown in FIG. 7. With such a drive, as shown in FIG. 7, with the exception of the case in which the brightness level 0 is represented (first gradation), first, a write address discharge (shown by a double circle) is initiated within each discharge cell PC in the leading subfield SF1, and this discharge cell PC is set into a lighting mode. Then, a selective erase address discharge is initiated (shown by a black circle) only in the selective erase address process $W_0$ of one subfield from among the subfields SF2 to SF14, and the discharge cell PC is set into the quenching mode. In other words, each discharge cell PC is set into a lighting mode in each subfield in a sequence thereof corresponding to the intermediate brightness that has to be represented, and light emission following the sustain discharge is repeatedly initiated (shown by a white circle) at a number of cycles allocated to each of these subfields. In this case, a brightness corresponding to the total number of sustain discharges initiated in the one-field (or one-frame) display period is viewed. Therefore, with the light emission patterns of 15 types based on the first to fifteenth gradation drives such as shown in FIG. 7, an intermediate brightness of 15 gradations corresponding to a total number of sustain discharges initiated in each subfield shown by a white circle is represented.

Thus, the plasma display device shown in FIG. 1 implements the drive, such as shown in FIG. 8 and FIG. 9, with respect to the PDP 50 based on the pixel drive data GGD.

Here, the pixel drive data GGD are obtained by the forced lighting processing circuit 3 implementing the forced lighting processing with respect to the pixel drive data GD.

Figure 10:
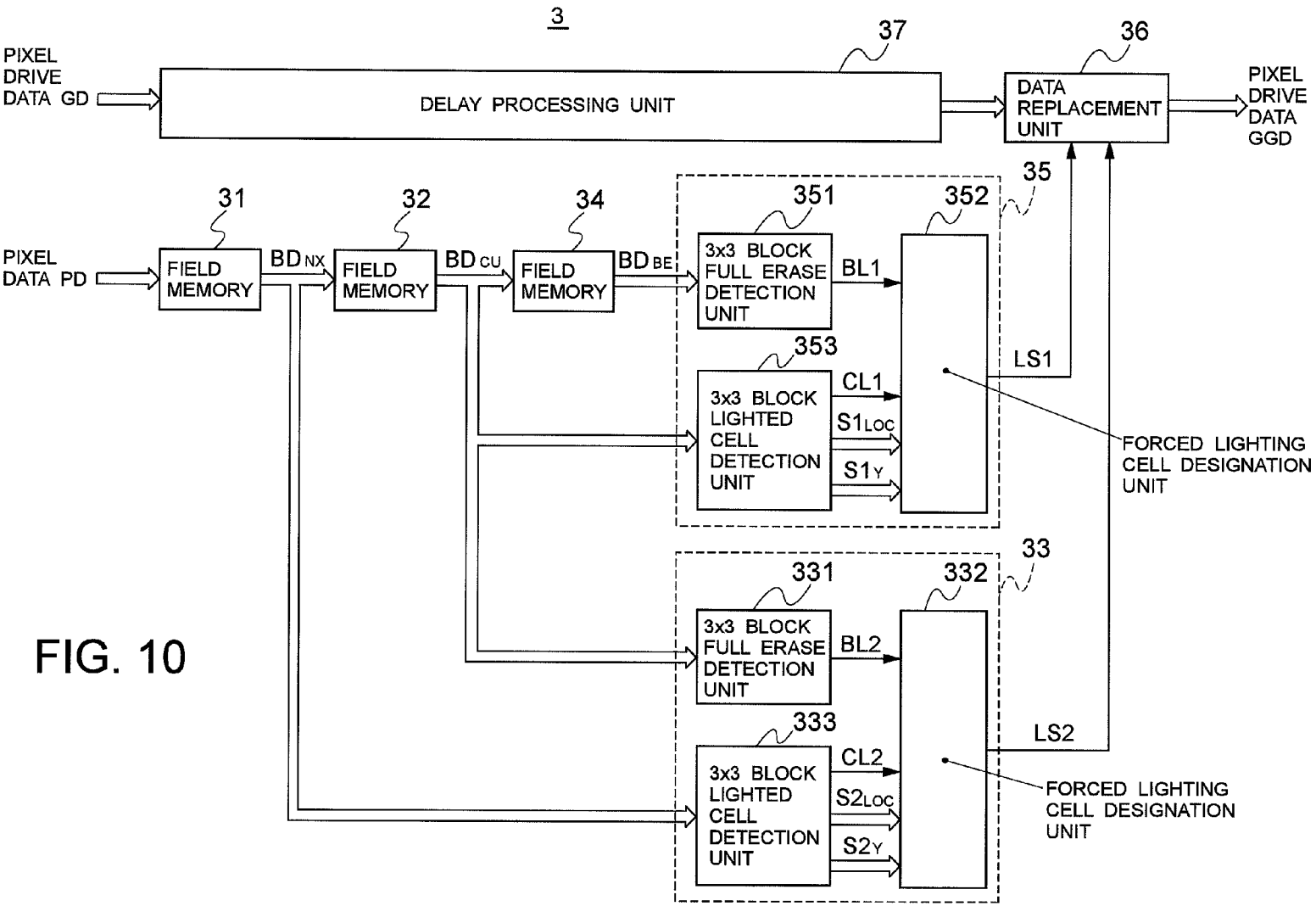
FIG. 10 shows the internal configuration of the forced lighting processing circuit 3.

FIG. 10 shows the internal configuration of the forced lighting processing circuit 3.

Referring to FIG. 10, the field memory 31 successively fetches and stores the pixel data PD for each pixel successively supplied from the A/D converter 1 and reads the pixel data PD in the order they are fetched each time the fetching of one-field (or one-frame) is completed. The field memory 31 supplies the pixel data PD that have thus been read out, as the next field pixel data $PD_{NX}$, into the field memory 32 and second forced lighting processing unit 33.

The field memory 32 successively fetches and stores the next field pixel data $PD_{NX}$ for each pixel successively supplied from the field memory 31 and reads the next field pixel data $PD_{NX}$ in the order they are fetched each time the fetching of one-field (or one-frame) is completed. The field memory 32 supplies the next field pixel data $PD_{NX}$ that have thus been read out, as the current field pixel data $PD_{CU}$, to the second forced lighting processing unit 33, a field memory 34, and a first forced lighting processing unit 35.

The field memory 34 successively fetches and stores the current field pixel data $PD_{CU}$ for each pixel successively supplied from the field memory 32 and reads the current field pixel data $PD_{CU}$ in the order they are fetched each time the fetching of one-field (or one-frame) is completed. The field memory 34 supplies the current field pixel data $PD_{CU}$ that have thus been read out, as the previous field pixel data $PD_{BE}$, to the first forced lighting processing unit 35.

The first forced lighting processing unit 35 is configured of a 3×3 block full erase detection unit 351, a forced lighting cell designation unit 352, and a 3×3 block lighted cell detection unit 353.

The 3×3 block full erase detection unit 351, first, determines whether all the discharge cells PC within the block have assumed the quenched state over one field period for each 3 row×3 column block with respect to the discharge cells $PC_{(1,1)}$ to $PC_{(n,m)}$ within one screen, based on the previous field pixel data $PD_{BE}$ of one field. Thus, the 3×3 block full erase detection unit 351 determines that all the nine discharge cells PC within the block have assumed the quenched state over one field only in the case where all the previous field pixel data $PD_{BE}$ corresponding to each discharge cell PC within each block represent the brightness level 0. Further, the 3×3 block full erase detection unit 351 supplies a full quenching detection signal BL1 indicating the logical level 1 to the forced lighting cell designation unit 352 when the block full erase detection unit determines that all the discharge cells PC within the block have assumed the quenched state over one field, and supplies a detection signal indicating a logical level 0 in other cases.

The 3×3 block lighted cell detection unit 353, first, detects a discharge cell PC demonstrating a brightness other than the black display, that is, larger than the brightness level 0, in a block for each 3 row×3 column block with respect to the discharge cells $PC_{(1,1)}$ to $PC_{(n,m)}$ within one screen, based on the current field pixel data $PD_{CU}$ of one field. Thus, from among all the discharge cells PC within each block, the 3×3 block lighted cell detection unit 353 detects a discharge cell PC for which the current field pixel data $PD_{CU}$ corresponding to the discharge cell PC represent a brightness larger than the brightness level 0. In this case, the 3×3 block lighted cell detection unit 353 takes this discharge cell PC as a lighted cell and supplies a lighted cell detection signal CL1 with a logical level 1 indicating that this lighted cell has been detected to the forced lighting cell designation unit 352. The 3×3 block lighted cell detection unit 353 also supplies a lighted cell position signal $S1_{LOC}$ that represents the pixel position within one screen in the lighted cell to the forced lighting cell designation unit 352. In addition, the 3×3 block lighted cell detection unit 353 supplies a lighted cell brightness signal $S1_Y$ representing the brightness level indicated by the current field pixel data $PD_{CU}$ corresponding to the lighted cell to the forced lighting cell designation unit 352.

Figure 11:
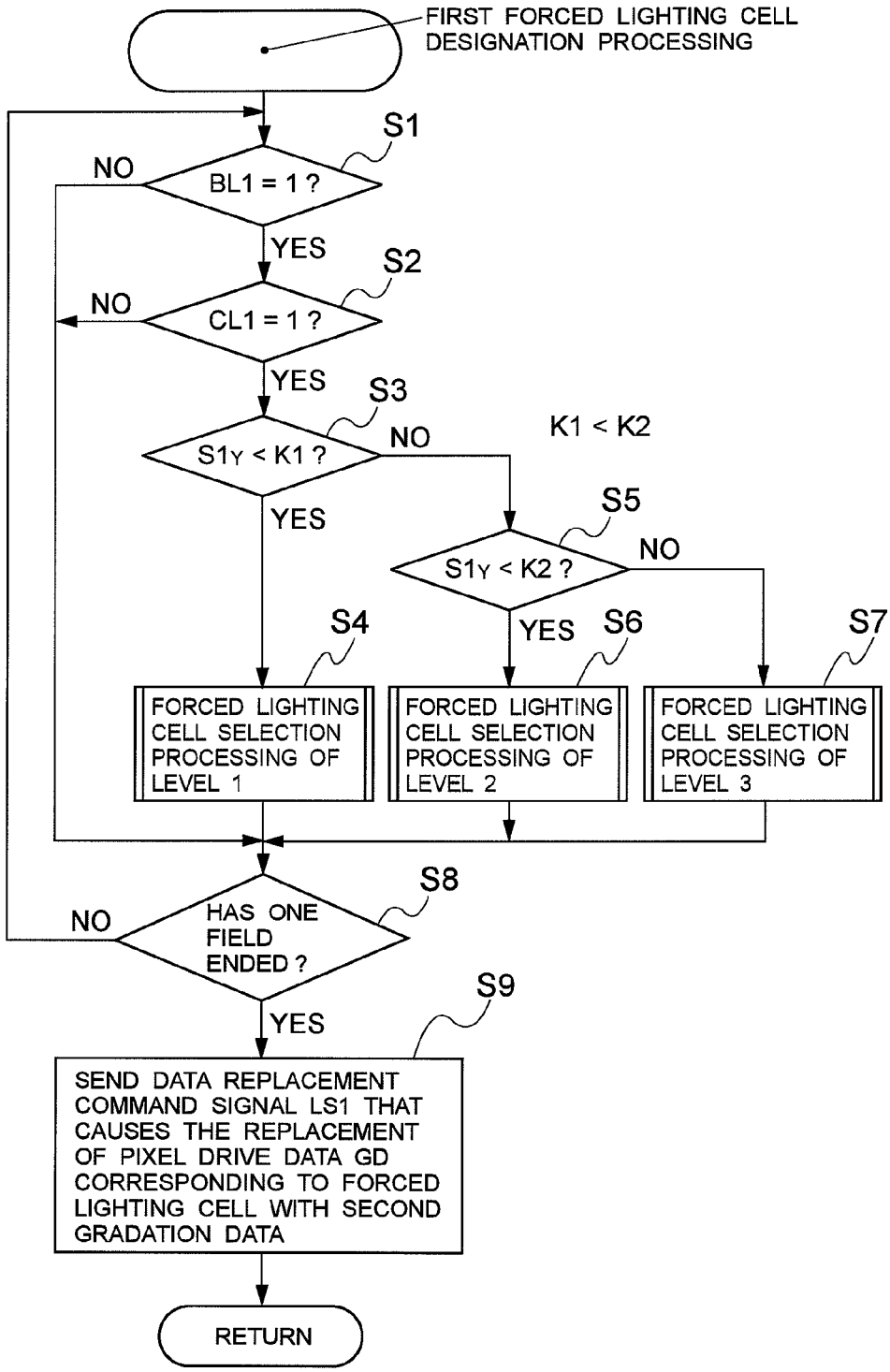
FIG. 11 shows a first forced lighting cell designation processing flow implemented in the forced lighting cell designation unit 352.

The forced lighting cell designation unit 352 executes the first forced lighting cell designation process flow such as shown in FIG. 11 for each field (frame).

Referring to FIG. 11, first, the forced lighting cell designation unit 352 determines whether the full quenching detection signal BL1 has a logical level 1 (step S1). Thus, the forced lighting cell designation unit determines whether all the nine discharge cells PC within a 3×3 block assumed a quenched state over one field at the stage of the immediately preceding field. Where the full quenching detection signal BL1 is determined to have a logical level 1 in step S1, the forced lighting cell designation unit 352 determines whether the lighted cell detection signal CL1 has a logical level 1 (step S2). Thus, the forced lighting cell designation unit determines whether the aforementioned lighted cell is present among the nine discharge cells PC within a 3×3 block. Where the lighted cell detection signal CL1 is determined to have a logical level 1 in step S2, the forced lighting cell designation unit 352 determines whether the brightness level indicated by the lighted cell brightness signal $S1_Y$ is less than the predetermined brightness level K1 (step S3). Where the brightness level indicated by the lighted cell brightness signal $S1_Y$ is determined to be less than the predetermined brightness level K1 in step S3, the forced lighting cell designation unit 352 executes the forced lighting cell selection processing of level 1 (described hereinbelow) (step S4). Further, where the brightness level indicated by the lighted cell brightness signal $S1_Y$ is determined not to be less than the predetermined brightness level K1 in step S3, the forced lighting cell designation unit 352 determines whether the brightness level indicated by the lighted cell brightness signal $S1_Y$ is less than the brightness level K2 (K1<K2) (step S5). Where the brightness level indicated by the lighted cell brightness signal $S1_Y$ is determined to be less than the predetermined brightness level K2 in step S5, the forced lighting cell designation unit 352 executes the forced lighting cell selection processing of level 2 (described hereinbelow) (step S6). On the other hand, where the brightness level indicated by the lighted cell brightness signal $S1_Y$ is determined not to be less than the predetermined brightness level K2 in step S5, the forced lighting cell designation unit 352 executes the forced lighting cell selection processing of level 3 (described hereinbelow) (step S7).

Figure 12:
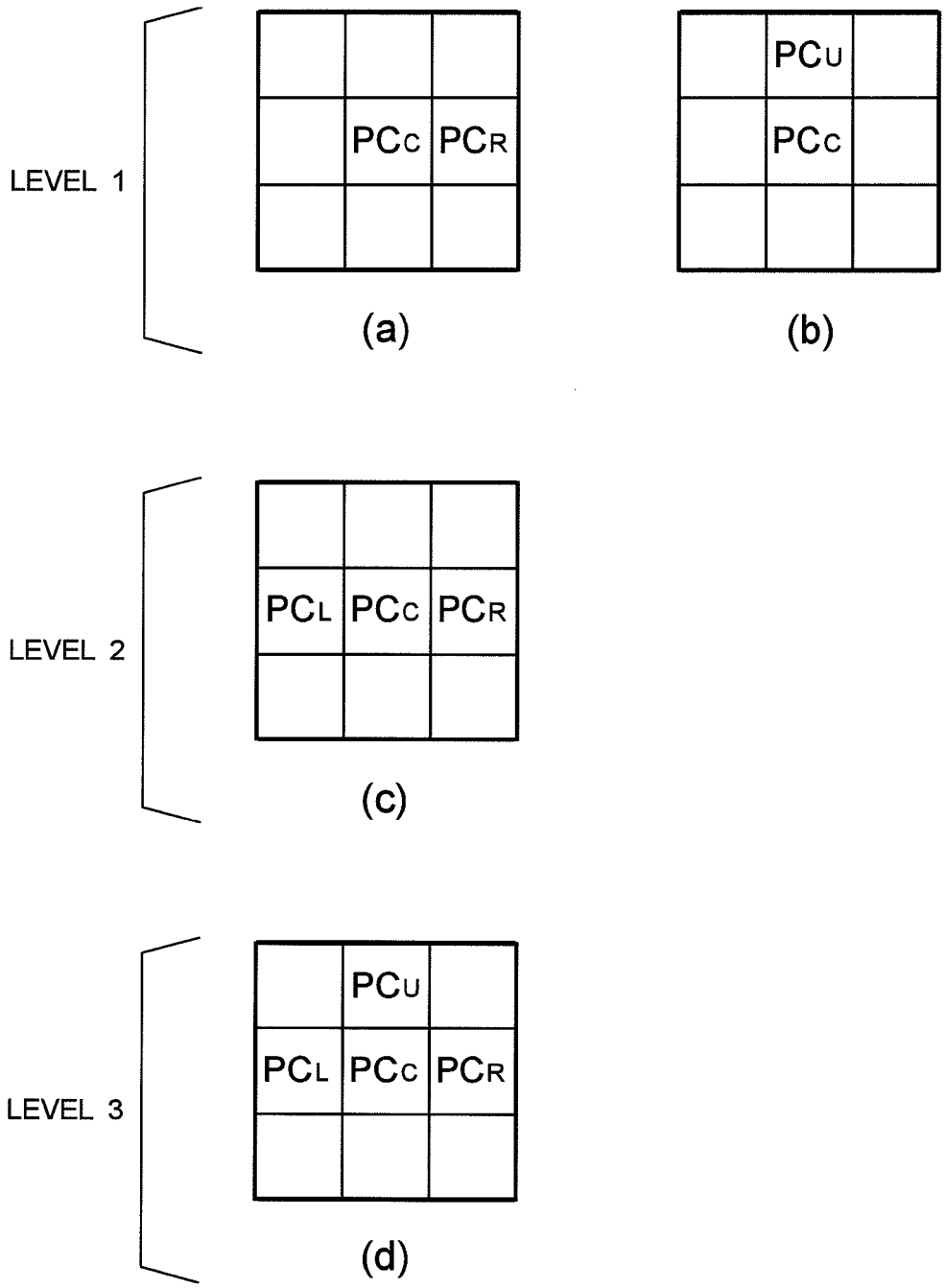
FIG. 12 shows a discharge cell selected by the forced lighting cell selection processing in the forced lighting cell designation unit 352.

Here, in the forced lighting cell selection processing of level 1 (step S4), first, the forced lighting cell designation unit 352 takes the discharge cell indicated by the lighted cell position signal $S1_{LOC}$ as a lighting transition cell and selects one from among the adjacent discharge cells located to the left and to the right of the lighting transition cell as a discharge cell that has to be forcibly set into a lighted state. For example, when the lighting transition cell is a discharge cell $PC_C$ such as shown in FIG. 12A, the discharge cell $PC_R$ that is adjacent thereto on the right side is selected as a discharge cell that has to be forcibly set into a lighted state. Further, the forced lighting cell designation unit 352 also may select one from among the adjacent cells located above and below the lighting transition cell, for example, the adjacent discharge cell $PC_U$ located above the central discharge cell $PC_C$, as shown in FIG. 12B, as the discharge cell that has to be forcibly set into a lighted state. Then, the forced lighting cell designation unit 352 stores the information indicating the pixel position of the discharge cell that has been selected as the discharge cell that has to be forcibly set into a lighted state, for example, the discharge cell $PC_R$ shown in FIG. 12A or the discharge cell $PC_U$ shown in FIG. 12B, in an internal memory (not shown in the figure).

In the forced lighting cell selection processing of level 2 (step S6), first, the forced lighting cell designation unit 352 selects the discharge cells indicated by the lighted cell position signal $S1_{LOC}$, that is, the adjacent discharge cells located on the left and right sides of the lighting transition cell, as the discharge cells that have to be forcibly set into a lighted state. For example, in the case where the lighting transition cell is the discharge cell $PC_C$ such as shown in FIG. 12C, the discharge cell $PC_R$ adjacent thereto on the right side and the discharge cell $PC_L$ adjacent thereto on the left side are selected as the discharge cells that have to be forcibly set into a lighted state. Then, the forced lighting cell designation unit 352 stores the information indicating the pixel position of the discharge cells that have been selected as the discharge cells that have to be forcibly set into a lighted state, for example, the discharge cell $PC_R$ and the discharge cell $PC_L$ shown in FIG. 12C, in the internal memory.

In the forced lighting cell selection processing of level 3 (step S7), first, the forced lighting cell designation unit 352 selects the discharge cells indicated by the lighted cell position signal $S1_{LOC}$, that is, the adjacent discharge cells located on the left and right sides of the lighting transition cell and one of the adjacent discharge cells located thereabove and therebelow, as the discharge cells that have to be forcibly set into a lighted state. For example, in the case where the lighting transition cell is the discharge cell $PC_C$ such as shown in FIG. 12D, the discharge cell $PC_R$ adjacent thereto on the right side, the discharge cell $PC_L$ adjacent thereto on the left side, and the adjacent discharge cell $PC_U$ located thereabove are selected as the discharge cells that have to be forcibly set into a lighted state. Then, the forced lighting cell designation unit 352 stores the information indicating the pixel position of the discharge cells that have been selected as the discharge cells that have to be forcibly set into a lighted state, for example, the discharge cells $PC_R$, $PC_L$, and $PC_U$ shown in FIG. 12C, in the internal memory.

Once the above-described step S4, S6, or S7 is completed, the forced lighting cell designation unit 352 determines whether the processing of one-field (one-frame) has ended (step S8). Where the processing of one-field (one-frame) is determined not to have ended in this step S8, the forced lighting cell designation unit 352 returns to the execution of step S1 and repeatedly executes the above-described operations. On the other hand, where the processing of one-field (one-frame) is determined to have ended in this step S8, the forced lighting cell designation unit 352 executes the following step S9.

Thus, the forced lighting cell designation unit 352 reads the information indicating the pixel position of the discharge cells that have to be forcibly set into a lighted state and supplies a data replacement command signal LS1 that has to replace the pixel drive data GD corresponding to this pixel with the data corresponding to the gradation other than the black display to the data replacement unit 36 (step S9).

Figure 13:
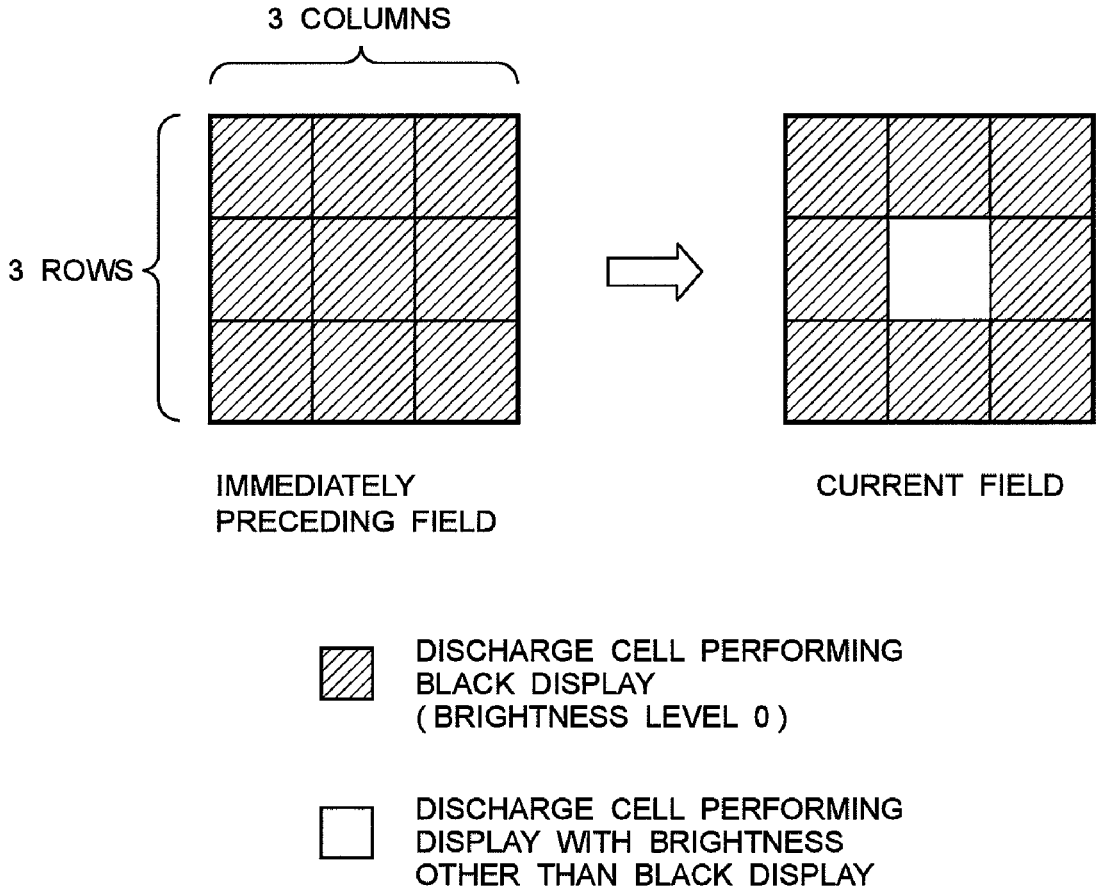
FIG. 13 shows a transition of the drive form of the discharge cell in which the deficit of charged particles occurs.

With the above-described processing, the first forced lighting processing unit 35, first, determines whether a transition has been made from a state in which all the discharge cells within a block are in a black display mode (immediately preceding field) to a state in which a discharge cell demonstrating a brightness other than the black display is present (current field) for each 3 row×3 column block such as shown in FIG. 13 (steps S1 and S2). Where the occurrence of such transition has been detected, the first forced lighting processing unit 35 detects the discharge cell that made a transition from the black display state (immediately preceding field) to the state demonstrating a brightness other than the black display (current field) as a lighting transition cell.

However, in the display state shown in FIG. 13, a drive that has to realize the black display, that is, the drive corresponding to the first gradation such as shown in FIG. 7, is inherently performed in each of eight adjacent discharge cells surrounding the lighting transition cell (central discharge cell) in the block in the stage of the current field. As a result, the sustain discharge cannot be initiated over one field display period in any of these adjacent discharge cell. Therefore, the central discharge cell serving as a lighting transition cell is in a state in which it cannot receive a supply of charged particles from the adjacent discharge cells.

Accordingly, when a transition of the display state, such as shown in FIG. 13, has occurred, the first forced lighting processing unit 35 executes a processing that has to realize forcibly a drive (referred to hereinbelow as "forced lighting drive") corresponding to a gradation other than the black display with respect to at least one discharge cell from among the discharge cells adjacent to the lighting transition cell (central discharge cell) (step S9). Thus, the first forced lighting processing unit 35 issues a command (LS1) to replace the pixel drive data GD corresponding to this discharge cell with the data corresponding to the gradation other than the first gradation. In this case, the first forced lighting processing unit 35 decreases the number of discharge cells selected to realize the forced lighting drive when the brightness level of the lighting transition cell (central discharge cell) is low. For example, when the brightness level of the lighting transition cell is lower than K1, the first forced lighting processing unit 35 selects only one discharge cell adjacent to the central discharge cell as the discharge cell for executing the forced lighting drive, as shown in FIG. 12A or FIG. 12B (forced lighting cell selection process of level 1). Further, when the brightness level of the lighting transition cell is equal to or higher than K1, but lower than K2, the first forced lighting processing unit 35 selects only two adjacent discharge cell located on the left and right sides of the central discharge cell as the discharge cells for executing the forced lighting drive, as shown in FIG. 12C (forced lighting cell selection process of level 2). Further, when the brightness level of the lighting transition cell is equal to or higher than K2, the first forced lighting processing unit 35 selects a total of three discharge cell, namely, two adjacent discharge cell located on the left and right sides of the central discharge cell and one adjacent discharge cell located above the central discharge cell as the discharge cells for executing the forced lighting drive, as shown in FIG. 12D (forced lighting cell selection process of level 3).

The second forced lighting processing unit 33 is configured of a 3×3 block full erase detection unit 331, a forced lighting cell designation unit 332, and a 3×3 block lighted cell detection unit 333.

The 3×3 block full erase detection unit 331, first, determines whether all the discharge cells PC within the block have assumed the quenched state over one field period for each 3 row×3 column block with respect to the discharge cells $PC_{(1,1)}$ to $PC_{(n,m)}$ within one screen, based on the current field pixel data $PD_{CU}$ of one field. Thus, the 3×3 block full erase detection unit 331 determines that all the nine discharge cells PC within the block have assumed the quenched state over one field only in the case where all the current field pixel data $PD_{CU}$ corresponding to each discharge cell PC within each block represent the brightness level 0. Further, the 3×3 block full erase detection unit 331 supplies a full erase detection signal BL2 indicating the logical level 1 to the forced lighting cell designation unit 332 when the block full erase detection unit determines that all the discharge cells PC within the block have assumed the quenched state over one field, and supplies a detection signal indicating a logical level 0 in other cases.

The 3×3 block lighted cell detection unit 333, first, detects a discharge cell PC demonstrating a brightness other than the black display, that is, larger than the brightness level 0, in a block for each 3 row×3 column block with respect to the discharge cells $PC_{(1,1)}$ to, $PC_{(n,m)}$ within one screen, based on the next field pixel data $PD_{NX}$ of one field. Thus, from among all the discharge cells PC within each block, the 3×3 block lighted cell detection unit 333 detects a discharge cell PC for which the next field pixel data $PD_{NX}$ corresponding to the discharge cell PC represent a brightness larger than the brightness level 0. In this case, the 3×3 block lighted cell detection unit 333 takes this discharge cell PC as a lighted cell and supplies a lighted cell detection signal CL2 with a logical level 1 indicating that this lighted cell has been detected to the forced lighting cell designation unit 332. The 3×3 block lighted cell detection unit 333 also supplies a lighted cell position signal $S2_{LOC}$ that represents the pixel position within one screen in the lighted cell to the forced lighting cell designation unit 332. In addition, the 3×3 block lighted cell detection unit 333 supplies a lighted cell brightness signal $S2_Y$ representing the brightness level indicated by the next field pixel data $PD_{NX}$ corresponding to the lighted cell to the forced lighting cell designation unit 332.

Figure 14:
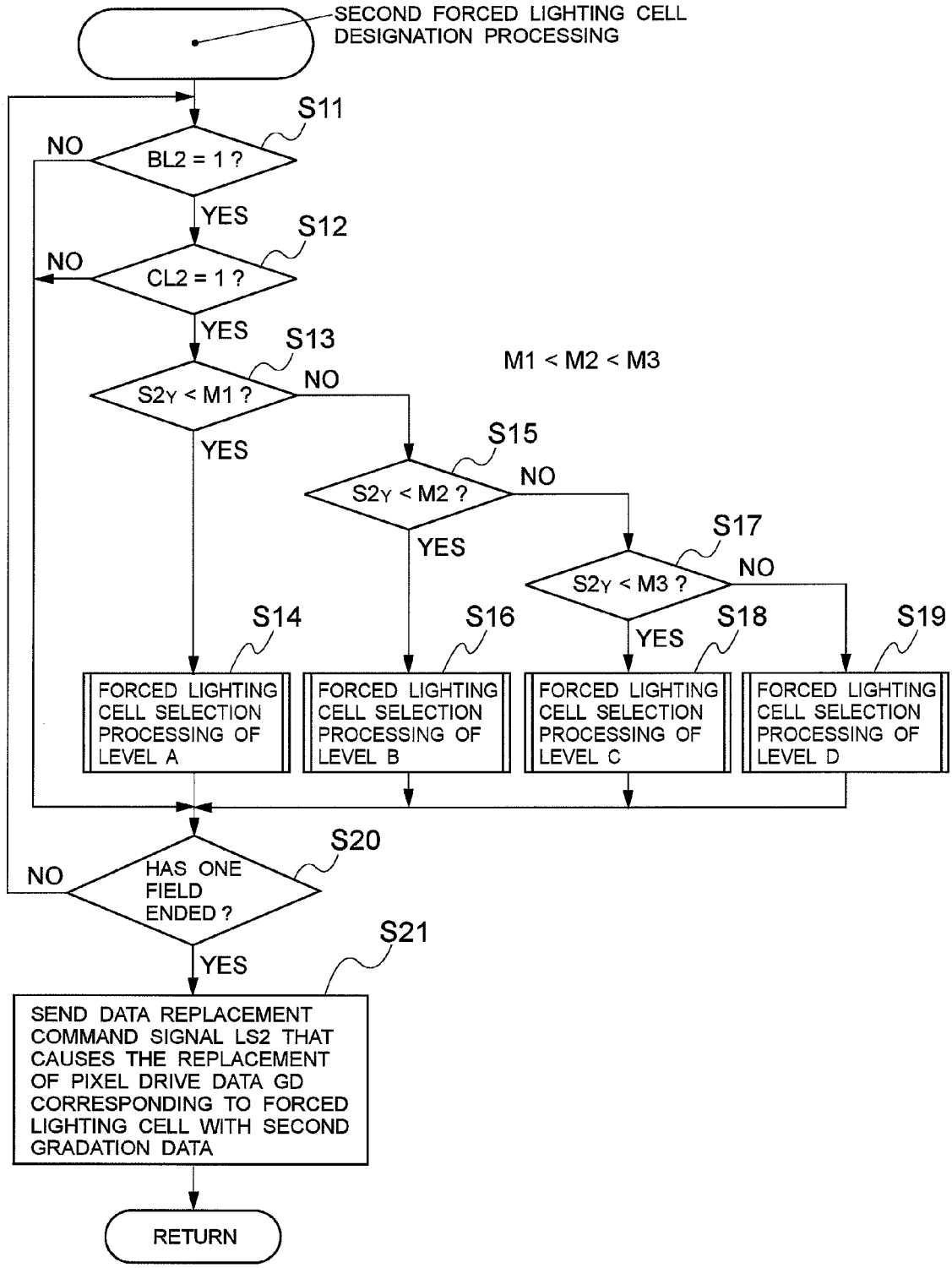
FIG. 14 shows a second forced lighting cell designation processing flow implemented in the forced lighting cell designation unit 332.

The forced lighting cell designation unit 332 executes the second forced lighting cell designation process flow such as shown in FIG. 14 for each field (frame).

Referring to FIG. 14, first, the forced lighting cell designation unit 332 determines whether the full quenching detection signal BL2 has a logical level 1 (step S11). Thus, the forced lighting cell designation unit determines whether all the nine discharge cells PC within a 3×3 block assumed a quenched state over one field at the stage of the current field. Where the full quenching detection signal BL2 is determined to have a logical level 1 in step S11, the forced lighting cell designation unit 332 determines whether the lighted cell detection signal CL2 has a logical level 1 (step S12). Thus, the forced lighting cell designation unit determines whether the aforementioned lighted cell is present among the nine discharge cells PC within a 3×3 block. Where the lighted cell detection signal CL2 is determined to have a logical level 1 in step S12, the forced lighting cell designation unit 332 determines whether the brightness level indicated by the lighted cell brightness signal $S2_Y$ is less than the predetermined brightness level M1 (step S13). Where the brightness level indicated by the lighted cell brightness signal $S2_Y$ is determined to be less than the predetermined brightness level M1 in step S13, the forced lighting cell designation unit 332 executes the forced lighting cell selection processing of level A (described hereinbelow) (step S14). Further, where the brightness level indicated by the lighted cell brightness signal $S2_Y$ is determined not to be less than the predetermined brightness level M1 in step S13, the forced lighting cell designation unit 332 determines whether the brightness level indicated by the lighted cell brightness signal $S2_Y$ is less than the brightness level M2 (M1<M2) (step S15). Where the brightness level indicated by the lighted cell brightness signal $S2_Y$ is determined to be less than the predetermined brightness level M2 in step S15, the forced lighting cell designation unit 332 executes the forced lighting cell selection processing of level B (described hereinbelow) (step S16). On the other hand, where the brightness level indicated by the lighted cell brightness signal $S2_Y$ is determined not to be less than the predetermined brightness level M2 in step S15, the forced lighting cell designation unit 332 determines whether the brightness level indicated by the lighted cell brightness signal $S2_Y$ is less than the brightness level M3 (M2<M3) (step S17). Where the brightness level indicated by the lighted cell brightness signal $S2_Y$ is determined to be less than the predetermined brightness level M3 in step S17, the forced lighting cell designation unit 332 executes the forced lighting cell selection processing of level C (described hereinbelow) (step S18). On the other hand, where the brightness level indicated by the lighted cell brightness signal $S2_Y$ is determined not to be less than the predetermined brightness level M3 in step S17, the forced lighting cell designation unit 332 executes the forced lighting cell selection processing of level D (described hereinbelow) (step S19).

Figure 15:
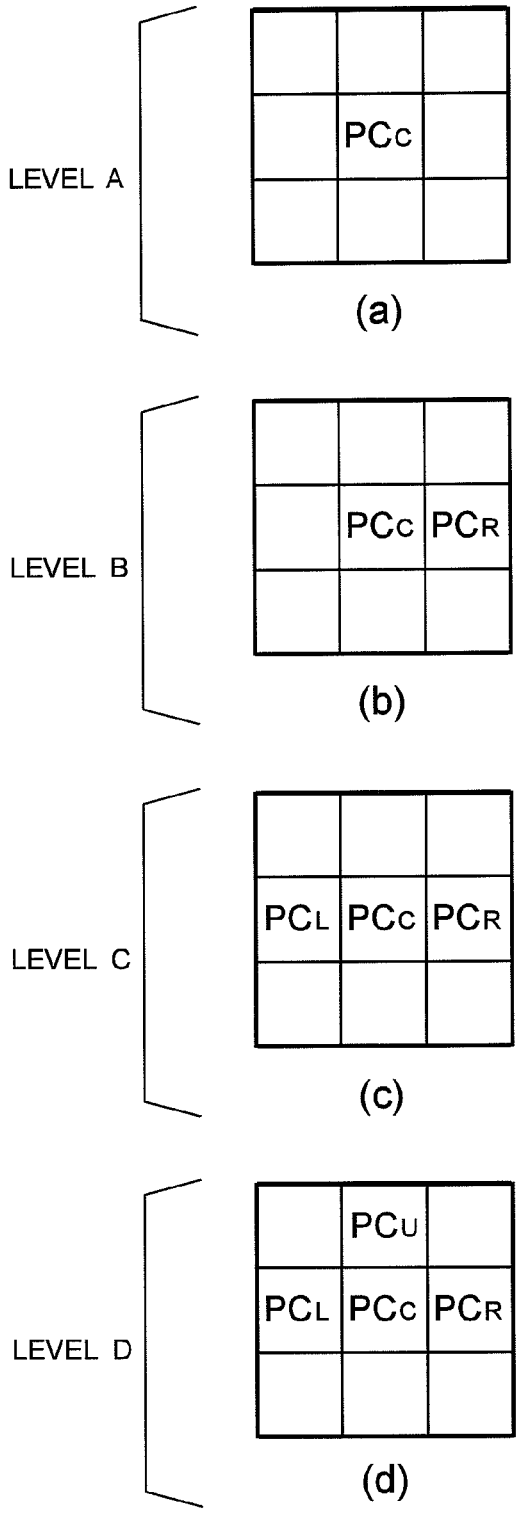
FIG. 15 shows a discharge cell selected by the forced lighting cell selection processing in the forced lighting cell designation unit 332.

Here, in the forced lighting cell selection processing of level A (step S14), first, the forced lighting cell designation unit 332 takes the discharge cell indicated by the lighted cell position signal $S2_{LOC}$ as a lighting transition cell and selects it as a discharge cell that has to be forcibly set into a lighted state. For example, as shown in FIG. 15A, when the discharge cell indicated by the lighted cell position signal $S2_{LOC}$, from among the nine discharge cells within a 3×3 block, that is, the lighting transition cell, is a discharge cell $PC_C$, only the discharge cell $PC_C$ is selected as a discharge cell that has to be forcibly set into a lighted state. Then, the forced lighting cell designation unit 332 stores the information indicating the pixel position of the discharge cell that has been selected as the discharge cell that has to be forcibly set into a lighted state, that is, the discharge cell $PC_C$ shown in FIG. 15A, in an internal memory (not shown in the figure).

In the forced lighting cell selection processing of level B (step S16), first, the forced lighting cell designation unit 332 selects the discharge cells indicated by the lighted cell position signal $S2_{LOC}$, that is, a total of two discharge cells including the lighting transition cell and the adjacent discharge cell located on the left (or on the right) side of the lighting transition cell, as the discharge cells that have to be forcibly set into a lighted state. For example, in the case where the lighting transition cell is the discharge cell $PC_C$ such as shown in FIG. 15B, the discharge cell $PC_C$ and the discharge cell $PC_R$ adjacent thereto on the right side are selected as the discharge cells that have to be forcibly set into a lighted state. Then, the forced lighting cell designation unit 332 stores the information indicating the pixel position of the discharge cells that have been selected as the discharge cells that have to be forcibly set into a lighted state, for example, the discharge cells $PC_C$ and $PC_R$ shown in FIG. 15B, in the internal memory (not shown in the figure).

In the forced lighting cell selection processing of level C (step S18), first, the forced lighting cell designation unit 332 selects the discharge cells indicated by the lighted cell position signal $S2_{LOC}$, that is, the lighting transition cell and the adjacent discharge cells located on the left and right sides thereof, as the discharge cells that have to be forcibly set into a lighted state. For example, in the case where the lighting transition cell is the discharge cell $PC_C$ such as shown in FIG. 15C, the discharge cell $PC_C$ and also the discharge cell $PC_R$ adjacent thereto on the right side and the discharge cell $PC_L$ adjacent thereto on the left side are selected as the discharge cells that have to be forcibly set into a lighted state. Then, the forced lighting cell designation unit 332 stores the information indicating the pixel position of the discharge cells that have been selected as the discharge cells that have to be forcibly set into a lighted state, for example, the discharge cells $PC_C$, $PC_R$, and $PC_L$ shown in FIG. 15C, in the internal memory.

In the forced lighting cell selection processing of level D (step S19), first, the forced lighting cell designation unit 332 selects the discharge cells indicated by the lighted cell position signal $S2_{LOC}$, that is, the lighting transition cell and the adjacent discharge cells located on the left and right sides thereof and thereabove, as the discharge cells that have to be forcibly set into a lighted state. For example, in the case where the lighting transition cell is the discharge cell $PC_C$ such as shown in FIG. 15D, the discharge cell $PC_C$ and also the adjacent discharge cell $PC_R$ located on the right side thereof, the adjacent discharge cell $PC_L$ located on the left side thereof, and the adjacent cell $PC_U$ located thereabove are selected as the discharge cells that have to be forcibly set into a lighted state. Then, the forced lighting cell designation unit 332 stores the information indicating the pixel position of the discharge cells that have been selected as the discharge cells that have to be forcibly set into a lighted state, for example, the discharge cells $PC_C$, $PC_R$, $PC_L$, and $PC_U$ shown in FIG. 15D, in the internal memory.

Once the above-described step S14, S16, S18 or S19 is completed, the forced lighting cell designation unit 332 determines whether the processing of one-field (one-frame) has ended (step S20). Where the processing of one-field (one-frame) is determined not to have ended in this step S20, the forced lighting cell designation unit 332 returns to the execution of step S11 and repeatedly executes the above-described operations. On the other hand, where the processing of one-field (one-frame) is determined to have ended in this step S20, the forced lighting cell designation unit 332 executes the following step S21.

Thus, the forced lighting cell designation unit 332 reads the information indicating the pixel position of the discharge cells that have to be forcibly set into a lighted state and supplies a data replacement command signal LS2 that has to replace the pixel drive data GD corresponding to this pixel with the data corresponding to the gradation (for example, second gradation) other than the black display to the data replacement unit 36 (step S21).

Figure 16:
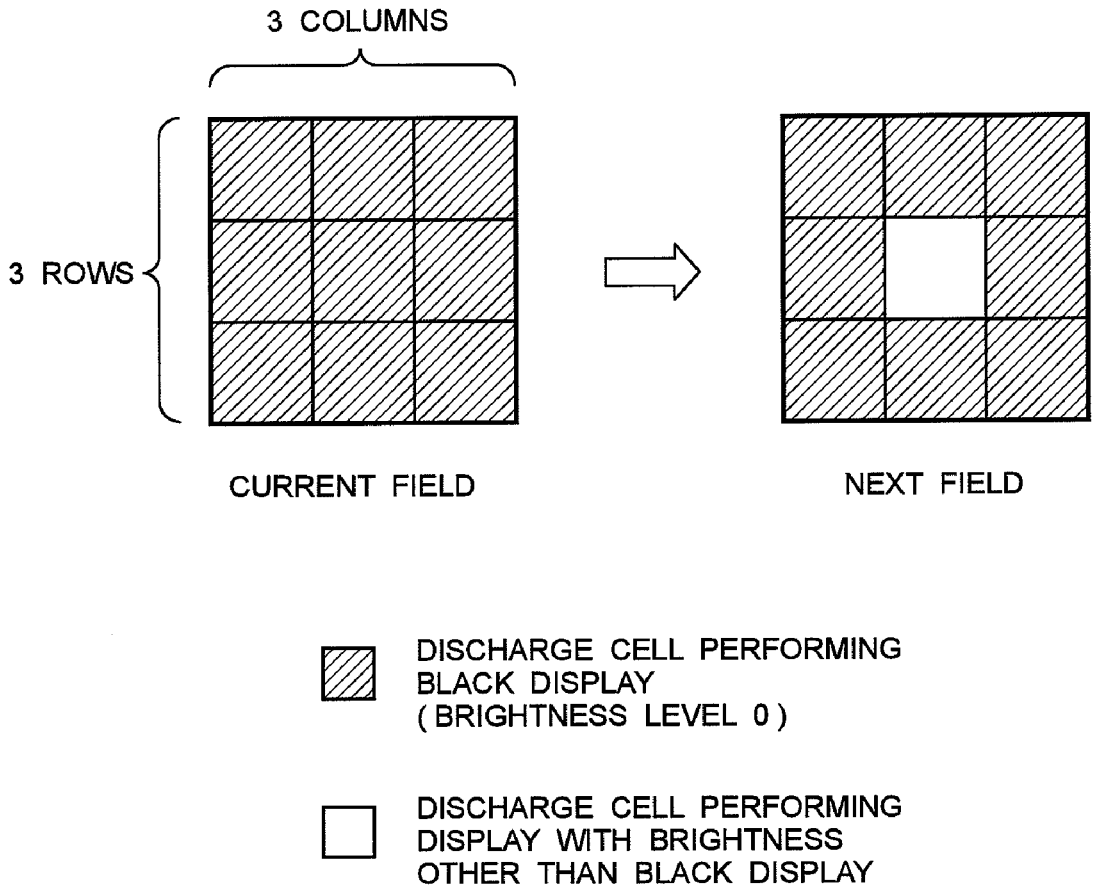
FIG. 16 shows a transition of the drive form of the discharge cell in which the deficit of charged particles occurs.

With the above-described processing, the second forced lighting processing unit 33 determines whether a transition has been made from a state in which all the discharge cells within a block are in a black display mode (current field) to a state in which a discharge cell demonstrating a brightness other than the black display is present (next field) for each 3 row×3 column block such as shown in FIG. 16 (steps S11 and S12). Where the occurrence of such transition has been detected, the second forced lighting processing unit 33 detects the discharge cell that made a transition from the black display state (current field) to the state demonstrating a brightness other than the black display (next field) as a lighting transition cell.

However, in the display state shown in FIG. 16, a drive that has to realize the black display, that is, the drive corresponding to the first gradation such as shown in FIG. 7, is originally performed in all the discharge cells including the lighting transition cell (central discharge cell) in the block in the stage of the current field. As a result, the sustain discharge cannot be initiated over one field display period in any of these adjacent discharge cell. Therefore, the central discharge cell serving as a lighting transition cell is in a state in which it cannot receive a supply of charged particles at an immediately preceding stage in which a driver other than the black display is implemented.

Accordingly, when a transition, such as shown in FIG. 16, has occurred, although all the discharge cells within the block originally had to be driven at a first gradation corresponding to the black display, the second forced lighting processing unit 33 executes a processing that has to realize a forced lighting drive corresponding to a gradation (for example, the second gradation) other than the black display with respect to at least one discharge cell from among the adjacent discharge cells, including the lighting transition cell (step S21). Thus, the second forced lighting processing unit 33 issues a command (LS2) to replace the pixel drive data GD corresponding to this discharge cell with the data corresponding to the gradation other than the first gradation. In this case, the second forced lighting processing unit 33 decreases the number of discharge cells selected to realize the forced lighting drive when the brightness level of the lighting transition cell is low. For example, when the brightness level of the lighting transition cell (central discharge cell) is lower than M1, the second forced lighting processing unit 33 selects only the lighting transition cell as the discharge cell for executing the forced lighting drive, as shown in FIG. 15A (forced lighting cell selection process of level A). Further, when the brightness level of the lighting transition cell is equal to or higher than M1, but lower than M2, the second forced lighting processing unit 33 selects the lighting transition cell and one discharge cell adjacent to the lighting transition cell as the discharge cells for executing the forced lighting drive, as shown in FIG. 15B (forced lighting cell selection process of level B). Further, when the brightness level of the lighting transition, cell is equal to or higher than M2, but lower than M3, the second forced lighting processing unit 33 selects the lighting transition cell and two adjacent discharge cells located on the left and right sides thereof as the discharge cells for executing the forced lighting drive, as shown in FIG. 15C (forced lighting cell selection process of level C). When the brightness level of the lighting transition cell is equal to or higher than M3, the second forced lighting processing unit 33 selects a total of four discharge cells, namely, the lighting transition cell, two adjacent discharge cells located on the left and right sides thereof, and one adjacent discharge cell located above the lighting transition cell as the discharge cells for executing the forced lighting drive, as shown in FIG. 15D (forced lighting cell selection process of level D).

Here, the delay processing unit 37 shown in FIG. 10 supplies the pixel drive data GD supplied from the pixel drive data generating circuit 2 to the data replacement unit 36, upon delaying the data by the time that takes into account the time to be spent on the above-described processing performed by the first forced lighting processing unit 35 and the second forced lighting processing unit 33. In other words, the delay processing unit 37 supplies the pixel drive data GD to the data replacement unit 36 with a delay time such as to output the pixel drive data GD corresponding to the current field pixel data $PD_{CU}$, at a timing at which the processing of one field, for example, in step S20 (shown in FIG. 14) of the second forced lighting processing unit 33 is determined to have ended.

When the data replacement command signal LS1 or LS2 is supplied, the data replacement unit 36 replaces the pixel drive data GD corresponding to the current field pixel data $PD_{CU}$ that were supplied from the delay-processing unit 37 at this timing with the pixel drive data corresponding to a gradation other than the black display. For example, the pixel drive data GD are replaced with the pixel drive data [11000000000000] corresponding to the second gradation such as shown in FIG. 7. Thus, the data replacement unit 36 forcibly replaces with the pixel drive data corresponding to the second gradation only the pixel drive data GD corresponding to the discharge cell selected as the discharge cell for which the forced lighting drive has to be implemented in the first forced lighting processing unit 35 and/or second forced lighting processing unit 33, from among each pixel drive data GD corresponding to each pixel. In this case, from among all the pixel drive data GD supplied from the delay processing unit 37, the data replacement unit 36 outputs those data that have been replaced as described hereinabove as the pixel drive data GGD, whereas the data that have not been the object of data replacement are outputted, without any change, as the pixel drive data GGD.

With such pixel drive data GGD, when the state of each discharge cell within a 3×3 block within two consecutive fields is predicted to make a transition such as shown in FIG. 13 or FIG. 16, the discharge cell that originally had to be driven at a gradation corresponding to black display will be driven at a gradation other than the black display (for example, the second gradation shown in FIG. 7).

Thus, with the pixel drive data GGD obtained in response to the data replacement command signal LS1, a forced lighting drive is performed in at least one of the discharge cells adjacent to the lighting transition cell (central discharge cell), as shown in FIG. 17A to FIG. 17C. In this case, the discharge cells adjacent to the lighting transition cells are driven at gradations other than the black display in the form such as shown in FIG. 17A when the brightness level at which the lighting transition cell has to be caused to emit is lower than the predetermined brightness level K1, FIG. 17B when the brightness level at which the lighting transition cell has to be caused to emit is equal to or higher than K1, but lower than the brightness level K2, and FIG. 17D when the brightness level at which the lighting transition cell has to be caused to emit is equal to or higher than K2. In other words, the lower is the brightness level at which the lighting transition cell has to be caused to emit, the smaller is the number of discharge cells that have to be forcibly driven at a gradation other than the black display.

With such display, when the lighting transition cell is driven at a gradation other than the black display, a forced lighting drive is performed in at least one from among the discharge cells adjacent to the lighting transition cell. As a result, the number of charged particles within the lighting transition cell will be increased by the sustain discharge initiated in the adjacent discharge cells by this forced lighting drive. Therefore, the lighting transition cell can be reliably write address discharged.

Further, with the pixel drive data GGD obtained in response to the data replacement command signal LS2, the drive with a predetermined gradation other than the black display is implemented with respect to at least one adjacent discharge cell, including the lighting transition cell, in the immediately preceding field of the field in which the lighting transition cell is gradation driven at a brightness other than the black display as shown in FIG. 18A to FIG. 18D. In this case, the forced lighting drive is implemented in the form shown in FIG. 18A when the brightness level at which the lighting transition cell has to be caused to emit is lower than the predetermined brightness level M1, in the form shown in FIG. 18B when the brightness level at which the lighting transition cell has to be caused to emit is equal to or higher than the brightness level M1 and lower than the brightness level M2, in the form shown in FIG. 18C when the brightness level at which the lighting transition cell has to be caused to emit is equal to or higher than the brightness level M2 and lower than the brightness level M3, and in the form shown in FIG. 18D when the brightness level at which the lighting transition cell has to be caused to emit is equal to or higher than the brightness level M3. In other words, the lower is the brightness level at which the lighting transition cell has to be caused to emit, the smaller is the number of discharge cells that have to be forcibly driven at a gradation other than the black display.

Therefore, with such a drive, in the field immediately preceding the field in which the lighting transition cell is driven at a gradation other than the black display, a forced lighting drive is performed in the adjacent discharge cells, including the lighting transition cell. As a result, at a stage immediately preceding the field in which the lighting transition cell is driven at a gradation other than the black display, the number of charged particles in the lighting transition cell is increased by the sustain discharge initiated in the adjacent discharge cells, including the lighting transition cell. The lighting transition cell can thus be reliably write address discharged.

Thus, after the black display (the first gradation drive shown in FIG. 7) in which the sustain discharge has not been initiated over one field period, the number of charged particles remaining inside the discharge cell decreases, and the write discharge sometimes cannot be correctly initiated even when the discharge cell is driven at a gradation other than the black gradation in the immediately following field. In particular, where the black display state is maintained in all the discharge cells adjacent to the periphery of this discharge cell within this period, the charged particles generated following the sustain discharge initiated in these adjacent discharge cells cannot be used. Therefore, a discharge failure caused by such deficit of charged particles is vividly demonstrated.

Figure 17:
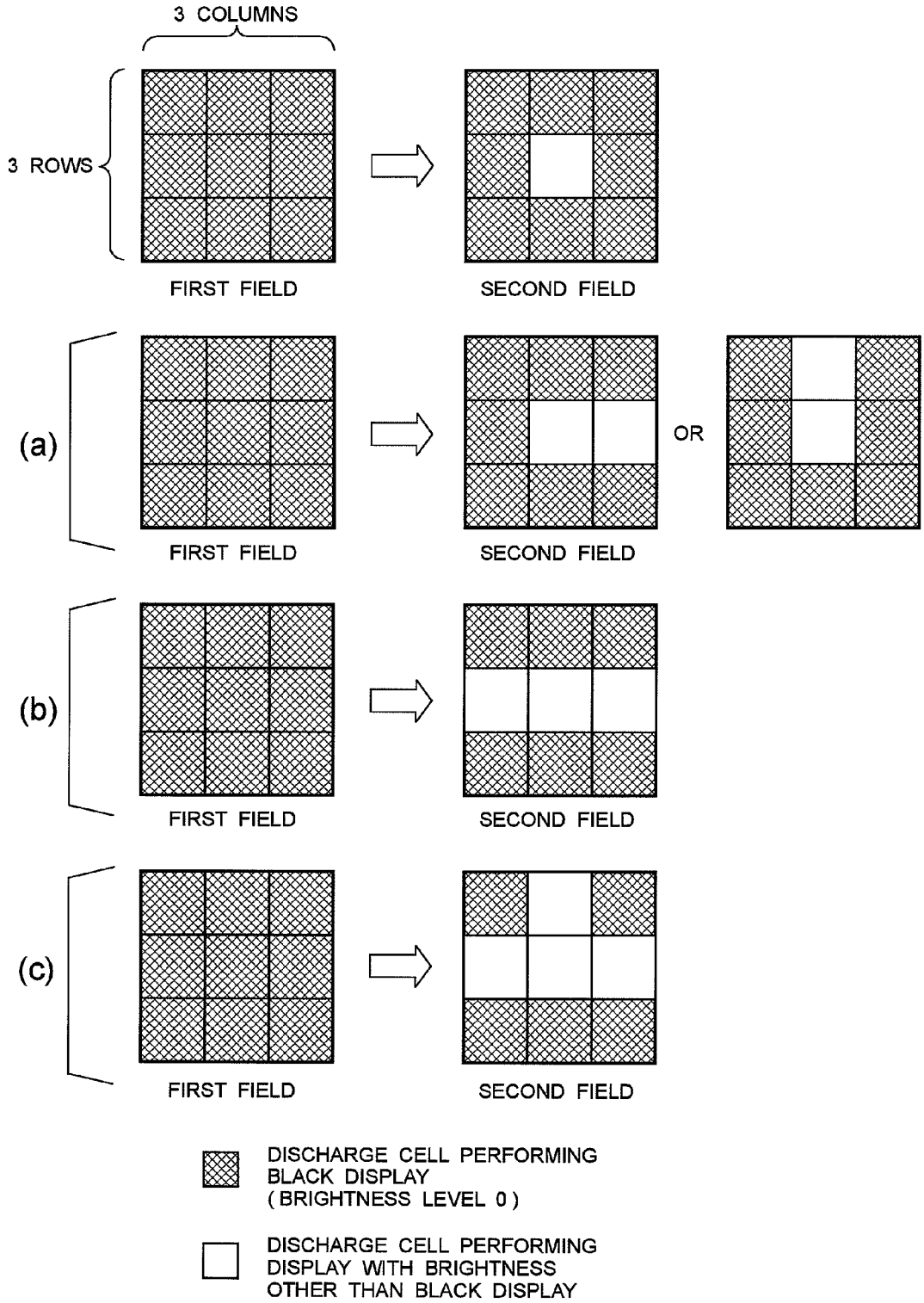
FIG. 17 shows an example of the drive form of the discharge cell performed by the forced lighting drive by the first forced lighting processing unit 35.
Figure 18:
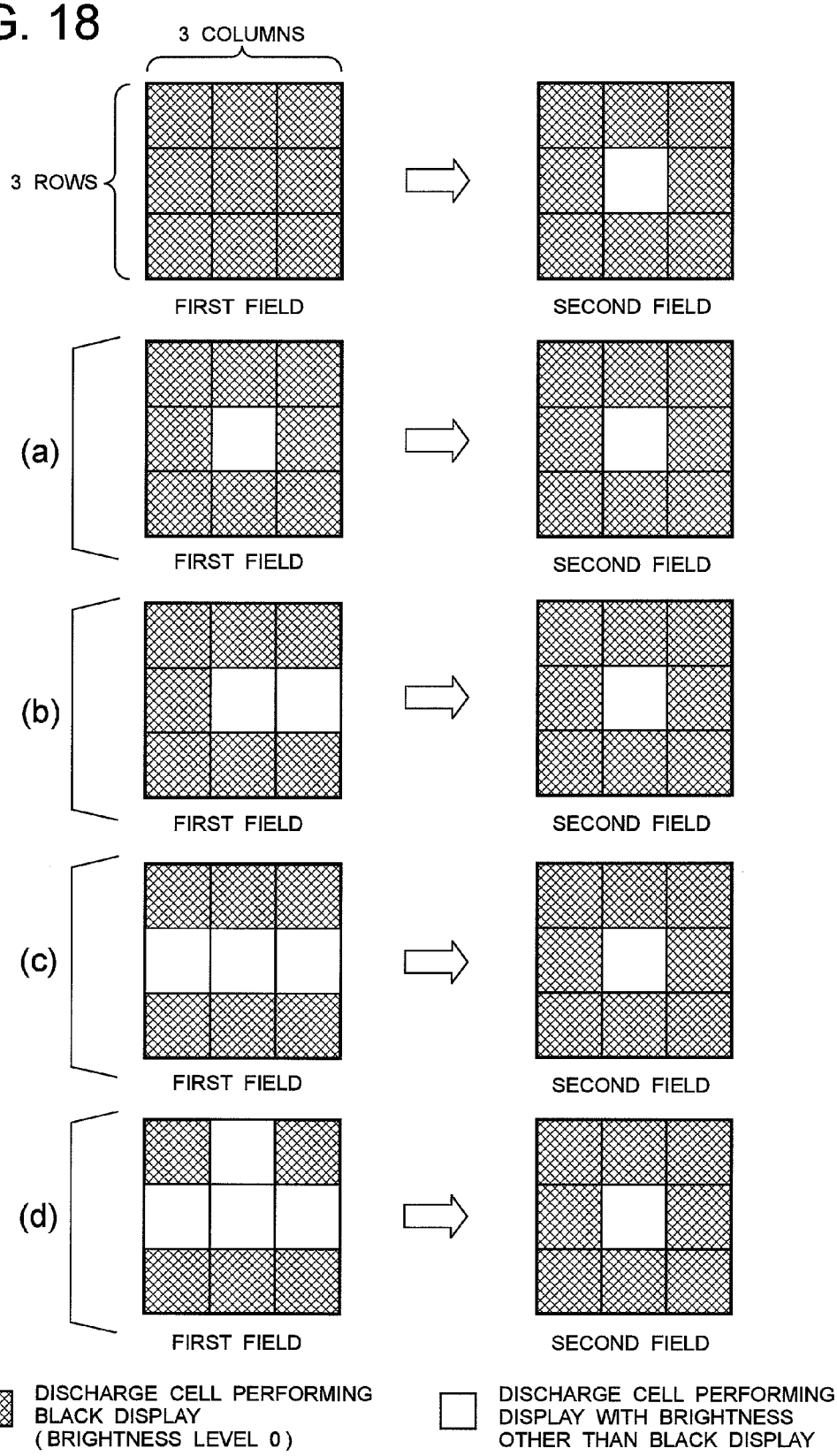
FIG. 18 shows an example of the drive form of the discharge cell performed by the forced lighting drive by the second forced lighting processing unit 33.

Here, when the deficit of charged particles occurs due to the image form that has to be displayed, that is, when the display state of each discharge cell between the two consecutive fields makes a transition such as shown in FIG. 13 or FIG. 16, the forced lighting processing circuit 3 generates pixel drive data GGD that have to realize the following drive. Thus, the forced lighting processing circuit 3 forcibly drives, at a gradation other than the black display, the discharge cells that are timely and spatially adjacent to the lighting transition cell (discharge cell in the block center), as shown in FIG. 17 or FIG. 18. As a result, the number of charged particles in the lighting transition cell increases following the sustain discharge initiated in the discharge cells that are timely and spatially adjacent to the lighting transition cell, and the subsequent write-address discharge can be reliably initiated.

In this case, the higher is the number of the adjacent discharge cells that have to be forcibly driven at a gradation other than the black display, the larger is the number of charged particles that can be formed, however, as shown in FIG. 13 or FIG. 16, each discharge cell adjacent to the lighting transition cell originally has to implement the black display. Accordingly, in the forced lighting processing circuit 3, for example, as shown in FIG. 17A to FIG. 17C, where the brightness level of the lighting transition cell is low, the number of the adjacent discharge cells that were forcibly driven at a gradation other than the black display is decreased, so as to suppress actively the effect of image deterioration associated with such drive. In other words, when the lighting transition cell is caused to emit the light with an original brightness, the lower is the emission brightness, the more vivid is the emission accompanying the forced lighting drive performed in the adjacent discharge cells. Therefore, when the brightness level at the time the lighting transition cell is caused to emit light is low, the number of the adjacent discharge cells that have to be the objects of the forced lighting drive is reduced. Furthermore, with consideration for this feature, when the adjacent discharge cells are forcibly driven at a gradation other than the black display in the forced lighting processing circuit 3, the drive is performed at a second gradation having a brightness level that is next in height to that of the first gradation corresponding to the black display.

In the present embodiment, the drive such as shown in FIG. 17A to FIG. 17C and the drive such as shown in FIG. 18A to FIG. 18D are implemented individually, but the two may be also realized in combination, as shown in FIG. 19A to FIG. 19C. In this case, the data replacement unit 36 performs the above-described data replacement with respect to the pixel drive data so that the drive is performed in the form shown in FIG. 19A when the brightness level that has to cause the emission from the lighting transition cell is lower than the predetermined brightness level T1, in the form shown in FIG. 19B when the brightness level is equal to or higher than the brightness level T1 and lower than the brightness level T2, and in the form shown in FIG. 19C in the case where the brightness level is equal to or higher than the brightness level T2.

Thus, as shown in FIG. 19A to FIG. 19C, the discharge cells that are timely and spatially adjacent to the lighting transition cell are forcibly driven at a gradation other than the black display.

Here, in the plasma display shown in FIG. 1, in the reset process R, the initialization of all the discharge cells PC is completed by a reset discharge that is weaker than the sustain discharge by using the action of the CL emitting MgO formed inside the discharge cells PC. In other words, in the conventional reset process that has to release a comparatively large number of charged particles within the discharge space, a discharge stronger than the sustain discharge is initiated as a reset discharge by applying a reset pulse of a voltage higher than the sustain pulse. Thus, by so releasing a large number of charged particles within the discharge space, it is possible to stabilize the write address discharge in the next address process $W_W$. However, in the discharge cell in which CL emitting MgO is formed, as in the present embodiment, the write address discharge in the address process $W_W$ is stabilized better that in the discharge cell in which no CL emitting MgO has been formed, regardless of the number of charged particles released in the reset process R. Accordingly, in the reset process R, the increase in dark contrast can be ensured by omitting a strong reset discharge that can release a comparatively large number of charged particles within the discharge space, that is, a reset discharge that is stronger than the sustain discharge.

However, where the black display state is maintained, the write address discharge failure caused by the deficit of charged particles still sometimes occurs even if the write address discharge has been stabilized by the action of the CL emitting MgO.

Accordingly, the adjacent discharge cells that are timely and/or spatially adjacent to the discharge cell for which the deficit of charged particles is predicted are forcibly subjected to a sustain discharge, even if the pixel data PD corresponding to the adjacent discharge cells indicate a black display, by the above-described operation of the forced lighting processing circuit 3 designed to prevent the write address discharge failure. With such processing, charged particles are supplied into the discharge cell for which the deficit of charged particles is predicted, and the write address discharge of this discharge cell is stabilized.

Therefore, with the plasma display device shown in FIG. 1, a write address discharge can be initiated with good stability even in the case in which a strong reset discharge that has to increase the dark contrast is omitted.

In the drive shown in FIG. 9, the reset process R is provided only for the subfield in the header of each field, and a reset discharge is initiated in this reset process R by applying the reset pulse RP only once. However, a reset discharge serving to form charged particles may be also initiated immediately before the reset pulse application.

Figure 20:
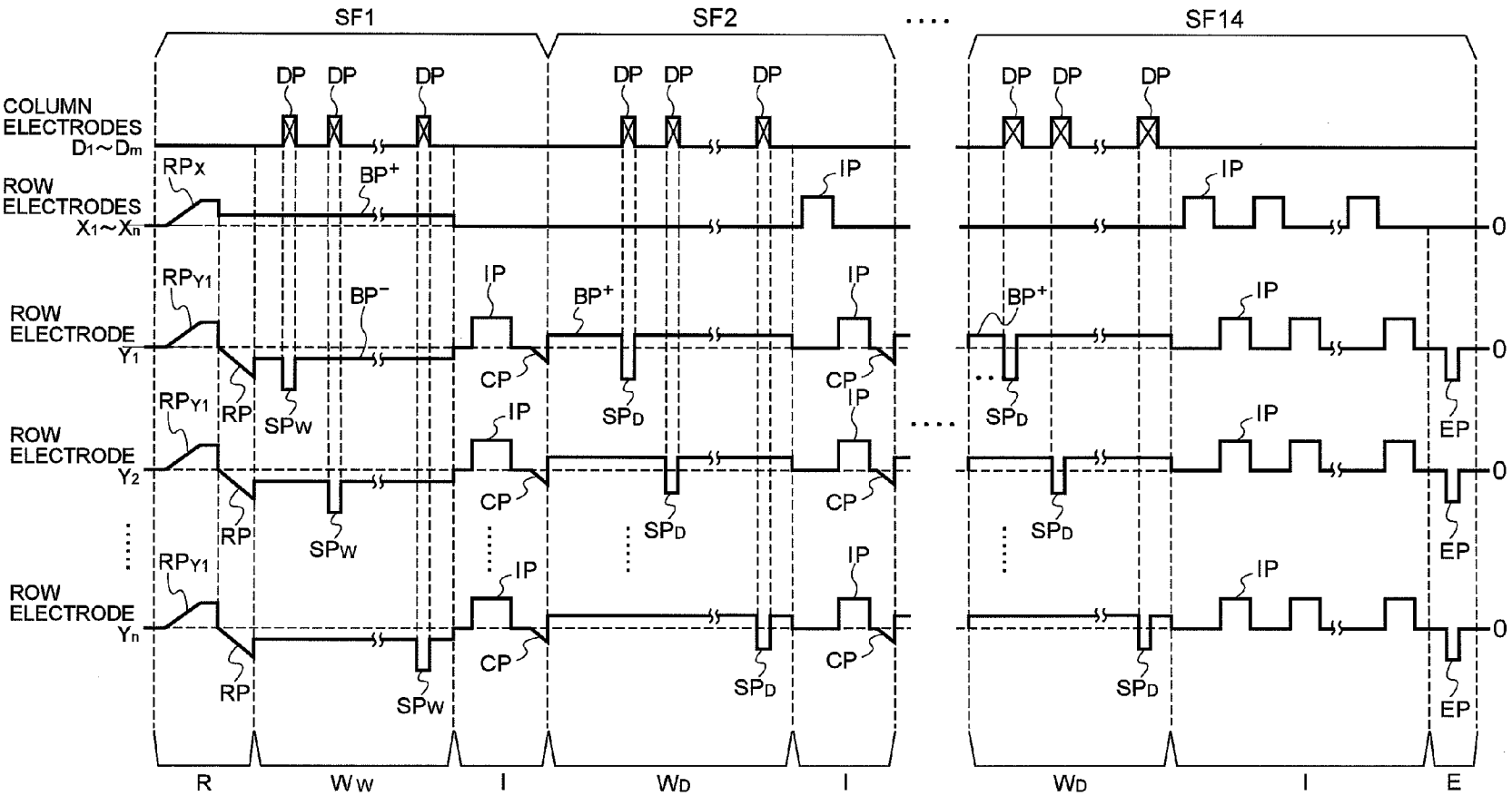
FIG. 20 shows another example of drive pulses applied to the PDP 50 according to the emission drive sequence shown in FIG. 8.

FIG. 20 illustrates an application example of another drive pulse performed with consideration for the aforementioned issue.

Referring to FIG. 20, each drive pulse that is applied in another process that removes the reset process R of the subfield SF1 and the application timing thereof are identical to those shown in FIG. 9, and the explanation thereof is therefore omitted.

In the reset process R shown in FIG. 20, first, in the front half portion thereof, the Y electrode driver 53 applies a reset pulse $RP_{Y1}$ of positive polarity that has a waveform in which the transition of electric potential at the front edge portion with the passage of time is more gradual than that in the sustain pulse IP to all the row electrodes $Y_1$ to $Y_n$. The peak potential of the reset pulse $RP_{Y1}$ is lower than the peak potential of the sustain pulse IP. During this time, the address driver 55 sets the column electrodes $D_1$-$D_m$ to a ground potential (0 V). In response to the application of the reset pulse $RP_{Y1}$, the first reset discharge is initiated between the row electrodes Y and column electrodes D within each of all the discharge cells PC. Thus, in the front half portion of the reset process R, by applying a voltage between the electrodes such that the row electrodes Y become anodes and the column electrodes D become cathodes, a discharge (referred to hereinbelow as a column-side cathode discharge) in which the electric current flows from the row electrodes Y toward the column electrodes D is initiated as the first reset discharge. In response to this first reset discharge, charged particles are formed in the discharge spaces within all the discharge cells PC. Further, after completion of such first reset discharge, a wall charge of negative polarity is formed in the vicinity of row electrodes Y within all the discharge cells PC, and a wall charge of positive polarity is formed in the vicinity of column electrodes D. Further, in the front half portion of the reset process R, the X electrode driver 51 applies to each of all the row electrodes $X_1$ to $X_n$ the reset pulses $RP_x$ that have the same polarity as the reset pulse $RP_{Y1}$ and have a peak potential that can prevent the surface discharge between the row electrodes X and Y that follows the application of the reset pulse $RP_{Y1}$. Then, in the rear half portion of the reset process R, the Y electrode driver 53 generates a reset pulse RP of negative polarity with a smooth transition of electric potential with the passage of time at the front edge and applies this reset pulse to all the row electrodes $Y_1$ to $Y_n$. Further, in the rear half portion of the reset process R, the X electrode driver 51 applies a base pulse $BP^+$ having a predetermined base potential of positive polarity to each of all the row electrodes $X_1$ to $X_n$. In this case, a second reset discharge is initiated between the row electrodes X and Y within all the discharge cells PC in response to the application of these reset pulse RP of negative polarity and base pulse $BP^+$ of positive polarity. With consideration for the wall charge formed in the vicinity of row electrodes X and Y in response to the above-described first reset discharge, the peak potentials of the reset pulse RP and base pulse $BP^+$ are the lowest electric potentials capable of reliably initiating the second reset discharge between the row electrodes X and Y. Further, the negative peak potential in the reset pulse RP is set to a potential higher than the peak potential of the below-described write scanning pulse $SP_W$ of negative polarity, that is, to a potential close to 0 V. Thus, where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the selective write address process $W_W$ becomes unstable. The wall charge formed in the vicinity of row electrodes X and Y within each discharge cell PC is erased by the second reset discharge initiated in the rear half portion of the reset process R, and all the discharge cells PC are initialized in a quenched mode. Furthermore, in response to the application of the reset pulse RP, weak discharges are also initiated between the row electrodes Y and column electrodes D within all the discharge cells PC, and the wall charge of positive polarity that has been formed in the vicinity of column electrodes D is partially erased by these discharges and adjusted to a value that is capable of initiating correctly the selective write address discharge in the selective write address process $W_W$. The pulse voltage of the reset pulse RP is set lower than the pulse voltage of the sustain pulse IP. Further, the voltage applied between the row electrodes X and Y within each discharge cell by the reset pulse RP and base pulse $BP^+$ is lower than the voltage applied between the row electrodes X and Y by the application of the sustain pulse IP. Therefore, the reset discharge initiated in response to the application of the reset pulse RP and base pulse $BP^+$ is weaker than the sustain discharge initiated by the application of the sustain pulse IP.

Thus, in the front half portion of the reset process R, a comparatively weak first reset discharge that has to form the charged particles is initiated. As a result, by employing the drive shown in FIG. 20, it is possible to replenish the charged particles, while improving the dark contrast with respect to the case in which a strong reset discharge that has to form a large number of charged particles is initiated.

When the PDP 50 is driven in a form, such as shown in FIG. 20, for each field (or frame), the PDP 50 may be driven in a form, such as shown in FIG. 9, at a ratio of one drive per a plurality of fields. Further, the PDP 50 may be also driven in a form, such as shown in FIG. 20, at a ratio of one drive per a plurality of fields, while driving the PDP 50 in a form, such as shown in FIG. 9, for each field (or frame).

Figure 21:
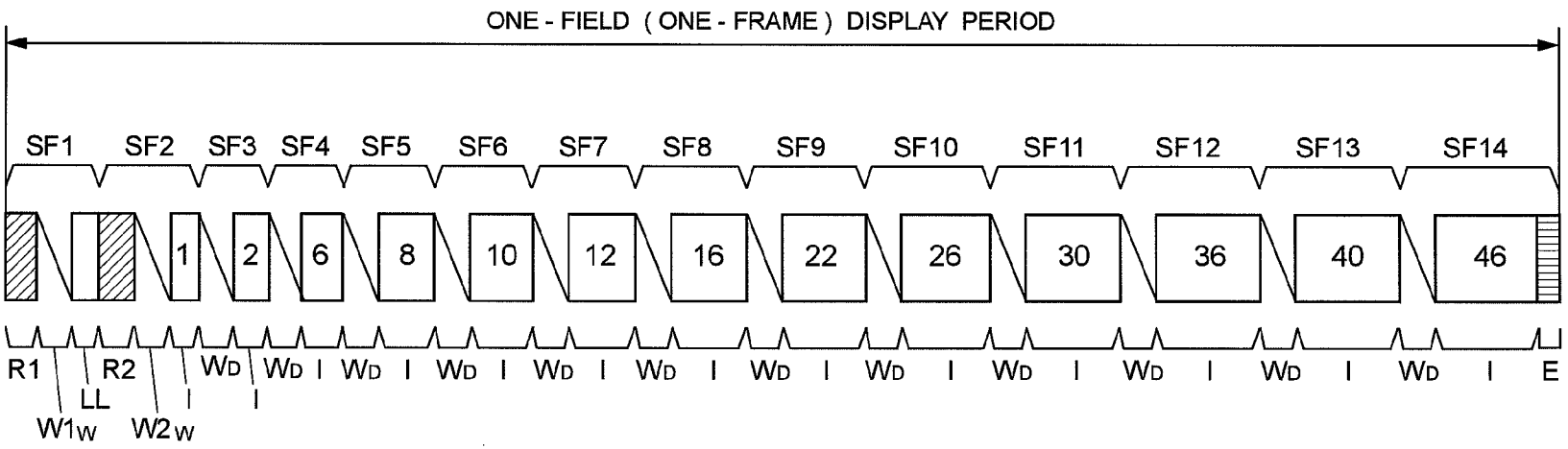
FIG. 21 shows another example of an emission drive sequence employed in the plasma display device shown in FIG.

Further, in the above-described embodiment, the light emission drive sequence shown in FIG. 8 is employed for driving the PDP 50, but the PDP 50 may be also driven according to the light emission drive sequence, such as shown in FIG. 21, instead of that shown in FIG. 8.

In this case, the pixel drive data generation circuit 2 performs a multigradation processing composed of the above-described error diffusion processing and dither processing with respect to the pixel data PD in which the brightness level of each pixel supplied from the A/D converter 1 is represented in 8 bits. With such multigradation processing, each pixel data PD is converted into 4-bit multigradation pixel data PDs shown in FIG. 22 in which all the brightness levels are represented in 16 stages (first to sixteenth gradations). Further, the pixel drive data generation circuit 2 then converts the multigradation pixel data PDs into the 14-bit pixel drive data GD according to a data conversion table, such as shown in FIG. 22, and supplies the data obtained to the forced lighting processing circuit 3.

The forced lighting processing circuit 3 has a configuration shown in FIG. 10, performs the forced lighting processing (shown in FIG. 11 to FIG. 19), such as described hereinabove, with respect to the pixel drive data GD of each pixel and supplies the obtained pixel drive data GGD to the memory 4. The pixel drive data GGD also have a data pattern (14 bit) identical to the data pattern for each gradation based on the 14-bit pixel drive data GD, such as shown in FIG. 22.

The memory 4 sequentially writes the pixel drive data GGD and performs the below-described read operation each time the writing of the pixel drive data $GGD_{(1,1)}$ to $GGD_{(n,m)}$ corresponding to each pixel of one screen, that is, the first row by the first column to the n-th row by the m-th column is completed. First, the memory 4 takes the first bit of each pixel drive data $GGD_{(1,1)}$ to $GGD_{(n,m)}$ as pixel drive data bits $DB_{(1,1)}$ to $DB_{(n,m)}$, reads them for each one display line in the subfield SF1 shown in FIG. 21, and supplies them to the address driver 55. Then, the memory 4, takes the second bit of each pixel drive data $GGD_{(1,1)}$ to $GGD_{(n,m)}$ as the pixel drive data bit $DB_{(1,1)}$ to $DB_{(n,m)}$, reads them for each one display line in the subfield SF2 shown in FIG. 21, and supplies them to the address driver 55. Then, the memory 4 reads the bits of each pixel drive data $GGD_{(1,1)}$ to $GGD_{(n,m)}$ separately by rows of the same bits and supplies each of them as pixel drive data bits $DB_{(1,1)}$ to $DB_{(n,m)}$ to the address driver 55 in the subfield corresponding to the bit row.

During this time, the drive control circuit 56 supplies the control signals that have to drive the PDP 50 according to the light emission drive sequence as shown in FIG. 21, to panel drivers including the X electrode driver 51, Y electrode driver 53, and address driver 55. Thus, in the leading subfield SF1 within a one-field (one-frame) display period, such as shown in FIG. 21, the drive control circuit 56 supplies to the panel drivers the control signals that have to realize sequentially the driving according to each of the first reset process R1, first selective write address process $W1_W$, and a very small or minute light emission process LL. Further, in the subfield SF2 that follows the subfield SF1, the control signals that have to realize sequentially the driving according to each of the second reset process R2, second selective write address process $W2_W$, and sustain process I are supplied to the panel drivers. In the subfields SF3 to SF14, the control signals that have to realize sequentially the driving according to each of the selective erase address process $W_D$ and sustain process I. Only in the very last subfield SF14 within the one-field display period, after the sustain process I has been executed, the drive control circuit 56 supplies the control signals that have to realize sequentially the driving according to the erase process E to the panel drivers.

Figure 23:
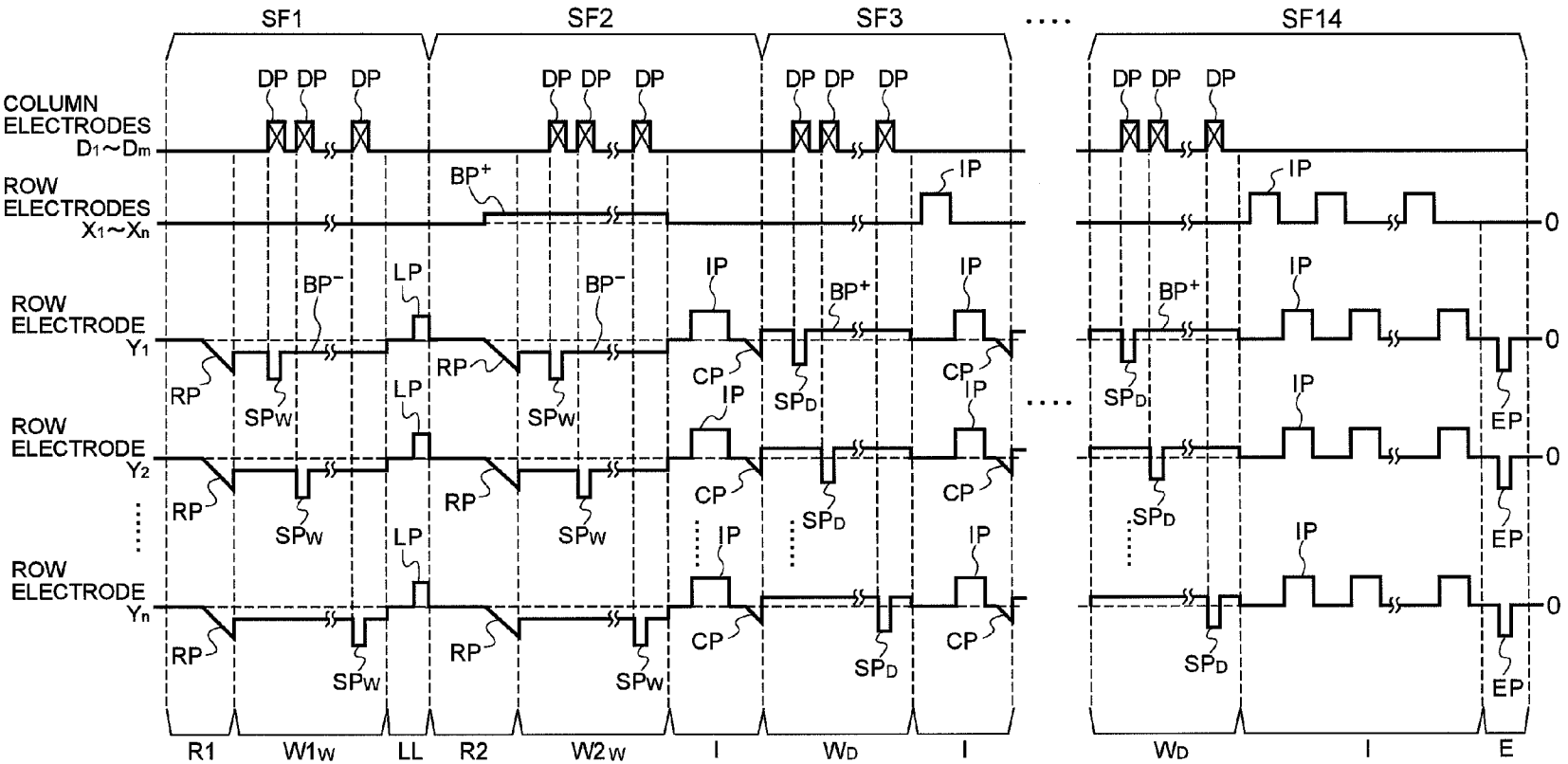
FIG. 23 shows an example of drive pulses applied to the PDP 50 according to the emission drive sequence shown in FIG. 21.

The panel drivers (X electrode driver 51, Y electrode driver 53, and address driver 55) supply the drive pulses such as shown in FIG. 23 to the column electrodes D and row electrodes X and Y of the PDP 50 in response to the control signals that are supplied from the drive control circuit 56.

In FIG. 23, only the operation of the subfields SF1 to SF3 and the very last subfield SF14, from among the subfields SF1 to SF14 shown in FIG. 21, is shown in respective frames.

In the first reset process R1 of the subfield SF1, the address driver 55 sets the column electrodes $D_1$ to $D_m$ to a ground potential (0 V). The Y electrode driver 53 generates a reset pulse RP of negative polarity which has a waveform in which the electric potential at the front edge decreases gradually with the passage of time and applies this reset pulse to all the row electrodes $Y_1$ to $Y_n$. The negative peak potential in the reset pulse RP is set to a potential that is higher than the peak potential of the write scanning pulse $SP_W$ of negative polarity that is described hereinbelow, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge that has been formed in the vicinity of column electrodes D is largely erased, and the address discharge in the first selective write address process $W1_W$ becomes unstable. During this time, the X electrode driver 51 sets all the row electrodes $X_1$ to $X_n$ to the ground potential (0 V). In response to the application of the reset pulse RP, a reset discharge is initiated between the row electrodes X and Y within all the discharge cells PC. By this reset discharge, the wall charge that remained in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP. Accordingly, part of the wall charge of positive polarity that has been formed in the vicinity of column electrodes D is erased by this very weak discharge, and the wall charge is adjusted to a value capable of initiating the selective write address discharge correctly in the below-described first selective write address process $W1_W$. The pulse voltage of the reset pulse RP is set lower than the pulse voltage of the sustain pulse IP. Further, the voltage applied between the row electrodes X and Y within each discharge cell by the reset pulse RP is lower than the voltage applied between the row electrodes X and Y by the application of the sustain pulse IP. Therefore, the reset discharge initiated in response to the application of the reset pulse RP is weaker than the sustain discharge initiated by the application of the sustain pulse IP.

Further, in the first selective write address process $W1_W$ of the subfield SF1, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 23, to the row electrodes $Y_1$ to $Y_n$ at the same time. During this time, the address driver 55, first, converts the pixel drive data bit corresponding to the subfield SF1 into the pixel data pulse DP having a pulse voltage corresponding to the logical level of the pixel drive data bit. For example, when a pixel drive data bit with a logical level 1 that has to set the discharge cell PC to a lighting mode is supplied, the address driver 55 converts the pixel drive data bit into a pixel data pulse DP having a peak potential of positive polarity. On the other hand, with respect to a pixel drive data bit with a logical level 0 that has to set the discharge cell PC to a quenching mode, the address driver converts the pixel drive data bit into a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrodes D and row electrodes Y within the discharge cell PC having applied thereto a high-voltage pixel data pulse DP that has to set the discharge cell to a lighting mode, simultaneously with the write scanning pulse $SP_W$. During this time, a voltage corresponding to the write scanning pulse $SP_W$ is also applied between the row electrodes X and Y, but at this stage, all the discharge cells PC are in the quenching mode, that is, in a state in which the wall charge is erased. Therefore, a discharge is not generated between the row electrodes X and Y by the application of this write scanning pulse $SP_W$. Accordingly, in the first selective write address process $W1_W$ of the subfield SF1, a selective write address discharge is initiated only between the column electrode D and row electrode Y within the discharge cell PC in response to the application of the write scanning pulse $SP_W$ and high-voltage pixel data pulse DP. As a result, although a wall charge is present in the vicinity of row electrode X within the discharge cell PC, the cell is set to a lighting mode state in which a wall charge of positive polarity is formed in the vicinity of row electrode Y and a wall charge of negative polarity is formed in the vicinity of column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse $SP_W$. Thus, in the discharge cell PC, the state of a quenching mode that has been initialized in the first reset process R1, that is, a state in which no discharge is generated between the row electrode Y and column electrode D and also between the row electrodes X and Y, is maintained.

Further, in the minute light emission process LL of the subfield SF1, the Y electrode driver 53 simultaneously applies the very small or minute light emission pulses LP having a predetermined peak potential of positive polarity, such as shown in FIG. 23, to the row electrodes $Y_1$ to $Y_n$. In response to the application of this minute light emission pulse LP, a discharge (referred to hereinbelow as "minute light emission discharge") is initiated between the column electrode D and row electrode Y within the discharge cell PC that has been set to the lighting mode. In other words, in the minute light emission process LL, although a discharge is initiated between the row electrode Y and column electrode D within the discharge cell PC, an electric potential that does not initiate the discharge between the row electrodes X and Y is applied to the row electrode Y, whereby the minute light emission discharge is initiated only between the column electrode D and row electrode Y within the discharge cell PC that has been set to the lighting mode. In this case, the peak potential of the minute light emission pulse LP is lower than the peak potential of the sustain pulse IP applied in the sustain process I following the below-described subfield SF2 and is equal, for example, to the base potential that is applied to the row electrode Y in the below-described selective erase address process $W_D$. Further, as shown in FIG. 23, the variation ratio with the passage of time in the rise segment of the potential in the minute light emission pulse LP is higher than the variation ratio in the fall segment in the reset pulse RP. In other words, by making the transition of electric potential in the front edge portion of the minute light emission pulse LP steeper than the transition of electric potential in the front edge portion of the reset pulse, a discharge is initiated that is stronger than the reset discharge initiated in the first reset process R1 and second reset process R2. Here, this discharge is a column-side cathode discharge such as described hereinabove and also a discharge initiated by the minute light emission pulse LP that has a pulse voltage lower than the sustain pulse IP. Therefore, the emission brightness following this discharge is lower than that following the sustain discharge (described hereinbelow) initiated between the row electrodes X and Y. Thus, in the minute light emission process LL, a discharge initiated as a minute light emission discharge is a discharge that is followed by light emission with a brightness level higher than that of the reset discharge, but is a discharge with a brightness level following the discharge that is lower than that of the sustain discharge, that is, a discharge that is followed by a minute light emission such that can be used for display. In this case, in the first selective address process $W1_W$ that is implemented immediately before the minute light emission process LL, a selective write address discharge is initiated between the column electrode D and row electrode Y in the discharge cell PC. Therefore, in the subfield SF1, a brightness corresponding to a gradation with a brightness that is higher by one stage than the brightness level 0 is represented by the light emission following the selective write address discharge and the light emission following this minute light emission discharge.

After the minute light emission discharge, a wall charge of negative polarity is formed in the vicinity of the row electrode Y, and a wall charge of positive polarity is formed in the vicinity of the column electrode D.

Further, in the second reset process R2 of the subfield SF2, the address driver 55 sets the column electrodes $D_1$ to $D_m$ to a ground potential (0 V). During this time, the Y electrode driver 53 applies a reset pulse RP of negative polarity in which the transition of electric potential at the front edge with the passage of time is gradual to the row electrodes $Y_1$ to $Y_n$. Further, during this time, the X electrode driver 51 applies a base pulse $BP^+$ having a predetermined base potential of positive polarity to each of the row electrodes $X_1$ to $X_n$. In this case, reset discharges are initiated between the row electrodes X and Y within all the discharge cells PC in response to the application of these reset pulse RP of negative polarity and base pulse $BP^+$ of positive polarity. The negative peak potential in the reset pulse RP is set to a potential that is higher than the peak potential of the write scanning pulse $SP_W$ of negative polarity, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the second selective write address process $W2_W$ becomes unstable. By the reset discharge initiated in the second reset process R2, the wall charge protective layer includes has been formed in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP, part of the wall charge of positive polarity that has been formed in the vicinity of column electrodes D is erased by this very weak discharge, and the wall charge is adjusted to a value capable of initiating the selective write address discharge correctly in the second selective write address process $W2_W$. The pulse voltage of the reset pulse RP is set lower than the pulse voltage of the sustain pulse IP. Further, the voltage applied between the row electrodes X and Y within each discharge cell by the reset pulse RP and base pulse $BP^+$ is lower than the voltage applied between the row electrodes X and Y by the application of the below-described sustain pulse IP. Therefore, the reset discharge initiated in response to the application of the reset pulse RP and base pulse $BP^+$ is weaker than the sustain discharge initiated by the application of the sustain pulse IP.

Then, in the second selective write address process $W2_W$ of the subfield SF2, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 23, to the row electrodes $Y_1$ to $Y_n$ at the same time. In the second selective write address process $W2_W$, the X electrode driver 51 continues the application of the base pulse $BP^+$ that has been applied to the row electrodes $X_1$ to $X_n$ in the second reset process R2. The base pulse BP and base pulse $BP^+$ are set to a potential such that the voltage between the row electrodes X and Y within the period in which the write scanning pulse $SP_W$ is not applied is lower than the discharge start voltage of the discharge cell PC. Further, in the second selective write address process $W2_W$, the address driver 55, first, converts the pixel drive data bit corresponding to the subfield SF2 into the pixel data pulse DP having a pulse voltage corresponding to the logical level of the pixel drive data bit. For example, when a pixel drive data bit with a logical level 1 that has to set the discharge cell PC to a lighting mode is supplied, the address driver 55 converts the pixel drive data bit into a pixel data pulse DP having a peak potential of positive polarity. On the other hand, with respect to a pixel drive data bit with a logical level 0 that has to set the discharge cell PC to a quenching mode, the address driver performs a conversion into a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrode D and row electrode Y within the discharge cell PC having applied thereto a high-voltage pixel data pulse DP that has to set the discharge cell to a lighting mode, simultaneously with the write scanning pulse $SP_W$. Furthermore, a very weak discharge is also initiated between the row electrodes X and Y within the discharge cell PC immediately after this selective write address discharge. In other words, a voltage corresponding to the base pulse $BP^-$ and base pulse $BP^+$ is applied between the row electrodes X and Y after the write scanning pulse $SP_W$ has been applied, but because this voltage is set lower than the discharge start voltage of each discharge cell PC, no discharge is generated within the discharge cell PC by the application of this voltage. However, where the selective write address discharge is initiated, a discharge is initiated between the row electrodes X and Y by the application of a voltage induced by the selective write address discharge and based on the base pulse $BP^-$ and base pulse $BP^+$. This discharge is not initiated in the first selective write address process $W1_W$ in which the base pulse $BP^+$ is not applied to the row electrode X. By this discharge and also the above-described selective write address discharge, the discharge cell PC is set into a state in which a wall charge of positive polarity is formed in the vicinity of row electrode Y, a wall charge of negative polarity is formed in the vicinity of row electrode X, and a wall charge of negative polarity is formed in the vicinity of column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse $SP_W$, and therefore no discharge is generated between the row electrodes X and Y. Thus, in the discharge cell PC, the immediately preceding state, that is, the state of a quenching mode that has been initialized in the second reset process R2, is maintained.

Further, in the sustain process I of the subfield SF2, the Y electrode driver 53 generates, pulse by pulse, the sustain pulses IP having a peak potential of positive polarity and applies these pulses simultaneously to the row electrodes $Y_1$ to $Y_n$. During this time, the X electrode driver 51 sets the row electrode $X_1$ to $X_n$ to a state with the ground potential (O V), and the address driver 55 sets the column electrodes $D_1$ to $D_m$ to the ground potential (0 V). In response to the application of this sustain pulse IP, a sustain discharge is initiated between the row electrodes X and Y within the discharge cell PC that has been set, as described hereinabove, into a lighting mode. The light emitted from the fluorescent layer 17, following this sustain discharge, is irradiated to the outside via the front transparent substrate 10, whereby one display emission corresponding to the brightness weight of the subfield SF2 is performed. Further, in response to the application of this sustain pulse IP, a discharge is also initiated between the row electrode Y and column electrode D within the discharge cell PC that has been set into a lighting mode. By this discharge and also the above-described sustain discharge, a wall charge of negative polarity is formed in the vicinity of the row electrode Y within the discharge cell PC, and a wall charge of positive polarity is formed in the vicinity of row electrode X and column electrode D. Further, after the sustain pulse IP has been applied, the Y electrode driver 53 applies to the row electrodes $Y_1$ to $Y_n$ a wall charge adjustment pulse CP that has a peak potential of negative polarity with a gradual transition of electric potential at a front edge with the passage of time, as shown in FIG. 23. In response to the application of this wall charge adjustment pulse CP, a very weak erase discharge is initiated in the discharge cell PC in which the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next selective erase address process $W_D$.

Further, in the selective erase address process $W_0$ of subfields SF3 to SF14, the Y electrode driver 53 successively and alternatively applies the erase scanning pulse $SP_D$ having a peak potential of negative polarity such as shown in FIG. 23 to the row electrodes $Y_1$ to $Y_n$, while applying the base pulse $BP^+$ having a predetermined base potential of positive polarity to each row electrode $Y_1$ to $Y_n$. Further, the peak potential of the base pulse $BP^+$ is set such that can prevent an erroneous discharge between the row electrodes X and Y within the execution period of this selective erase address process $W_0$. Further, within the execution period of this selective erase address process $W_0$, the X electrode driver 51 sets the row electrodes $X_1$ to $X_n$ to a ground potential (0 V). In the selective erase address process $W_D$, the address driver 55, first, converts the pixel drive data bit corresponding to the subfield SF to the pixel data pulse DP having a pulse voltage corresponding to the logical level thereof. For example, when a pixel drive data bit with a logical level 1 that has to cause a transition of the discharge cell PC from the lighting mode into the quenching mode is applied, the address driver 55 converts this bit into a pixel data pulse DP having a peak potential of positive polarity. On the other hand, when a pixel drive data bit with a logical level 0 that has to maintain the present state of the discharge cell PC is applied, the address driver converts this bit into a pixel data pulse DP of a low voltage (0 V). Further, the address driver 55 applies the pixel data pulse DP, by one display line (m lines), to the column electrodes $D_1$ to $D_m$ synchronously with the application timing of the erase scanning pulse $SP_D$. In this case, a selective erase address discharge is initiated between the column electrodes D and row electrodes Y within the discharge cell PC having applied thereto a high-voltage pixel data pulse DP, simultaneously with the erase scanning pulse $SP_D$. By such selective erase address discharge, the discharge cell PC is set into a state in which a wall charge of positive polarity is formed in the vicinity of each row electrode Y and X and a wall charge of negative polarity is formed in the vicinity of column electrodes D, that is, to a quenching mode. On the other hand, the above-described selective erase address discharge is not initiated between the column electrode D and row electrode Y within the discharge cell PC having applied thereto a pixel data pulse DP of a low voltage (0 V), simultaneously with the erase scanning pulse $SP_D$. Therefore, in the discharge cell PC, the immediately preceding state (lighting mode, quenching mode), is maintained.

Further, in the sustain process I of each subfield SF3 to SF14, the X electrode driver 51 and Y electrode driver 53 apply the sustain pulse IP having a peak potential of positive polarity to the row electrodes $X_1$ to $X_n$ and $Y_1$ to $Y_n$ alternately for the row electrodes X and Y and repeatedly, the number of application cycles (even number) corresponding to the brightness weight of the subfield, as shown in FIG. 23. Each time the sustain pulse IP is applied, a sustain discharge is initiated between the row electrodes X and Y within the discharge cell PC that has been set into a lighting mode. The light emitted from the fluorescent layer 17, following this sustain discharge, is irradiated to the outside via the front transparent substrate 10, whereby the display emission is performed, the number of cycles thereof corresponding to the brightness weight of the subfield SF. In this case, a wall charge of negative polarity is formed in the vicinity of the row electrode Y and a wall charge of positive polarity is formed in the vicinity of row electrode X and column electrode D within the discharge cell PC in which the sustain discharge has been initiated in response to the sustain pulse IP that is applied at the very end in the sustain process I of each subfield SF2 to SF14. Further, after this final sustain pulse IP has been applied, the Y electrode driver 53 applies to the row electrodes $Y_1$ to $Y_n$ wall charge adjustment pulse CP that has a peak potential of negative polarity with a gradual transition of electric potential at a front edge with the passage of time, as shown in FIG. 23. In response to the application of this wall charge adjustment pulse CP, a very weak erase discharge is initiated in the discharge cell PC in which the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next selective erase address process $W_D$.

Upon completion of the sustain process I of the very last subfield SF14, the Y electrode driver 53 applies an erase pulse EP having a peak potential of negative polarity to the row electrodes $Y_1$ to $Y_n$. In response to the application of this erase pulse EP, an erase discharge is initiated only the discharge cell PC that is in the lighting mode state. Under the effect of this erase discharge, the discharge cell PC that is in the lighting mode state makes a transition to the quenching mode state.

The above-described drive is executed based on the 16 pixel drive data GGD such as shown in FIG. 22.

First, at the second gradation representing a brightness that is one stage higher than the first gradation that represents the black display (brightness level 0), a selective write address discharge for setting the discharge cell PC into a lighting mode is initiated only in the SF1 from among the subfields SF1 to SF14, and a minute light emission discharge is induced in the discharge cell PC that has been set into the lighting mode (shown by an empty square). In this case, the brightness level during the emission following these selective write address discharge and minute light emission discharge is lower than the brightness level during the emission following one sustain discharge. Therefore, when the brightness level that can be observed due to the sustain discharge is taken as "1", in the second gradation, the brightness correspond to the brightness level "α" that is lower than the brightness level "1" is represented.

At the third gradation representing a brightness that is one stage higher than that of the second gradation, a selective write address discharge for setting the discharge cell PC into a lighting mode is initiated only in the SF2 from among the subfields SF1 to SF14 (shown by a double circle), and a selective erase address discharge for causing the transition of the discharge cell PC to the quenching mode is initiated in the next subfield SF3 (shown by a black circle). Therefore, in the third gradation, light emission following one sustain discharge is performed only in the sustain process I of the SF2 from among the subfields SF1 to SF14, and a brightness corresponding to the brightness level "1" is represented.

At the fourth gradation representing a brightness that is one stage higher than that of the third gradation, first, a selective write address discharge for setting the discharge cell PC into a lighting mode is initiated in the subfield SF1, and a minute light emission discharge is induced in the discharge cell PC that has been set into the lighting mode (shown by an empty square). Furthermore, in the fourth gradation, a selective write address discharge for setting the discharge cell PC into a lighting mode is initiated only in the SF2 from among the subfields SF1 to SF14 (shown by a double circle), and a selective erase address discharge for causing the transition of the discharge cell PC to the quenching mode is initiated in the next subfield SF3 (shown by a black circle). Therefore, in the fourth gradation, light emission with the brightness level "α" is performed in the subfield SF1, and the sustain discharge followed by the light emission with the brightness level "1" is performed once in the SF2. Therefore, a brightness corresponding to the brightness level "α"+"1" is represented.

At each of the fifth to sixteenth gradations, a selective write address discharge for setting the discharge cell PC into a lighting mode is initiated in the subfield SF1, and a minute light emission discharge is induced in the discharge cell PC that has been set into the lighting mode (shown by an empty square). Then, a selective erase address discharge for causing the transition of the discharge cell PC to the quenching mode is initiated only in one subfield corresponding to this gradation (shown by a black circle). Therefore, at each of the fifth to sixteenth gradations, the minute light emission discharge is initiated in the subfield SF1, one sustain discharge is initiated in the SF2, and then sustain discharges are initiated in each of the sequential subfields (shown by an empty circle), the number thereof corresponding to the gradation, at a number of cycles allocated to the subfield. As a result, at each of the fifth to sixteenth gradations, a brightness is viewed that corresponds to a sum total of the brightness level "α"+"a total number of sustain discharges initiated within one-field (or one-frame) display period".

Thus, with the first to sixteenth gradation drives such as shown in FIG. 22, a brightness range with a brightness level of "0" to "255+α" can be represented by 16 stages such as shown in FIG. 22.

With the drive shown in FIG. 22, at the fourth gradation and each gradation thereafter, a minute light emission discharge followed by light emission with a brightness level α is initiated in the subfield SF1, but it is also possible not to induce the minute light emission discharge at the third gradation and each gradation thereafter. The reason therefor is that because the light emission following the minute light emission discharge has a very low brightness (brightness level α), at the fourth gradation and each gradation thereafter at which the minute light emission discharge is used together with the sustain discharge followed by light emission with a higher brightness, the increase in brightness resulting from the brightness level α is often impossible to see and the initiation of the minute light emission discharge becomes meaningless.

Accordingly, in the plasma display device shown in FIG. 1, the initialization of all the discharge cells PC is completed by a reset discharge that is weaker than the sustain discharge in each of the reset processes (R1, R2) shown in FIG. 23 by using the action of the CL emitting MgO formed inside the discharge cells PC. In other words, in the conventional reset process that has to release a comparatively large number of charged particles within the discharge space, a discharge stronger than the sustain discharge is initiated as a reset discharge by applying a reset pulse of a voltage higher than the sustain pulse. Thus, by so releasing a large number of charged particles within the discharge space at the initialization stage, it is possible to stabilize the write address discharge in the address process. However, in the discharge cell in which CL emitting MgO has been formed, as in the present embodiment, the write address discharge in the address process is stabilized better than in the discharge cell in which no LC emitting MgO has been formed, regardless of the number of charged particles released by the reset discharge. Accordingly, in the reset processes (R1, R2), the increase in dark contrast can be ensured by omitting a strong reset discharge that can release a comparatively large number of charged particles within the discharge space, that is, a reset discharge that is stronger than the sustain discharge.

However, where the black display state is maintained, the write address discharge failure caused by the deficit of charged particles still sometimes occurs in the address processes ($W1_W$, $W2_W$) even if the write address discharge has been stabilized by the action of the CL emitting MgO.

Figure 19:
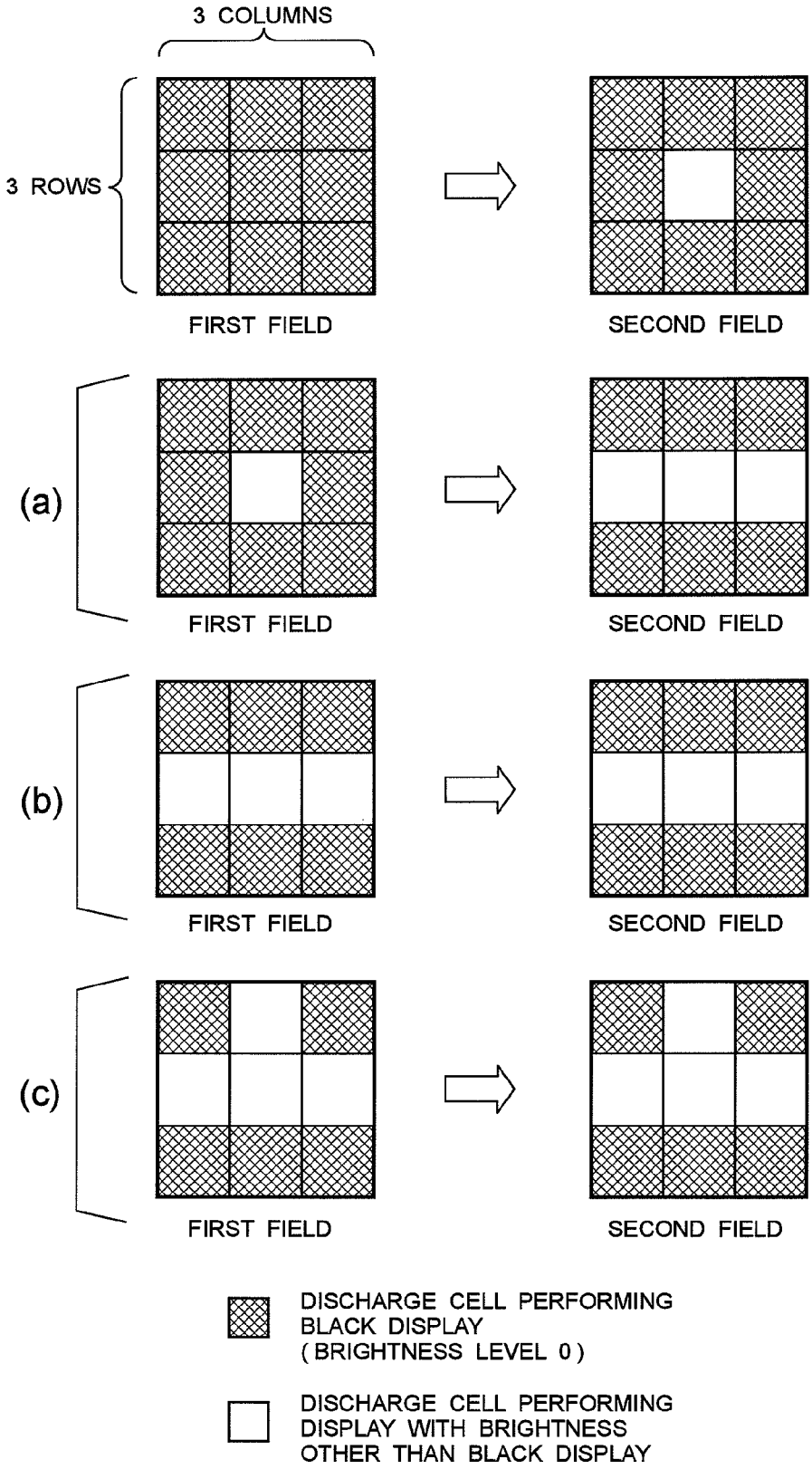
FIG. 19 shows an example of the drive form of the discharge cell performed by the forced lighting drive by the first forced lighting processing unit 35 and the second forced lighting processing unit 33.

Accordingly, the adjacent discharge cell that is timely and/or spatially adjacent to the discharge cell for which the deficit of charged particles is predicted is forcibly driven at a gradation other than the black display, for example, at a second gradation such as shown in FIG. 22, by the operation of the forced lighting processing circuit 3. Thus, in the case of a display state such as shown in FIG. 13, even if the discharge cell that is adjacent to the lighting transition cell (central discharge cell) cell for which the deficit of charged particles is predicted is to be originally driven at a first gradation of black display, this cell is forcibly driven at a second gradation, such as shown in FIG. 22 (FIG. 17 to FIG. 19). With such process, a very weak light emitting discharge is initiated in the adjacent cells that are timely and/or spatially adjacent to the lighting transition cell, and the replenishment of charged particles in the lighting transition cells is performed by the very weak light emission discharge. As a result, the deficit of charged particles is eliminated and the write address discharge of the discharge cell is stabilized.

Therefore, even when the drive such as shown in FIG. 21 to FIG. 23 is employed, it is possible to prevent the deficit of charged particles, that is, a write address discharge failure that is apprehended to occur when the state of each discharge cell within a 3×3 block makes a transition, such as shown in FIG. 13, between two consecutive fields.

With the drive shown in FIG. 23, the reset discharge is initiated by applying the reset pulse RP once in each of the first reset process R1 and second reset process R2, but it is also possible to initiate the reset discharge for forming charged particles immediately therebefore.

Figure 24:
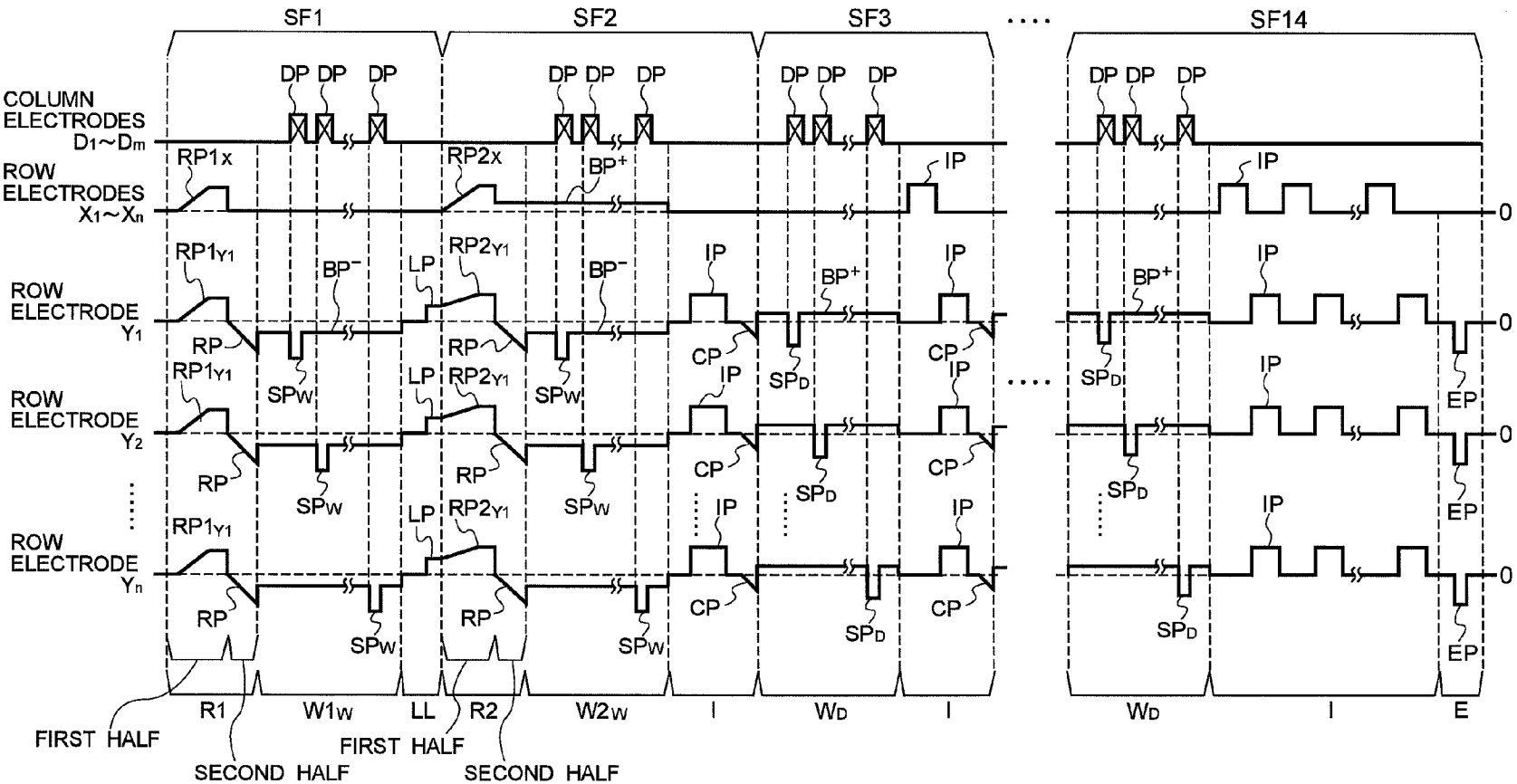
FIG. 24 shows another example of drive pulses applied to the PDP 50 according to the emission drive sequence shown in FIG. 21.

FIG. 24 illustrates an application example of another drive pulse performed with consideration for the above-described issue.

Referring to FIG. 24, the drive pulses that are applied in other processes, except the first reset process R1 of SF1 and the second reset process R2 of SF2, and application timing thereof, are identical to those shown in FIG. 23 and the explanation thereof is herein omitted.

In the first reset process R1 shown in FIG. 24, first, in the front half portion thereof, the Y electrode driver 53 applies a reset pulse $RP\mathbf{1}_{Y1}$ of positive polarity that has a waveform in which the transition of electric potential at the front edge portion with the passage of time is more gradual than that in the sustain pulse IP to all the row electrodes $Y_1$ to $Y_n$. The peak potential of the reset pulse $RP\mathbf{1}_{Y1}$ is lower than the peak potential of the sustain pulse IP. During this time, the address driver 55 sets the column electrodes $D_1$ to $D_m$ to a ground potential (0 V). In response to the application of the reset pulse $RP_{Y1}$, the first reset discharge is initiated between the row electrodes Y and column electrodes D within each of all the discharge cells PC. Thus, in the front half portion of the first reset process R1, by applying a voltage between the electrodes such that the row electrodes Y become anodes and the column electrodes D become cathodes, a column-side cathode discharge in which the electric current flows from the row electrodes Y toward the column electrodes D is initiated as the first reset discharge. In response to this first reset discharge, charged particles are formed in the discharge spaces within all the discharge cells PC. Further, after completion of such first reset discharge, a wall charge of negative polarity is formed in the vicinity of row electrodes Y within all the discharge cells PC, and a wall charge of positive polarity is formed in the vicinity of column electrodes D. Further, in the front half portion of the first reset process R1, the X electrode driver 51 applies to each of all the row electrodes $X_1$ to $X_n$ the reset pulses $RP\mathbf{1}_x$ that have the same polarity as the reset pulse $RP\mathbf{1}_{Y1}$ and have a peak potential that can prevent the surface discharge between the row electrodes X and Y that follows the application of the reset pulse $RP\mathbf{1}_{Y1}$. Then, in the rear half portion of the first reset process R1, the Y electrode driver 53 generates a reset pulse RP of negative polarity with a smooth transition of electric potential with the passage of time at the front edge and applies this reset pulse to all the row electrodes $Y_1$ to $Y_n$. In this case, in response to the application of the reset pulse RP of negative polarity, a second reset discharge is initiated between the row electrodes X and Y within all the discharge cells PC. With consideration for the wall charge formed in the vicinity of each row electrode X and Y in response to the first reset discharge, the peak potential of the reset pulse RP is the lowest electric potential that can reliably initiate the second reset discharge between the row electrodes X and Y. The negative peak potential in the reset pulse RP is set to a potential that is higher than the peak potential of the write scanning pulse $SP_W$ of negative polarity, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge that has been formed in the vicinity of column electrodes D is largely erased, and the address discharge in the first selective write address process $W\mathbf{1}_W$ becomes unstable. By the second reset discharge initiated in the rear half of the first reset process R1, the wall charge that has been formed in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP. Accordingly, part of the wall charge of positive polarity that has been formed in the vicinity of column electrodes D is erased by this very weak discharge, and the wall charge is adjusted to a value capable of initiating the selective write address discharge correctly in the first selective write address process $W\mathbf{1}_W$. The pulse voltage of the reset pulse RP is set lower than the pulse voltage of the sustain pulse IP. Further, the voltage applied between the row electrodes X and Y within each discharge cell by the reset pulse RP is lower than the voltage applied between the row electrodes X and Y by the application of the sustain pulse IP. Therefore, the reset discharge initiated in response to the application of the reset pulse RP is weaker than the sustain discharge initiated by the application of the sustain pulse IP.

Thus, in the front half portion of the first reset process R1, a comparatively weak first reset discharge that has to form the charged particles is initiated. As a result, the dark contrast can be increased with respect to that in the case in which a strong reset discharge is initiated.

In the front half portion of the second reset process R2 shown in FIG. 24, the Y electrode driver 53 applies a reset pulse $R\mathbf{2}P_{Y1}$ of positive polarity that has a waveform in which the transition of electric potential at the front edge portion with the passage of time is more gradual than that in the sustain pulse IP to all the row electrodes $Y_1$ to $Y_n$. The peak potential of the reset pulse $RP\mathbf{2}_{Y1}$ is lower than the peak potential of the sustain pulse IP. During this time, the address driver 55 sets the column electrodes $D_1$ to $D_m$ to a ground potential (0 V). Further, during this time, the X electrode driver 51 applies to each of all the row electrodes $X_1$ to $X_n$ the reset pulses $RP\mathbf{2}_x$ that have a peak potential that can prevent the surface discharge between the row electrodes X and Y that follows the application of the reset pulse $RP\mathbf{2}_{Y1}$. Where no surface discharge occurs between the row electrodes X and Y, the X electrode driver 51 may set all the row electrodes $X_1$ to $X_n$ to the ground potential (0 V), instead of applying the reset pulses $RP\mathbf{2}_x$. In response to the application of the reset pulse $RP\mathbf{2}_{Y1}$, the first reset discharge that is weaker than the column-side cathode discharge in the minute light emission process LL is initiated between the row electrode Y and column electrode D within a discharge cell PC in which the column-side cathode discharge has not been initiated in the minute light emission process LL within each discharge cell PC.

Thus, in the front half portion of the second reset process R2, by applying a voltage between the electrodes such that the row electrodes Y become anodes and the column electrodes D become cathodes, a column-side cathode discharge in which the electric current flows from the row electrodes Y toward the column electrodes D is initiated as the first reset discharge. On the other hand, within the discharge cell PC in which the minute light emission discharge has already been initiated in the minute light emission process LL, no discharge is initiated even when the application of the reset pulse $RP2_{Y1}$ is performed. Therefore, a state is assumed in which a wall charge of negative polarity is formed in the vicinity of row electrodes Y and a wall charge of positive polarity is formed in the vicinity of column electrodes D within all the discharge cells PC immediately after the front half portion of the second reset process R2 is completed.

In the rear half portion of the second reset process R2, the Y electrode driver 53 applies a reset pulse RP of negative polarity with a smooth transition of electric potential with the passage of time at the front edge to the row electrodes $Y_1$ to $Y_n$. Further, in the rear half portion of the second reset process R2, the X electrode driver 51 applies a base pulse $BP^+$ having a predetermined base potential of positive polarity to each row electrode $X_1$ to $X_n$. In this case, a second reset discharge is initiated between the row electrodes X and Y within all the discharge cells PC in response to the application of these reset pulse RP of negative polarity and base pulse $BP^+$ of positive polarity. With consideration for the wall charge formed in the vicinity of row electrodes X and Y in response to the above-described first reset discharge, the peak potentials of the reset pulse RP and base pulse $BP^+$ are the lowest electric potentials capable of reliably initiating the second reset discharge between the row electrodes X and Y. Further, the negative peak potential in the reset pulse RP is set to a potential higher than the peak potential of the write scanning pulse $SP_W$ of negative polarity, that is, to a potential close to 0 V. Thus, where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the second selective write address process $W2_W$ becomes unstable. Here, the wall charge formed in the vicinity of row electrodes X and Y within each discharge cell PC is erased by the second reset discharge initiated in the rear half portion of the second reset process R2, and all the discharge cells PC are initialized in a quenched mode. Furthermore, in response to the application of the reset pulse RP, weak discharges are also initiated between the row electrodes Y and column electrodes D within all the discharge cells PC, and the wall charge of positive polarity that has been formed in the vicinity of column electrodes D is partially erased by these discharges and adjusted to a value that is capable of initiating correctly the selective write address discharge in the second selective write address process $W2_W$. The pulse voltage of the reset pulse RP is set lower than the pulse voltage of the sustain pulse IP. Further, the voltage applied between the row electrodes X and Y within each discharge cell by the reset pulse RP and base pulse $BP^+$ is lower than the voltage applied between the row electrodes X and Y by the application of the sustain pulse IP. Therefore, the reset discharge initiated in response to the application of the reset pulse RP and base pulse $BP^+$ is weaker than the sustain discharge initiated by the application of the sustain pulse IP.

Thus, with the drive shown in FIG. 24, in the front half portion of each of the first reset process R1 and second reset process R2, a comparatively weak first reset discharge that has to form the charged particles is initiated. As a result, by employing the drive shown in FIG. 24, it is possible to replenish the charged particles, while improving the dark contrast with respect to the case in which a strong reset discharge that has to form a large number of charged particles is initiated.

When the PDP 50 is driven in the form, such as shown in FIG. 24, for each field (or frame), the PDP 50 may be driven in the form, such as shown in FIG. 23, at a ratio of one drive per a plurality of fields. Further, the PDP 50 may be also driven in the form, such as shown in FIG. 24, at a ratio of one drive per a plurality of fields, while driving the PDP 50 in the form, such as shown in FIG. 23, for each field (or frame).

In the forced lighting processing circuit 3, it is determined, for each block of discharge cells such as shown in FIG. 13, whether or not a transition has been made from a state in which all the discharge cells within the block are in the black display mode to a state in which they are in a display mode other than the black display, and a discharge cell in which the forced lighting drive has to be implemented is selected within the block in which the transition has occurred.

However, it is also possible to set in advance a discharge cell in which such forced lighting drive has to be implemented and to implement the forced lighting drive with respect to this discharge cell, regardless of the transition in the display state based on the display data PD.

For example, the discharge cells where the forced lighting drive is to be implemented are set in advance as a k-row/L-column discharge cell and an m-row/n-column discharge cell, and when black display is performed, the above-described forced lighting drive is implemented with respect to each such discharge cell, regardless of the pixel data PD.

When black display is performed, the above-described forced lighting drive may be implemented with respect to any random discharge cell, regardless of the pixel data PD. The effect of generating charged particles can be obtained from the discharge cell that has thus been subjected to forced lighting drive even when such a configuration is employed. Therefore, stabilization of write address discharge can be implemented with respect to a discharge cell that makes a transition from the black display state to the non-black display, as shown in FIG. 13.

In the drive shown in FIG. 9, the sustain process I is provided in the subfield SF1, but it is also possible not to execute the sustain process I in the SF1. Thus, during this time, all the row electrodes Y are maintained at a ground potential (0 V). In this case, the discharge cell that has been set to the above-described forced lighting drive is subjected to a selective write address discharge in the selective write address process $W_W$ of the subfield SF1 and a selective erase address discharge in the selective erase address process $W_D$ of the next subfield SF2. By the generation of charged particles by such selective write address discharge in the subfield SF1, the write address discharge in the discharge cell that makes a transition from black display to a non-black display, such as shown in FIG. 13, is stabilized. Furthermore, in this case, the emission following this forced lighting drive is only the emission caused by the write address discharge generated between the row electrodes and column electrodes. This emission is much weaker than that caused by the surface discharged generated between the row electrodes, such as a sustain discharge, and difficult to detect visually. Therefore, it produces a small negative effect on the displayed image.

In the forced lighting processing circuit 3, a lighting transition cell is detected for each block composed of 3 row×3 column discharge cells, but such detection is not limiting. Thus, the reason for detecting a lighting transition cell for each block composed of 3 row×3 column discharge cells is to take eight discharge cells adjacent to the lighting transition cell on the periphery thereof the objects of forced lighting discharge. However, for example, there are panel structures in which charged particles cannot be supplied into a lighting transition cell even when a discharge is initiated in four adjacent discharge cells located on the diagonals passing through the lighting transition cell. Accordingly, in such cases, the aforementioned block is configured of a total of five discharge cells: a lighting transition cell and adjacent discharge cells located above and below and on the left and right side of the lighting transition cell, instead of the 3×3 block. In other words, the block is configured of the lighting transition cell and those adjacent discharge cells that can supply charged particles to this lighting transition cell. Furthermore, the detection may be performed in cell units rather than block units. In this case, with respect to the discharge cell that is the object of forced lighting discharge, the forced lighting discharge is performed (in the present embodiment, the drive at a low-brightness level such as that of the second gradation or third gradation) even when the brightness level determined by the input video signal indicates a brightness level that is equal to or higher than the second gradation.

Where the above-described forced lighting discharge is implemented with respect to timely adjacent discharge cells, as shown in FIG. 18, the drive other than the usual black display is performed after one field has passed upon the initiation of discharge by the forced lighting discharge. In this case, because the number of charged particles generated by the discharge induced by the forced lighting discharge decreases with the passage of time, it is preferred that this time interval be as short as possible.

Embodiment 2

Figure 25:
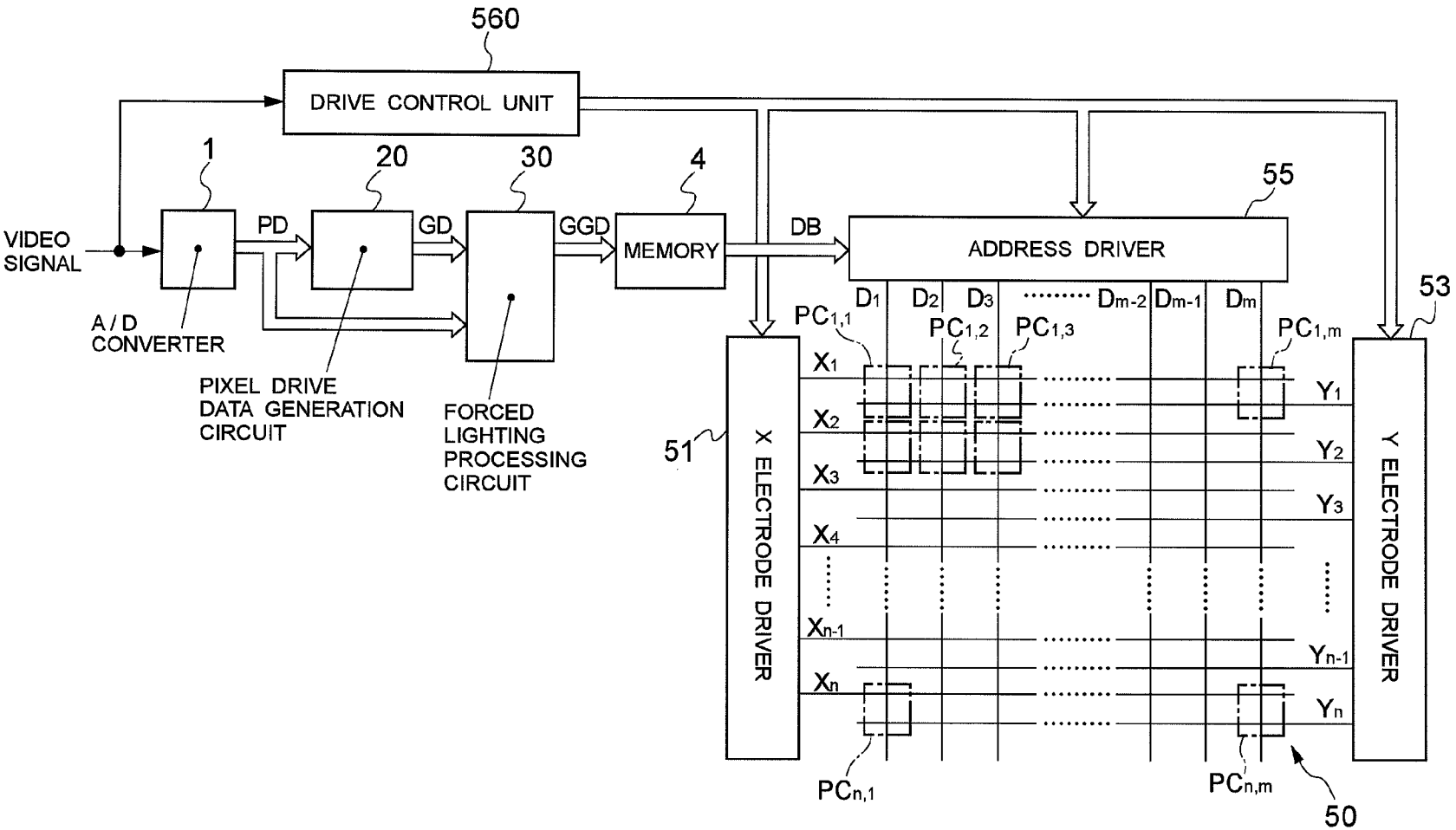
FIG. 25 shows another configuration of the plasma display device in which the plasma display panel is driven according to the drive method in accordance with the present invention.

FIG. 25 shows the configuration of a plasma display device created with consideration for the above-described issues.

The configuration of the plasma display device shown in FIG. 25 is identical to that shown in FIG. 1, except that a pixel drive data generation circuit 20 is provided instead of the pixel drive data generation circuit 2 shown in FIG. 1, a forced lighting processing circuit 30 is provided instead of the forced lighting processing circuit 3, and a drive control circuit 560 is provided instead of the drive control circuit 56.

Therefore, the explanation below will be focused on the operation of the pixel drive data generation circuit 20, forced lighting processing circuit 30, and drive control circuit 560.

First, the pixel drive data generation circuit 20 performs a multigradation processing including an error diffusion processing and a dither processing with respect to 8-bit pixel data PD supplied from the A/D converter 1, in the same manner as in the processing implemented in the pixel drive data generation circuit 2. With such multigradation processing, each of the pixel data PD is converted into 4-bit multigradation image data PDs, such as shown in FIG. 26, in which all the brightness levels are represented in 15 gradations (first to fifteenth gradations). Then, the pixel drive data generation circuit 2 converts the multigradation image data $PD_S$ into 14-bit pixel drive data GD according to a data conversion table such as shown in FIG. 26, and supplies the pixel drive data to the forced lighting processing circuit 30.

The forced lighting processing unit 30, first, determines whether a transition has been made from a state in which all the discharge cells within a block are in a black display mode (immediately preceding field), such as shown in FIG. 13, to a state in which a discharge cell demonstrating a brightness other than the black display, that is, a lighting transition cell, is present (current field) for each 3 row×3 column block. In this case, with respect to the pixel drive data GD that correspond to each discharge cell within the block for which the occurrence of transition such as shown in FIG. 13 has not been determined, the forced lighting processing unit 30 supplies these pixel drive data, without any change, as the pixel drive data GGD to the memory 4. On the other hand, the below-described data replacement processing is performed with respect to the pixel drive data GD corresponding to the lighting transition cell from among all the discharge cells within the block for which the occurrence of transition such as shown in FIG. 13 has been determined.

Thus, the forced lighting processing unit 30, first, determines whether the pixel drive data GD are the pixel drive data GD corresponding to any one gradation representing a low brightness, for example, first gradation to third gradation such as shown in FIG. 26, that is, First gradation: [00000000000000]

Second gradation: [10000000000000]

Third gradation: [01000000000000].

In the case where the pixel drive data GD have been determined to represent a gradation other than the above-described first gradation to third gradation, the forced lighting processing unit 30 supplies the supplied pixel drive data GD, without any change, as the pixel drive data GGD to the memory 4.

On the other hand, in the case where the pixel drive data GD have been determined to correspond to any one from the first gradation to third gradation, the forced lighting processing unit 30 replaces the pixel drive data GD with the pixel drive data GD corresponding to the fourth gradation shown in FIG. 26, that is, with

[01110000000000]

and sends these data as the pixel drive data GGD to the memory 4.

The memory 4 sequentially writes the pixel drive data GGD and performs the below-described read operation upon completion of writing the pixel drive data $GGD_{(1,1)}$ to $GGD_{(n,m)}$ corresponding to each pixel of one screen, that is, the first row by the first column to the n-th row by the m-th column. First, the memory 4 takes the first bit of each pixel drive data $GGD_{(1,1)}$ to $GGD_{(n,m)}$ as pixel drive data bits $DB_{(1,1)}$ to $DB_{(n,m)}$, reads them for each one display line in the below-described subfield SF1, and supplies them to an address driver 55. Then, the memory 4, takes the second bit of each pixel drive data $GGD_{(1,1)}$ to $GGD_{(n,m)}$ as the pixel drive data bit $DB_{(1,1)}$ to $DB_{(n,m)}$, reads them for each one display line in the below-described subfield SF2, and supplies them to the address driver 55. Then, the memory 4 reads the bits of each pixel drive data $GGD_{(1,1)}$ to $GGD_{(n,m)}$ separately by rows of the same bits and supplies each of them as pixel drive data bits $DB_{(1,1)}$ to $DB_{(n,m)}$ to the address driver 55 in the subfield corresponding to the bit row.

Figure 27:
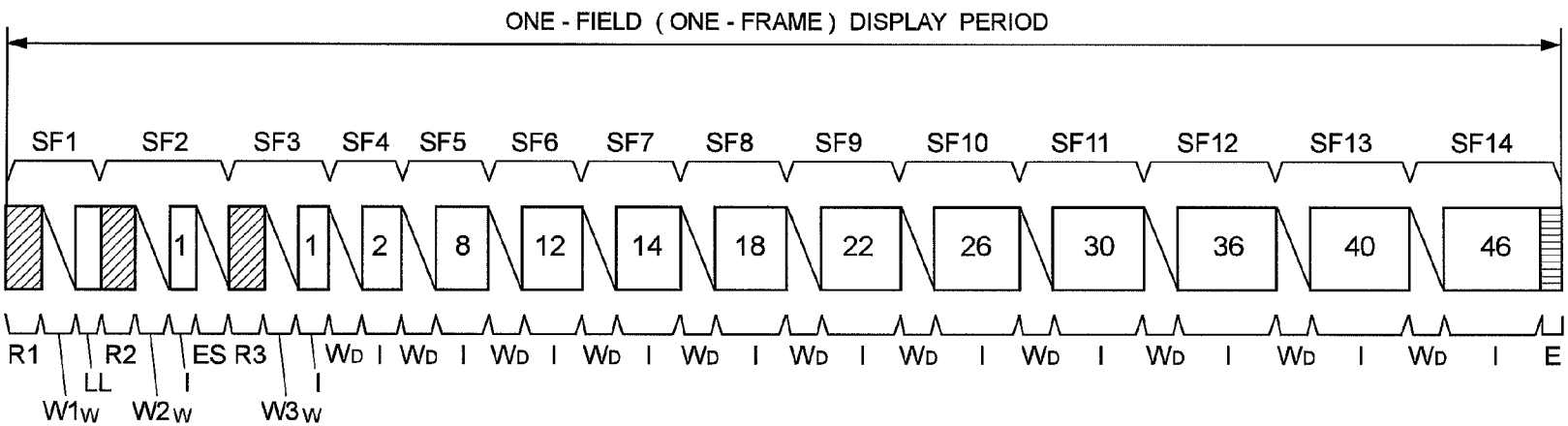
FIG. 27 shows an example of an emission drive sequence employed in the plasma display device shown in FIG. 25.

The drive control circuit 560 supplies the control signals that have to drive the PDP 50 according to the light emission drive sequence as shown in FIG. 27, to panel drivers (X electrode driver 51, Y electrode driver 53, and address driver 55). Thus, in the leading subfield SF1 within a one-field (one-frame) display period, such as shown in FIG. 27, the drive control circuit 560 supplies to the panel drivers the control signals that have to realize sequentially the driving according to each of the first reset process R1, first selective write address process $W1_W$, and minute light emission process LL. In the subfield SF2 that follows the subfield SF1, the drive control circuit 560 supplies to the panel drivers the control signals that have to realize sequentially the driving according to each of the second reset process R2, second selective write address process $W2_W$, sustain process I, and scanning erase process ES. In the subfield SF3 that follows the subfield SF2, the drive control circuit 560 supplies to the panel drivers the control signals that have to realize sequentially the driving according to each of the third reset process R3, third selective write address process $W3_W$, and sustain process I. In the remaining subfields SF4 to SF14, the drive control circuit 560 supplies to the panel drivers the control signals that have to realize sequentially the driving according to each of the selective erase address process $W_D$ and sustain process I. Only in the very last subfield SF14, after the sustain process I has been executed, the drive control circuit 560 supplies the control signals that have to realize sequentially the driving according to the erase process E to the panel drivers.

Figure 28:
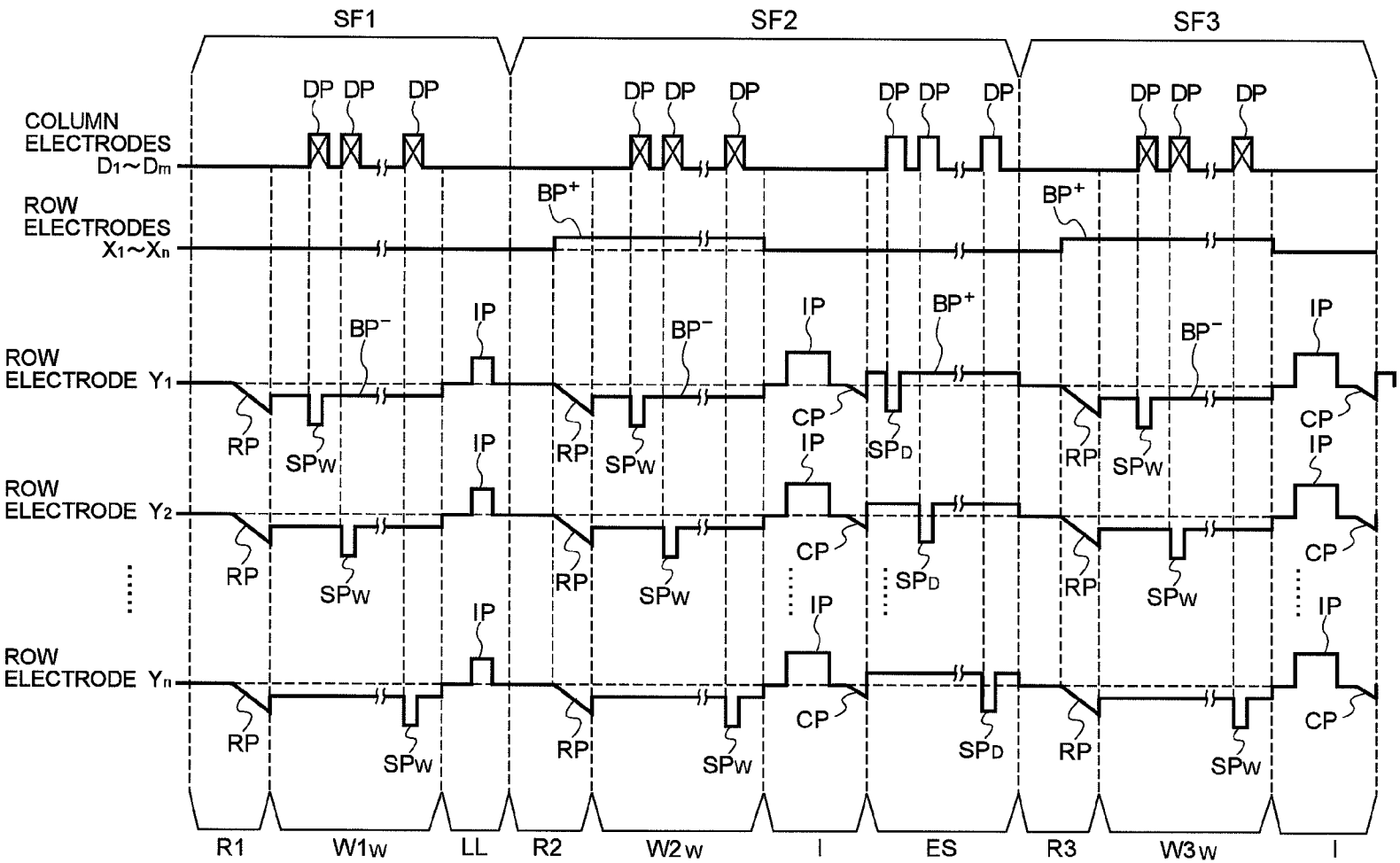
FIG. 28 shows drive pulses applied to the PDP 50 according to the emission drive sequence shown in FIG. 27.

The X electrode driver 51, Y electrode driver 53, and address driver 55 generate the drive pulses such as shown in FIG. 28 and supply them to the column electrodes D and row electrodes X and Y of the PDP 50 in response to the control signals that are supplied from the drive control circuit 560.

The drive pulses applied in each of the subfields SF4 to SF14 and the application timings thereof are identical to those shown in FIG. 24. Accordingly, in FIG. 28, only the drive pulses applied in each of the subfields SF1 to SF3 and the application timings thereof are shown in respective frames.

Referring to FIG. 28, in the first reset process R1 of the subfield SF1, the address driver 55 sets the column electrodes $D_1$ to $D_m$ to a state with a ground potential (0 V) During this time, the Y electrode driver 53 generates a reset pulse RP of negative polarity which has a waveform in which the electric potential at the front edge changes gradually with the passage of time and applies this reset pulse to all the row electrodes $Y_1$ to $Y_n$. The negative peak potential in the reset pulse RP is set to a potential that is higher than the peak potential of the write scanning pulse $SP_W$ of negative polarity that is described hereinbelow, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge that has been formed in the vicinity of column electrodes D is largely erased, and the address discharge in the first selective write address process $W1_W$ becomes unstable. During this time, the X electrode driver 51 sets all the row electrodes $X_1$ to $X_n$ to the ground potential (0 V). In response to the application of the reset pulse RP, a reset discharge is initiated between the row electrodes X and Y within all the discharge cells PC. By this reset discharge, the wall charge that remained in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP. Accordingly, part of the wall charge of positive polarity that has been formed in the vicinity of column electrodes D is erased by this very weak discharge, and the wall charge is adjusted to a value capable of initiating the selective write address discharge correctly in the below-described first selective write address process $W1_W$. The pulse voltage of the reset pulse RP is set lower than the pulse voltage of the sustain pulse IP. Further, the voltage applied between the row electrodes X and Y within each discharge cell by the reset pulse RP is lower than the voltage applied between the row electrodes X and Y by the application of the sustain pulse IP. Therefore, the reset discharge initiated in response to the application of the reset pulse RP is weaker than the sustain discharge initiated by the application of the sustain pulse IP.

Further, in the first selective write address process $W1_W$ of the subfield SF1, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 28, to the row electrodes $Y_1$ to $Y_n$ at the same time. During this time, the address driver 55, first, converts the pixel drive data bit corresponding to the subfield SF1 into the pixel data pulse DP having a pulse voltage corresponding to the logical level of the pixel drive data bit. For example, when a pixel drive data bit with a logical level 1 that has to set the discharge cell PC to a lighting mode is supplied, the address driver 55 converts the pixel drive data bit into a pixel data pulse DP having a peak potential of positive polarity. On the other hand, with respect to a pixel drive data bit with a logical level 0 that has to set the discharge cell PC to a quenching mode, the address driver converts the pixel drive data bit into a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrodes D and row electrodes Y within the discharge cell PC having applied thereto a high-voltage pixel data pulse DP that has to set the discharge cell to a lighting mode, simultaneously with the write scanning pulse $SP_W$. During this time, a voltage corresponding to the write scanning pulse $SP_W$ is also applied between the row electrodes X and Y, but at this stage, all the discharge cells PC are in the quenching mode, that is, in a state in which the wall charge is erased. Therefore, a discharge is not generated between the row electrodes X and Y by the application of this write scanning pulse $SP_W$. Accordingly, in the first selective write address process $W1_W$ of the subfield SF1, a selective write address discharge is initiated only between the column electrode D and row electrode Y within the discharge cell PC in response to the application of the write scanning pulse $SP_W$ and high-voltage pixel data pulse DP. As a result, although a wall charge is present in the vicinity of row electrode X within the discharge cell PC, the cell is set to a lighting mode state in which a wall charge of positive polarity is formed in the vicinity of row electrode Y and a wall charge of negative polarity is formed in the vicinity of column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse $SP_W$. Thus, in the discharge cell PC, the state of a quenching mode that has been initialized in the first reset process R1, that is, a state in which no discharge is generated between the row electrode Y and column electrode D and also between the row electrodes X and Y, is maintained.

Further, in the minute light emission process LL of the subfield SF1, the Y electrode driver 53 simultaneously applies the minute light emission pulses LP having a predetermined peak potential of positive polarity, such as shown in FIG. 28, to the row electrodes $Y_1$ to $Y_n$. In response to the application of this minute light emission pulse LP, a minute light emission discharge is initiated between the column electrode D and row electrode Y within the discharge cell PC that has been set to the lighting mode. In other words, in the minute light emission process LL, although a discharge is initiated between the row electrode Y and column electrode D within the discharge cell PC, an electric potential that does not initiate the discharge between the row electrodes X and Y is applied to the row electrode Y, whereby the minute light emission discharge is initiated only between the column electrode D and row electrode Y within the discharge cell PC that has been set to the lighting mode. In this case, the peak potential of the minute light emission pulse LP is lower than the peak potential of the sustain pulse IP applied in the sustain process I following the below-described subfield SF2 and is equal, for example, to the base potential that is applied to the row electrode Y in the below-described selective erase address process $W_D$. Further, as shown in FIG. 28, the variation ratio with the passage of time in the rise segment of the potential in the minute light emission pulse LP is higher than the variation ratio in the fall segment in the reset pulse RP. In other words, by making the transition of electric potential in the front edge portion of the minute light emission pulse LP steeper than the transition of electric potential in the front edge portion of the reset pulse, a discharge that is stronger than the reset discharge is initiated. Here, this discharge is a column-side cathode discharge and also a discharge initiated by the minute light emission pulse LP that has a pulse voltage lower than the sustain pulse IP. Therefore, the emission brightness following this discharge is lower than that following the sustain discharge initiated between the row electrodes X and Y. Thus, in the minute light emission process LL, a discharge initiated as a minute light emission discharge is a discharge that is followed by light emission with a brightness level higher than that of the reset discharge, but is a discharge with a brightness level following the discharge that is lower than that of the sustain discharge, that is, a discharge that is followed by a minute light emission such that can be used for display. In this case, in the first selective address process $W1_W$ that is implemented immediately before the minute light emission process LL, a selective write address discharge is initiated between the column electrode D and row electrode Y in the discharge cell PC. Therefore, in the subfield SF1, a brightness corresponding to a gradation with a brightness that is higher by one stage than the brightness level 0 is represented by the light emission following the selective write address discharge and the light emission following this minute light emission discharge.

After the minute light emission discharge, a wall charge of negative polarity is formed in the vicinity of the row electrode Y, and a wall charge of positive polarity is formed in the vicinity of the column electrode D.

Further, in the second reset process R2 of the subfield SF2, the address driver 55 sets the column electrodes $D_1$ to $D_m$ to a ground potential (0 V). During this time, the Y electrode driver 53 applies a reset pulse RP of negative polarity in which the transition of electric potential at the front edge with the passage of time is gradual to the row electrodes $Y_1$ to $Y_n$. Further, during this time, the X electrode driver 51 applies a base pulse $BP^+$ having a predetermined base potential of positive polarity to each of the row electrodes $X_1$ to $X_n$. In this case, reset discharges are initiated between the row electrodes X and Y within all the discharge cells PC in response to the application of these reset pulse RP of negative polarity and base pulse $BP^+$ of positive polarity. The negative peak potential in the reset pulse RP is set to a potential that is higher than the peak potential of the write scanning pulse $SP_W$ of negative polarity, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the second selective write address process $W2_W$ becomes unstable. By the reset discharge initiated in the second reset process R2, the wall charge protective layer includes has been formed in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP, part of the wall charge of positive polarity that has been formed in the vicinity of column electrodes D is erased by this very weak discharge, and the wall charge is adjusted to a value capable of initiating the selective write address discharge correctly in the second selective write address process $W2_W$. The pulse voltage of the reset pulse RP is set lower than the pulse voltage of the sustain pulse IP. Further, the voltage applied between the row electrodes X and Y within each discharge cell by the reset pulse RP and base pulse $BP^+$ is lower than the voltage applied between the row electrodes X and Y by the application of the below-described sustain pulse IP. Therefore, the reset discharge initiated in response to the application of the reset pulse RP and base pulse $BP^+$ is weaker than the sustain discharge initiated by the application of the sustain pulse IP.

Then, in the second selective write address process $W2_W$ of the subfield SF2, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 28, to the row electrodes $Y_1$ to $Y_n$ at the same time. In the second selective write address process $W2_W$, the X electrode driver 51 continues the application of the base pulse $BP^+$ that has been applied to the row electrodes $X_1$ to $X_n$ in the second reset process R2. The potentials of base pulse $BP^-$ and base pulse $BP^+$ are set such that the voltage between the row electrodes X and Y within the period in which the write scanning pulse $SP_W$ is not applied is lower than the discharge start voltage of the discharge cell PC. Further, in the second selective write address process $W2_W$, the address driver 55, first, converts the pixel drive data bit corresponding to the subfield SF2 into the pixel data pulse DP having a pulse voltage corresponding to the logical level of the pixel drive data bit. For example, when a pixel drive data bit with a logical level 1 that has to set the discharge cell PC to a lighting mode is supplied, the address driver 55 converts the pixel drive data bit into a pixel data pulse DP having a peak potential of positive polarity. On the other hand, with respect to a pixel drive data bit with a logical level 0 that has to set the discharge cell PC to a quenching mode, the address driver performs a conversion into a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrode D and row electrode Y within the discharge cell PC having applied thereto a high-voltage pixel data pulse DP that has to set the discharge cell to a lighting mode, simultaneously with the write scanning pulse $SP_W$. Furthermore, a very weak discharge is also initiated between the row electrodes X and Y within the discharge cell PC immediately after this selective write address discharge. In other words, a voltage corresponding to the base pulse $BP^-$ and base pulse $BP^+$ is applied between the row electrodes X and Y after the write scanning pulse $SP_W$ has been applied, but because this voltage is set lower than the discharge start voltage of each discharge cell PC, no discharge is generated within the discharge cell PC by the application of this voltage. However, where the selective write address discharge is initiated, a discharge is initiated between the row electrodes X and Y by the application of a voltage induced by the selective write address discharge and based on the base pulse $BP^-$ and base pulse $BP^+$. This discharge is not initiated in the first selective write address process $W1_W$ in which the base pulse $BP^+$ is not applied to the row electrode X. By this discharge and also the above-described selective write address discharge, the discharge cell PC is set into a state in which a wall charge of positive polarity is formed in the vicinity of row electrode Y, a wall charge of negative polarity is formed in the vicinity of row electrode X, and a wall charge of negative polarity is formed in the vicinity of column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse SPW, and therefore no discharge is generated between the row electrodes X and Y. Thus, in the discharge cell PC, the immediately preceding state, that is, the state of a quenching mode that has been initialized in the second reset process R2, is maintained.

Further, in the sustain process I of the subfield SF2, the Y electrode driver 53 generates, pulse by pulse, the sustain pulses IP having a peak potential of positive polarity and applies these pulses simultaneously to the row electrodes $Y_1$ to $Y_n$. During this time, the X electrode driver 51 sets the row electrode $X_1$ to $X_n$ to a state with the ground potential (0 V), and the address driver 55 sets the column electrodes $D_1$ to $D_m$ to a state with the ground potential (0 V). In response to the application of this sustain pulse IP, a sustain discharge is initiated between the row electrodes X and Y within the discharge cell PC that has been set, as described hereinabove, into a lighting mode. The light emitted from the fluorescent layer 17, following this sustain discharge, is irradiated to the outside via the front transparent substrate 10, whereby one display emission corresponding to the brightness weight of the subfield SF2 is performed. Further, in response to the application of this sustain pulse IP, a discharge is also initiated between the row electrode Y and column electrode D within the discharge cell PC that has been set into a lighting mode. By this discharge and also the above-described sustain discharge, a wall charge of negative polarity is formed in the vicinity of the row electrode Y within the discharge cell PC, and a wall charge of positive polarity is formed in the vicinity of row electrode X and column electrode D. Further, after the sustain pulse IP has been applied, the Y electrode driver 53 applies to the row electrodes $Y_1$ to $Y_n$ a wall charge adjustment pulse CP that has a peak potential of negative polarity with a gradual transition of electric potential at a front edge with the passage of time, as shown in FIG. 28. In response to the application of this wall charge adjustment pulse CP, a very weak erase discharge is initiated in the discharge cell PC in which the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next scanning erase process ES.

Further, in the scanning erase process ES, the Y electrode driver 53 successively and alternatively applies the erase scanning pulse $SP_D$ having a peak potential of negative polarity such as shown in FIG. 28 to the row electrodes $Y_1$-$Y_n$, while applying the base pulse $BP^+$ having a predetermined base potential of positive polarity to each row electrode $Y_1$-$Y_n$. Further, the peak potential of the base pulse $BP^+$ is set such that can prevent an erroneous discharge between the row electrodes X and Y within the execution period of this scanning erase process ES. During this time, the address driver 55 generates a pixel data pulse DP having a peak potential of positive polarity that has to cause a transition of the discharge cell PC from the lighting mode to the quenching mode and supplies these pixel data, by one display line (m lines), to the column electrodes $D_1$ to $D_m$ synchronously with the application timing of the erase scanning pulse $SP_D$. Further, within the execution period of this scanning erase process ES, the X electrode driver 51 sets the row electrodes $X_1$ to $X_n$ to a ground potential (0 V). Here, an erase discharge is initiated between the column electrode D and row electrode Y within the discharge cell PC having applied thereto a high-voltage pixel data pulse DP, simultaneously with the erase scanning pulse $SP_D$. By such erase discharge, the discharge cell PC is set into a state in which a wall charge of positive polarity is formed in the vicinity of each row electrode Y and X and a wall charge of negative polarity is formed in the vicinity of column electrodes D, that is, to a quenching mode. At this time, all the pixel data pulses DP applied to each of the column electrodes $D_1$ to $D_m$ in each display line has a peak potential of positive polarity. Therefore, with the aforementioned scanning erase process ES, all the discharge cells $PC_{1,1}$ to $PC_{1,m}$ of one screen are successively, by one display line, set to a quenching mode, and the residual state of wall charge becomes substantially identical in all the discharge spaces. As a result, spread of the write address discharge initiated in each discharge cell in the below-described third selective write address process $W3_W$ is inhibited.

Further, in the third reset process R3 of the subfield SF3, the address driver 55 sets the column electrodes $D_1$ to $D_m$ to a state with the ground-potential (0 V). During this time, the Y electrode driver 53 applies a reset pulse RP of negative polarity in which the transition of electric potential at the front edge with the passage of time is gradual to the row electrodes $Y_1$ to $Y_n$. Further, during this time, the X electrode driver 51 applies a base pulse $BP^+$ having a predetermined base potential of positive polarity to each of the row electrodes $X_1$ to $X_n$. In this case, reset discharges are initiated between the row electrodes X and Y within all the discharge cells PC in response to the application of these reset pulse RP of negative polarity and base pulse $BP^+$ of positive polarity. The negative peak potential in the reset pulse RP is set to a potential that is higher than the peak potential of the write scanning pulse $SP_W$ of negative polarity, that is, to a potential that is close to 0 V. Such setting can be explained as follows. Where the peak potential of the reset pulse RP is made lower than the peak potential of the write scanning pulse $SP_W$, a strong discharge is initiated between the row electrodes Y and column electrodes D, the wall charge formed in the vicinity of column electrodes D is largely erased, and the address discharge in the third selective write address process $W3_W$ becomes unstable. By the reset discharge initiated in the third reset process R3, the wall charge protective layer includes has been formed in the vicinity of each row electrode X and Y within each discharge cells PC is erased and all the discharge cells PC are initialized in a quenching mode. Further, a very weak discharge is also initiated between the row electrodes Y and column electrodes D within all the discharge cells PC in response to the application of this reset pulse RP, part of the wall charge of positive polarity that has been formed in the vicinity of column electrodes D is erased by this very weak discharge, and the wall charge is adjusted to a value capable of initiating the selective write address discharge correctly in the third selective write address process $W3_W$. The pulse voltage of the reset pulse RP is set lower than the pulse voltage of the sustain pulse IP. Further, the voltage applied between the row electrodes X and Y within each discharge cell by the reset pulse RP and base pulse $BP^+$ is lower than the voltage applied between the row electrodes X and Y by the application of the below-described sustain pulse IP. Therefore, the reset discharge initiated in response to the application of the reset pulse RP and base pulse $BP^+$ is weaker than the sustain discharge initiated by the application of the sustain pulse IP.

Then, in the third selective write address process $W3_W$ of the subfield SF3, the Y electrode driver 53 successively and alternatively applies the write scanning pulse $SP_W$ having a peak potential of negative polarity to each row electrode $Y_1$ to $Y_n$, while applying the base pulse $BP^-$ having a predetermined base potential of negative polarity, such as shown in FIG. 28, to the row electrodes $Y_1$ to $Y_n$ at the same time. In the third selective write address process $W3_W$, the X electrode driver 51 continues the application of the base pulse $BP^+$ that has been applied to the row electrodes $X_1$ to $X_n$ in the third reset process R3. The base pulse $BP^-$ and base pulse $BP^+$ are set to a potential such that the voltage between the row electrodes X and Y within the period in which the write scanning pulse $SP_W$ is not applied is lower than the discharge start voltage of the discharge cell PC. Further, in the third selective write address process $W3_W$, the address driver 55, first, converts the pixel drive data bit corresponding to the subfield SF3 into the pixel data pulse DP having a pulse voltage corresponding to the logical level of the pixel drive data bit. For example, when a pixel drive data bit with a logical level 1 that has to set the discharge cell PC to a lighting mode is supplied, the address driver 55 converts the pixel drive data bit into a pixel data pulse DP having a peak potential of positive polarity. On the other hand, with respect to a pixel drive data bit with a logical level 0 that has to set the discharge cell PC to a quenching mode, the address driver performs a conversion into a pixel data pulse DP of a low voltage (0 V). Further, the address driver 55 applies this pixel data pulse DP, by one display line (m lines), to the column electrodes $D_1$ to $D_m$ synchronously with the application timing of each write scanning pulse $SP_W$. In this case, a selective write address discharge is initiated between the column electrode D and row electrode Y within the discharge cell PC having applied thereto a high-voltage pixel data pulse DP that has to set the discharge cell to a lighting mode, simultaneously with the write scanning pulse $SP_W$. Furthermore, a very weak discharge is also initiated between the row electrodes X and Y within the discharge cell PC immediately after this selective write address discharge. In other words, a voltage corresponding to the base pulse $BP^-$ and base pulse $BP^+$ is applied between the row electrodes X and Y after the write scanning pulse $SP_W$ has been applied, but because this voltage is set lower than the discharge start voltage of each discharge cell PC, no discharge is generated within the discharge cell PC by the application of this voltage. However, where the selective write address discharge is initiated, a discharge is initiated between the row electrodes X and Y by the application of a voltage induced by the selective write address discharge and based on the base pulse $BP^-$ and base pulse $BP^+$. This discharge is not initiated in the first selective write address process $W1_W$ in which the base pulse $BP^+$ is not applied to the row electrode X. By this discharge and also the above-described selective write address discharge, the discharge cell PC is set into a state in which a wall charge of positive polarity is formed in the vicinity of row electrode Y, a wall charge of negative polarity is formed in the vicinity of row electrode X, and a wall charge of negative polarity is formed in the vicinity of column electrode D. On the other hand, the above-described selective write address discharge is not initiated between the column electrode D and row electrode Y within the discharge cell PC having applied thereto a pixel data pulse DP of a low voltage (0 V) that has to set the cell into a quenching mode, simultaneously with the write scanning pulse $SP_W$, and therefore no discharge is generated between the row electrodes X and Y. Thus, in the discharge cell PC, the immediately preceding state, that is, the state of a quenching mode that has been initialized in the third reset process R3, is maintained.

Further, in the sustain process I of the subfield SF3, the Y electrode driver 53 generates, pulse by pulse, the sustain pulses IP having a peak potential of positive polarity and applies these pulses simultaneously to the row electrodes $Y_1$ to $Y_n$. During this time, the X electrode driver 51 sets the row electrode $X_1$ to $X_n$ to a state with the ground potential (0 V), and the address driver 55 sets the column electrodes $D_1$ to $D_m$ to a state with the ground potential (0 V). In response to the application of this sustain pulse IP, a sustain discharge is initiated between the row electrodes X and Y within the discharge cell PC that has been set, as described hereinabove, into a lighting mode. The light emitted from the fluorescent layer 17, following this sustain discharge, is irradiated to the outside via the front transparent substrate 10, whereby one display emission corresponding to the brightness weight of the subfield SF3 is performed. Further, in response to the application of this sustain pulse IP, a discharge is also initiated between the row electrode Y and column electrode D within the discharge cell PC that has been set into a lighting mode. By this discharge and also the above-described sustain discharge, a wall charge of negative polarity is formed in the vicinity of the row electrode Y within the discharge cell PC, and a wall charge of positive polarity is formed in the vicinity of row electrode X and column electrode D. Further, after the sustain pulse IP has been applied, the Y electrode driver 53 applies to the row electrodes $Y_1$ to $Y_n$ a wall charge adjustment pulse CP that has a peak potential of negative polarity with a gradual transition of electric potential at a front edge with the passage of time, as shown in FIG. 28. In response to the application of this wall charge adjustment pulse CP, a very weak erase discharge is initiated in the discharge cell PC in which the above-described sustain discharge has been initiated, and part of the wall charge formed inside the discharge cell is erased. As a result, the amount of wall charge within the discharge cell PC is adjusted to a value that makes it possible to initiate correctly a selective erase address discharge in the next selective erase address process $W_D$.

In the subsequent subfields SF4 to SF14, the panel drivers perform the application of various drive pulses at timings shown in FIG. 24.

The above-described drive is executed based on 15 pixel drive data GGD such as shown in FIG. 26.

First, at the second gradation representing a brightness that is one stage higher than the first gradation that represents the black display (brightness level 0), as shown in FIG. 26, a selective write address discharge for setting the discharge cell PC into a lighting mode is initiated only in the SF1 from among the subfields SF1 to SF14, and a minute light emission discharge is induced in the discharge cell PC that has been set into the lighting mode (shown by an empty square). In this case, the brightness level during the emission following these selective write address discharge and minute light emission discharge is lower than the brightness level during the emission following one sustain discharge. Therefore, when the brightness level that can be observed due to the sustain discharge is taken as "1", in the second gradation, the brightness corresponding to the brightness level "α" that is lower than the brightness level "1" is represented.

At the third gradation representing a brightness that is one stage higher than that of the second gradation, a selective write address discharge for setting the discharge cell PC into a lighting mode is initiated only in the SF2 from among the subfields SF1 to SF14 (shown by a double circle). Therefore, in the third gradation, brightness level "1" based on one sustain discharge initiated only in the sustain process I of the SF2 from among the subfields SF1 to SF14 is represented. At the fourth gradation representing a brightness that is one stage higher than that of the third gradation, a selective write address discharge for setting the discharge cell PC into a lighting mode is initiated in the subfields SF2 and SF3 (shown by a double circle), and a selective write address discharge for causing the transition of the discharge cell to the quenching mode is initiated in the subfield SF4 (shown by a black circle). Therefore, in the fourth gradation, the brightness level "2" determined by a total of two sustain discharges initiated in the subfields SF2 and SF3 is represented.

At each of the fifth to fifteenth gradations, a selective write address discharge for setting the discharge cell PC into a lighting mode is initiated in the subfields SF2 and SF3 (shown by a double circle), and then a selective erase address discharge for causing the transition of the discharge cell to the quenching mode is initiated in one subfield corresponding to this gradation (shown by a black circle). Therefore, at each of the fifth to fifteenth gradations, a brightness is represented that corresponds to a sum total of a total of two sustain discharges initiated in the subfields SF2 and SF3 and sustain discharges (shown by an empty circle) initiated in the subfield SF4 and subsequent subfields.

Thus, with the first to fifteenth gradation drives such as shown in FIG. 26, a brightness range with a brightness level of "0" to "256" can be represented by 15 stages such as shown in FIG. 26.

Accordingly, in the plasma display device shown in FIG. 25, the initialization of all the discharge cells PC is completed by a reset discharge that is weaker than the sustain discharge in each of the reset processes (R1 to R23) shown in FIG. 28 by using the action of the CL emitting MgO formed inside the discharge cells PC. In other words, in the conventional reset process that has to release a comparatively large number of charged particles within the discharge space, a discharge stronger than the sustain discharge is initiated as a reset discharge by applying a reset pulse of a voltage higher than the sustain pulse. Thus, by so releasing a large number of charged particles within the discharge space at the initialization stage, it is possible to stabilize the write address discharge in the address process. However, in the discharge cell in which CL emitting MgO has been formed, as in the present embodiment, the write address discharge in the address process is stabilized better than in the discharge cell in which no CL emitting MgO has been formed, regardless of the number of charged particles released by the reset discharge. Accordingly, in the reset processes (R1 to R3) shown in FIG. 28, the increase in dark contrast can be ensured by omitting a strong reset discharge that can release a comparatively large number of charged particles within the discharge space, that is, a reset discharge that is stronger than the sustain discharge.

However, where the black display state is maintained, the write address discharge sometimes fails, as described hereinabove, due to the deficit of charged particles, even if the write address discharge has been stabilized by the action of the CL emitting MgO.

Accordingly, in order to prevent such write address discharge failure, in the plasma display device shown in FIG. 25, the below-described drive is performed only with respect to a discharge cell for which the deficit of charged particles is predicted, that is, the lighting transition cell within the block in which the transition of drive state such as shown in FIG. 16 occurs.

Thus, in the case where the pixel drive data GD corresponding to this lighting transition cell are the pixel drive data GD corresponding to any one gradation from among the first gradation to third gradation, such as shown in FIG. 26, that is, First gradation: [00000000000000]

Second gradation: [10000000000000]

Third gradation: [01000000000000], the forced lighting processing unit 30 replaces these data with the pixel drive data GD corresponding to the fourth gradation shown in FIG. 26, that is, with

[0111000000000].

Therefore, in this case, a drive of fourth gradation such as shown in FIG. 26 is implemented with respect to the lighting transition cell.

On the other hand, in the case where the pixel drive data GD corresponding to the above-described lighting transition cell do not correspond to any gradation from among the first gradation to third gradation, a drive corresponding to the gradation indicated by these pixel drive data GD is performed.

Thus, a lighting transition cell within a block for which a transition of drive state, such as shown in FIG. 16, is predicted by the pixel data PD, is forcibly driven (forced lighting drive) at a gradation equal to or higher than the fourth gradation shown in FIG. 26, even if it has to be driven at the first gradation. In this case, in the drive at a gradation equal to or higher than the fourth gradation, that is at a fourth to fifteenth gradations, a write address discharge and sustain discharge are necessarily initiated in the subfield SF2, as shown in FIG. 26 (shown by a double circle). Therefore, following these discharges, charged particles are released within the discharge space and a write address discharge can be reliably initiated in the third selective write address process $W3_W$ of the next subfield SF3.

Therefore, the write address discharge and sustain discharge initiated in the subfield SF2 serve as auxiliary discharges for initiating a write address discharge with good stability in the third selective write address process $W3_W$ of the next subfield SF3.

Accordingly, although the deficit of charged particles that is created by a transition of the drive state such as shown in FIG. 16 indeed can cause the failure of the write address discharge in the subfield SF3, this deficit of charged particles is eliminated at a stage immediately preceding the SF3 by the above-described drive and a write address discharge can be reliably initiated in the SF3.

Furthermore, with such drive method, the time interval from the initiation of the auxiliary discharges (write address discharge and sustain discharge of SF2) to the third selective write address process $W3_W$ of the subfield SF3 is shorter than in the case in which the drive shown in FIG. 18 is implemented. As a result, the reduction in the number of charged particles is small and the write address discharge can be initiated with better reliability.

In the example shown in FIG. 26, the auxiliary discharges serving to initiate reliably the write address discharge in the third selective write address process $W3_W$ of the subfield SF3 are executed in the subfield SF2 immediately preceding the subfield SF3, but the auxiliary discharges are not necessary required to be executed in the immediately preceding subfield and can be executed, for example, in the subfield SF1. Further, in the present embodiment, there is only one subfield SF for implementing the auxiliary discharges within one-field display period, but these discharges may be implemented in a plurality (two or more) subfields SF. Further, it is preferred that a subfield SF with a small brightness weight be set as the SF for implementing the auxiliary discharges.

In the drive shown in FIG. 26 to FIG. 28, a subfield SF1 is provided that includes a minute light emission process LL that initiates a minute light emission discharge with an emission brightness during the discharge that is lower than that of the sustain discharge within one-field display period, but this SF1 may be omitted. In sum, the SF1 shown in FIG. 26 to FIG. 28 is canceled and the SF2 is taken as a new leading subfield.

Further, in the drive shown in FIG. 26 to FIG. 28, the selective write address process is employed in the leading subfields SF1 to SF3 and a selective erase address process is employed in the subfield SF4 and subsequent subfields SF as the address process that is executed in each subfield SF, but the selective write address process may be also employed as the address process in all the subfields SF.

In the example shown in FIG. 28, the sustain pulse IP is applied once to each row electrode Y in the sustain process I of SF2, but such method is not limiting, the sustain pulse may be applied multiple times alternately to the row electrodes X and Y, or the sustain pulse may not be applied at all.

In the example shown in FIG. 28, the scanning erase process ES that has to set the state of each discharge cell to the erase mode sequentially, by one display line, is executed in the SF2, but an erase process (for example, the process shown in FIG. 9) that sets all the discharge cells together into the erase mode may be executed instead of the scanning erase process ES. Further, in the scanning erase process ES, the state of each discharge cell may be set into the erase mode sequentially for each display line group composed of a plurality of display lines, rather than by one display line. In this case, the scanning erase process ES itself may be omitted, provided that a spread of the write address discharge initiated for each discharge cell in the third selective write address process $W3_W$ can be inhibited to a certain degree by actual configuration or materials of the PDP 50.

In the forced lighting processing circuit 30, a lighting transition cell is detected for each block composed of 3 row×3 column discharge cells, but such detection is not limiting.

Thus, the reason for detecting a lighting transition cell for each 3 row×3 column block is to take the eight discharge cells adjacent to the lighting transition cell on the periphery thereof as the objects of forced lighting discharge. However, for example, there are panel structures in which charged particles cannot be supplied into a lighting transition cell even when a discharge is initiated in four adjacent discharge cells located on the diagonals passing through the lighting transition cell. Accordingly, in such cases, the aforementioned block is configured of a total of five discharge cells: a lighting transition cell and adjacent discharge cells located above and below and on the left and right side of the lighting transition cell, instead of the 3×3 block. In other words, the block is configured of the lighting transition cell and those adjacent discharge cells that can supply charged particles to this lighting transition cell. Furthermore, the detection may be performed in cell units rather than block units. In this case, with respect to the discharge cell that is the object of forced lighting discharge, the forced lighting discharge is performed (in the present embodiment, the drive at a low-brightness level such as that of the second gradation or third gradation) even when the brightness level determined by the input video signal indicates a brightness level that is equal to or higher than the second gradation.

This application is based on Japanese Patent Application No. 2007-052773 which is hereby incorporated by reference.

What is claimed is:

1. A drive method of a plasma display panel by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to a brightness weight of the subfield;

a discharge cell that assumes a black display state in a first field from among the first field and a second field that are adjacent in time and switches to a display state representing a brightness other than black in the second field is detected as a lighting transition cell based on the input video signal; and when the lighting transition cell is detected, at least one drive is executed from among a first forced lighting drive in which the lighting transition cell is forcibly set into the lighting mode only in the address process of a predetermined subfield from among the subfields, regardless of the brightness level indicated by the input video signal, in the first field, and a second forced lighting drive in which an adjacent discharge cell that is adjacent to the lighting transition cell is forcibly set into the lighting mode only in the address process of the predetermined subfield, regardless of the brightness level indicated by the input video signal, in the second field.

2. The drive method of a plasma display panel according to claim 1, wherein the predetermined subfield is a subfield with a brightness weight comparatively lower than those within other subfields.

3. The drive method of a plasma display panel according to claim 1, wherein in the first forced lighting drive, the adjacent discharge cells are also forcibly set together with the lighting transition cell into the lighting mode only within the predetermined subfield.

4. The drive method of a plasma display panel according to claim 1, wherein a brightness level at which the lighting transition cell is caused to emit light in the first field is detected based on the input video signal, and the number of adjacent discharge cells that have to be the object of the first forced lighting drive or the second forced lighting drive is set according to this brightness level.

5. The drive method of a plasma display panel according to claim 4, wherein the number of adjacent discharge cells that have to be the object of the first forced lighting drive or the second forced lighting drive decreases as the brightness level lowers.

6. The drive method of a plasma display panel according to claim 1, wherein in the address process of a leading subfield provided in the head portion of the field, from among all the subfields, setting to the lighting mode is performed by initiating a write address discharge in the discharge cell.

7. The drive method of a plasma display panel according to claim 1, wherein the plasma display panel has a front substrate and a rear substrate that are disposed opposite each other via a discharge space and comprises between the front substrate and the rear substrate, a plurality of row electrode pairs, a dielectric layer that covers the row electrode pairs, a protective layer that covers the dielectric layer, a plurality of column electrodes that extend in the direction crossing the row electrode pairs, and a fluorescent layer provided on the side of the rear substrate that faces the column electrodes, and the discharge cells are formed in the intersections of the row electrode pairs and column electrodes, and the protective layer is a magnesium oxide layer comprising a magnesium oxide crystal performing cathode luminescence emission that is excited by electron beam irradiation and has a peak within a wavelength region of 200 nm to 300 nm.

8. The drive method of a plasma display panel according to claim 7, wherein the grain size of the magnesium oxide crystal is equal to or more than 2000 Å.

9. The drive method of a plasma display panel according to claim 7, wherein the magnesium oxide crystal is provided in a state of being exposed to the discharge space.

10. The drive method of a plasma display panel according to claim 1, wherein the plasma display panel has a front substrate and a rear substrate that are disposed opposite each other via a discharge space and comprises between the front substrate and the rear substrate, a plurality of row electrode pairs, a dielectric layer that covers the row electrode pairs, a protective layer that covers the dielectric layer, a plurality of column electrodes that extend in the direction crossing the row electrode pairs, and a fluorescent layer provided on the side of the rear substrate that faces the column electrodes, and the discharge cells are formed in the intersections of the row electrode pairs and column electrodes, and the fluorescent layer contains magnesium oxide comprising a magnesium oxide crystal performing cathode luminescence emission that is excited by electron beam irradiation and has a peak within a wavelength region of 200 nm to 300 nm.

11. The drive method of a plasma display panel according to claim 10, wherein the grain size of the magnesium oxide crystal is equal to or more than 2000 Å.

12. The drive method of a plasma display panel according to claim 10, wherein the magnesium oxide crystal is provided in a state of being exposed to the discharge space.

13. The drive method of a plasma display panel according to claim 1, wherein a peak potential of a sustain pulse applied to the row electrode pairs in the sustain process is the largest from among the drive pulses applied to the row electrode pairs and column electrodes for driving the plasma display panel within the field.

14. The drive method of a plasma display panel according to claim 1, wherein the predetermined subfield is a subfield in which the brightness weight is the smallest from among the subfields.

15. A drive method of a plasma display panel by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to weighting of the subfield; and a forced lighting drive for forcibly setting into the lighting mode is executed only in the address process of a predetermined subfield from among the subfields, regardless of the brightness level indicated by the input video signal, with respect to a predetermined discharge cell from among the discharge cells.

16. The drive method of a plasma display panel according to claim 15, wherein the predetermined subfield is a subfield with a brightness weight comparatively lower than those within other subfields.

17. The drive method of a plasma display panel according to claim 16, wherein in the predetermined subfield, a peak potential of the row electrode in the sustain process is a ground potential.

18. A drive method of a plasma display panel by which a gradation display is performed by driving a plasma display panel in which a plurality of discharge cells each serving as a pixel are arranged, for each of a plurality of subfields constituting each field of an input video signal, wherein each of the subfields comprises an address process of setting each of the discharge cells into one mode from among a lighting mode and a quenching mode based on the input video signal, and a sustain process of causing an emission in only the discharge cell that has been set into the lighting mode, over a period corresponding to a brightness weight of the subfield;

the address process of at least two subfields from among the subfields is a selective write address process by which the discharge cell is set into the lighting mode by initiating a write address discharge with respect to the discharge cell;

a discharge cell that assumes a black display state in a first field from among the first field and a second field that are adjacent in time and switches to a display state representing a brightness other than black in the second field is detected as a lighting transition cell based on the input video signal; and when the lighting transition cell is detected, a forced lighting drive is executed by which the lighting transition cell is forcibly set into the lighting mode in the selective write address process of a predetermined subfield from among the subfields, regardless of the brightness level indicated by the input video signal, in the second field.

19. The drive method of a plasma display panel according to claim 18, wherein the predetermined subfield is at least two subfields that are disposed continuously within one field.

20. The drive method of a plasma display panel according to claim 18, wherein a brightness weight of the predetermined subfield is less than a predetermined brightness weight.

21. The drive method of a plasma display panel according to claim 18, wherein the predetermined subfield is at least two subfields that are disposed continuously within one field, and an erase process of setting all the discharge cells into the erase mode is provided immediately after the sustain process of the subfield disposed in front within the subfield.

22. The drive method of a plasma display panel according to claim 18, wherein the address process of the subfield following the subfield disposed in the rear side within each predetermined subfield is a selective erase address process of setting the discharge cell into the erase mode by initiating an erase discharge.

23. The drive method of a plasma display panel according to claim 18, wherein the plasma display panel has a front substrate and a rear substrate that are disposed opposite each other via a discharge space and comprises between the front substrate and the rear substrate, a plurality of row electrode pairs, a dielectric layer that covers the row electrode pairs, a protective layer that covers the dielectric layer, a plurality of column electrodes that extend in the direction crossing the row electrode pairs, and a fluorescent layer provided on the side of the rear substrate that faces the column electrodes, and the discharge cells are formed in the intersections of the row electrode pairs and column electrodes, and the protective layer is a magnesium oxide layer comprising a magnesium oxide crystal performing cathode luminescence emission that is excited by electron beam irradiation and has a peak within a wavelength region of 200 nm to 300 nm.

24. The drive method of a plasma display panel according to claim 23, wherein the grain size of the magnesium oxide crystal is equal to or more than 2000 Å.

25. The drive method of a plasma display panel according to claim 23, wherein the magnesium oxide crystal is provided in a state of being exposed to the discharge space.

26. The drive method of a plasma display panel according to claim 18, wherein the plasma display panel has a front substrate and a rear substrate that are disposed opposite each other via a discharge space and comprises between the front substrate and the rear substrate, a plurality of row electrode pairs, a dielectric layer that covers the row electrode pairs, a protective layer that covers the dielectric layer, a plurality of column electrodes that extend in the direction crossing the row electrode pairs, and a fluorescent layer provided on the side of the rear substrate that faces the column electrodes, and the discharge cells are formed in the intersections of the row electrode pairs and column electrodes, and the fluorescent layer contains magnesium oxide comprising a magnesium oxide crystal performing cathode luminescence emission that is excited by electron beam irradiation and has a peak within a wavelength region of 200 nm to 300 nm.

27. The drive method of a plasma display panel according to claim 26, wherein the grain size of the magnesium oxide crystal is equal to or more than 2000 Å.

28. The drive method of a plasma display panel according to claim 26, wherein the magnesium oxide crystal is provided in a state of being exposed to the discharge space.

29. The drive method of a plasma display panel according to claim 18, wherein a peak potential of a sustain pulse applied to the row electrode pairs in the sustain process is the largest from among the drive pulses applied to the row electrode pairs and column electrodes for driving the plasma display panel within the field.

* * * * *